US006433494B1

(12) United States Patent
Kulish et al.

(10) Patent No.: US 6,433,494 B1
(45) Date of Patent: Aug. 13, 2002

(54) INDUCTIONAL UNDULATIVE EH-ACCELERATOR

(76) Inventors: Victor V. Kulish, 55 Kosmonavitv Prospect, App 13, Sumy, 244035 (UA); Peter B. Kosel, 7474 Shawnee Run Rd., Cincinnati, OH (US) 45243; Alexandra C. Melnyk, 801 Bovee La., Powell, OH (US) 43065; Nestor Kolcio, 11500 Joromo Rd., Plain City, OH (US) 43064

( * ) Notice: Subject to any disclaimer, the term of this patent is extended or adjusted under 35 U.S.C. 154(b) by 0 days.

(21) Appl. No.: 09/551,762

(22) Filed: Apr. 18, 2000

Related U.S. Application Data

(60) Provisional application No. 60/130,585, filed on Apr. 22, 1999.

(51) Int. Cl.[7] ..... H05H 3/00; H05H 15/00

(52) U.S. Cl. ..... 315/500; 315/501; 315/111.61; 315/111.21; 315/505; 313/359.1; 250/251; 250/292; 250/396 ML; 250/423 R

(58) Field of Search ..... 315/500, 501, 315/505, 111.61, 111.21; 313/359.1; 250/251, 292, 396 ML, 423 R, 424

(56) References Cited

U.S. PATENT DOCUMENTS 5,073,913 A * 12/1991 Martin ..... 378/34

OTHER PUBLICATIONS

J.D. Cockcroft, E.T.S. Walter, "Experiment with high velocity ions. I. Further developments in the method of obtaining high velocity positive ions", Proc. Roy. Soc. A, vol. 136, p. 619 (1932).

E.O. Lawrence, M.S. Livingston, "The production of high speed light ions without the use of high voltages", Phys. Rev., vol. 40, p. 19 (1932).

D.W. Kerst, "The acceleration of electrons by magnetic induction", Phys. Rev., vol. 60, p.47 (1941).

M.S. Livingston, "The development of high energy accelerators", Dover Publications (New York; 1966).

V.V. Kulish, P.B. Kosel, A.G. Kailyuk, "New acceleration principle of charged particles for electronic applications. The general hierarchic description", Int. J. Infrared & Millimeter Waves, vol. 19, No. 1, p. 33 (1998).

(List continued on next page.)

*Primary Examiner*—Bruce Anderson
*Assistant Examiner*—Nikita Wells
(74) *Attorney, Agent, or Firm*—Mueller and Smith, LPA

(57) ABSTRACT

An improved device utilizing an inductive undulative EH-accelerator is proposed for acceleration and cooling of plasma fluxes, and beams of charged particles, and separate charged particles; and for forming of neutral molecular beams, and neutron beams (inductive undulative EH-accelerator) is proposed. The device consists of an electromagnetic undulation system, whose driving system for electromagnets, is made in the form of a radio frequency (RF) oscillator operating in the frequency range from about 100 KHz to 10 GHz; which is connected with coils of the undulatve system of electromagnets, and a source of accelerated particles, which is provided in the form of source of plasma or neutral molecular beams, or positive or negative ions, or charged particle beams, or separate charged particles. Other distinguishing features of the device are that at least a part of the cores and magneto-conductors of the electromagnetic undulation system is made from ferrite-type materials, and that the electromagnetic undulation system is used for purposes of acceleration of separate charged particles, or cooling and acceleration of charged particle beams and plasma fluxes. This is a compact system. The invention is related to such uses for which especially the problem of reducing of overall size, weight and cost of a device and increasing of its reliability is required.

82 Claims, 32 Drawing Sheets

OTHER PUBLICATIONS

V.V. Kulish, P.B. Kosel, A.G. Kailyuk, I. Gubanov, "New acceleration principle of charged particles for electronic applications. Examples", Int. J. Infrared & Millimeter Waves, vol. 19, No. 2, p. 251 (1998).
N. Taniguchi, "Energy–beam processing of materials", Oxford–Clarendon Press (Oxford; 1989).
K.A. Wright, "High energy electron beams for radiation applications", chapter 16, pp. 432–445, Introduction to Electron Beam Technology, R. Bakish (ed.), John Wiley & Sons (New York; 1962).
V.V. Kulish et al., "A compact high–power electron EH–accelerator for experimental realization", Proc. IEEE 12$^{th}$ Int. Pulsed Power Conference, Monterey, CA (1999).
V.V. Kulish et al,, "Compact electron EH–accelerator for intense X–ray flash source", Proc. SPIE Int. Conf. Millimeter & Submillimeter Waves, vol. 3771, p. 30 (1999).
L.H. Leonard, "Electron gun design", chapter 3, pp. 70–95, Introduction to Electron Beam Technology, R. Bakish (ed.), John Wiley & Sons (New York; 1962).
F. Rosenbury, "Handbook of electron tube and vaccum techniques", MIT, AIP Press (New York 1993).
J. R. Pierce, "Theory and design of electron beams", D. Van Nostrand Company (New York; 1949).
J.H. Moore, CC. Davis, M.A. Coplan, "Charged–particles optics", section 5 Building Scientific Apparatus, 2$^{nd}$ Edition, Addison–Wesley Publishing Company (Reading, MA; 1989).
D.E. Readley, "The theory of the Pierce–type electron gun", Electronics & Control, vol. 4, No. 1, p. 125 (1958).
T.S. Green, "Thermonuclear power", George Newnws Ltd. (London; 1963).
S.A. Cohen, "An introduction to plasma physics for materials processing", chapter 3, pp. 185–258, Plasma Etching, D.M. Manos & D.L. Flamm (Eds.), Academic Press (San Diego, CA; 1989).
H.P. Winter, "Applications of high–performance multicharged ion sources", chapter 1, pp. 1–32, Accelerator–based Atomic Physics Techniques and Applications, S.M. Shafroth & J.C. Austin (Eds.), AIP (New York; 1997).
F. Kalinichenco, V. Khomenko, S. Lebed, S. Mordic, V. Voznij, "Optimization of an RF ion source for production of a high energy ion microbeam", Nuclear Instr. & Methods in Physics Research B, vol. 122, p. 274 (1997).
P.F. Knewstubb, "Mass spectrometry and ion–molecule reactions", Cambridge University Press (New York; 1969).
H. Wollnik, "Ion optics in mass spectrometers", J. Mass Spectrometry, vol. 34, p. 991 (1999).
H. Wollnik, "Multi–pass time–of–flight mass analyzer", Int. J. Mass Spectrom. Ion Processes, vol. 96, p. 267 (1999.
M.I. Yavor, "Progress in ion optics for mass separation design", Nuclear Instr. & Methods in Physics Research B, vol. 126, p. 266 (1997).
M.I. Yavor, "Transformation of charged particle trajectories by a narrow gap between two magnetic prisms", Nuclear Instr. & Methods in Physics Research A, vol. 337, p. 16 (1993).
J. Roboz, "Introduction to mass–spectrometry instrumentation and techniques", John Wiley & Sons (New York; 1968).
B. Lax, K.J. Button, "Microwave ferrites and ferrimagnetics", McGraw–Hill Book company (New York; 1962).
Fair–Rite Products Corp., Catalog 13$^{th}$ Edition, "Fair–Rite Soft Ferrites", Wallhill, NY (1998).
A.H. Eschenfelder, "Magnetic bubble technology", Springer–Verlag (Berlin; 1980).
A.H. Bobeck, E. Della–Torre, "Magnetic bubbles", North–Holland Publishing Company (Amsterdam; 1975).
Motorola Semiconductor Products Inc., "RF Device Data", Third Edition, Phoenix, AZ (1983).
H. Granberg, "Get 600 watts RF from four power FETs", Application Note EB104, Motorola Semiconductor Products Inc.(1983).
P.H. Rose, "The three–stage tandem accelerator", Nuclear Instruments & Methods, vol. 11, p. 49 (1941).
D.W. Kerst, "The acceleration of electrons by magnetic inductions", Phys. Rev., vol. 60, p.47 (1941).
D.W. Kerst. R. Serber, "Electronic orbits in the induction accelerator", Phys. Rev., vol. 60, p. 53 (1941).
R.W. Howard, "Charged–particle accelerators", Appendix A, Nuclear Physics, Wadsworth Publishing Company (Belmont, CA; 1963).
M. Conte, W.W. MacKay, "An introduction to the physics of particle accelerators", World Scientific (Singapore; 1991).
D.H. Sloan, E.O. Lawrence, "The production of heavy high speed ions without the use of high voltages", Phys. Rev., vol. 38, p. 2021 (1931).
E.L. Ginzton, W. W. Hansen, W.R. Kennedy, "A linear electron accelerator", Rev. Sci. Inst., vol. 19, p. 89 (1948).
J.F. Kraus, D.A. Fleisch, "Electrodynamics", chapter 6, Electromagnetics with Applications, McGraw–Hill (Boston; 1999).
W.K.H. Panofsky, M. Phillips, "Classical electricity and magnetism", Addison–Wesley Publishing Company (Reading, MA: 1964).

* cited by examiner

INDUCTIONAL UNDULATIVE EH-ACCELERATOR

CROSS-REFERENCE TO RELATED APPLICATIONS

This application claims the benefit of U.S. Provisional Application No. 60/130,585, filed Apr. 22, 1999.

STATEMENT REGARDING FEDERALLY SPONSORED RESEARCH

Not applicable.

BACKGROUND OF THE INVENTION

The starting point in the history of particle accelerators can be taken as June, 1932, when J. D. Cockcroft and E. T. S. Walton first used electrostatically accelerated particles to disintegrate a nucleus. Shortly thereafter, E. O. Lawrence and M. S.Livingston demonstrated atom smashing with a new accelerator called the cyclotron, in which high particle energies are achieved by accelerating the particles across a single gap between a pair of electrodes situated in a magnetic field which turns the particles into circular orbits. See the following publications:

(1) J. D. Cockcroft, E. T. S. Walton, "Experiments with High Velocity Ions. I. Further Developments in the Method of Obtaining High Velocity Positive Ions", Proc. Roy. Soc., A, Vol. 136, p.619 (1932)

(2) E. O. Lawrence, M. S. Livingston, "The Production of High Speed Light Ions Without the Use of High Voltages", Phys. Rev. Vol. 40, p. 19 (1932).

Since then, many accelerators have been built so that today, accelerators for producing high energetic charged particle beams can be placed into several broad categories, depending on the particle energy produced:

Very low energy (100 KeV)

Low energy (0.1 to 10 Mev)

Medium energy (10 to 200 MeV)

High energy (0.2 to 1 BeV)

Very high energy (>1 BeV)

Very low energy accelerators are predominantly used in X-ray generators for medical applications and in electron microscopes. Low energy accelerators are used by the electronics industry for doping semiconductors. Medium energy machines are applied to smashing atoms. High and the very high energy accelerators are used for the generation of subatomic particles in high energy physics.

The very-low and the low energy accelerators are mostly electrostatic machines which need a source of very high voltage to operate. Here, the maximum voltage is limited to 5 MV, and is determined by the breakdown of insulation materials in air. These two systems are quite large in size, with the low energy systems being typically of 4 to 8 meters in length and occupying large rooms. For medium energy accelerators exceeding 10 MeV, the principle of acceleration by induction is applied. Here the particles undergo frequent impulses of energy increase as they move between electrodes driven by RF (radio frequency) power in step with their motion. These so called "induction accelerators" are usually circular and very large in size, with the particle orbit diameters being measured in kilometers. Some other medium energy machines, such as the betatron are used for the acceleration of electrons. They are also circular but very heavy because of the huge electromagnets used to produce an electric field by induction. See generally:

(3) D. W. Kerst, "The Acceleration of Electrons by Magnetic Induction", Phys,. Rev., Vol 60, p 47 (1941)

(4) M. S. Livingston, "The Development of High Energy Accelerators", Dover Publications (New York, 1966).

The semiconductor industry is a very large and important one in the US and in many other countries. Here particle accelerators of the very low and the low energy categories are used. However, their applications are very much restricted due to their size, weight and cost. Of the two types, electron beam accelerators are used for microelectronic circuit pattern generation on mask substrates. The other, the ion beam accelerators are used for the doping of semiconductors. These are rather peripheral uses of accelerator systems because the main "workhorse" operation in semiconductor microcircuit fabrication is the projection, or transfer, of the electronic circuit patterns on mask onto the surfaces of semiconductor wafers. The workhorses of this semiconductor industry today are predicated upon optical beam systems because they are much cheaper, small in size and more reliable than current particle accelerator systems. However, current semiconductor technology is now approaching the "door-step" of the limits of the capabilities of optical-based pattern-projection/transfer systems of excimer-laser-based optics. These systems produce light of wavelength near 150 nm, and since the fundamental optical resolution limit is the half-wavelength of light, this means that these optical systems will "run out" or become ineffective when industry moves, as essentially it must, down to 80 nm wide device structures. This limit is anticipated to be reached in about 5 years, that is around the year 2005. At the present time (year 2000) the smallest device dimensions in computer and memory semiconductor devices is at 180 nm. The 80 nm and smaller device dimensions will be needed to meet the future industrial requirements of faster circuits with increased number of transistors per circuit package. Therefore, for the semiconductor industry of the United States (which dominates and sets the world standards in this industry) to maintain its momentum of advancement, a new workhorse system needs to be developed. It was established some time ago (in the 1970's) that such systems must be based on charged particle accelerators such as electron accelerators, proton accelerators and heavy-ion accelerators. However, current particle accelerator technology cannot meet these needs. Heretofore, the state-of-the-art accelerators have been nothing more than scaled down versions of the 50 to 70 year old technologies pioneered by van der Graaf and Cockroft and Walton. Major advances in this early technology have been limited mainly to the construction of the associated electronics and have involved the replacement of vacuum-tube-based circuits with semiconductors-based ones. A compact accelerator as opposed to the relatively immense accelerator sizes of earlier technology will be required to fulfill this forthcoming need for a new type of workhorse in the semiconductor industry.

In 1997, Kulish, Kosel and Kailyuk proposed a new principle for the acceleration of charged particles and formation of quasi-neutral plasma beams. With this new technical approach to particle accelerators, the use of EH-undulated fields was proposed wherein both negative and positive charged particles could be accelerated simultaneously and unidirectionally. See generally the following publications:

(5) Victor V. Kulish, Peter B. Kosel, Alexander G. Kailyuk, "New Acceleration Principle of Charged Particles for Electronic Applications", The General Hierarchic Description, Int. J. Infrared & Millimeter Waves, Vol. 19, No. 1, p.33 (1998).

(6) Victor V. Kulish, Peter B. Kosel, Alexander G. Kailyuk, Ihor Gubanov "New Acceleration Principle of Charged Particles for Electronic Applications", Examples, Int. J. Infrared & Millimeter Waves, Vol. 19, No. 2, p 251 (1998).

The insight associated with this new approach earned a concomitant theory of hierarchic accelerations and waves. Their studies and, resultant theories hold promise for a new particle accelerator technology which looks to requisite compactness for applications not only with the semiconductor fabrication techniques of the future but in a wide range of new procedures and products.

Practical applications of this advanced technology now are called for.

BRIEF SUMMARY OF THE INVENTION

The present invention is addressed to particle accelerator structures and systems and to methods for carrying out particle acceleration to achieve the formation of energized particle beams from within beam production spacial regions of constrained extent. A combination of distributed excitation currents of relatively higher (R.F.) frequencies joined with uniquely configured acceleration channel defining core assemblies achieves the requisite spacial constraints through a directional altering of particle accelerating pathways which are established with magnetic materials effective to carry required time-varying magnetic fields and to permit the formation of resultant electric fields. Turning or undulating particle trajectories or paths are achieved in one embodiment with the use of steering assemblies intercepting particle trajectories to directionally alter them from one discrete acceleration channel segment into another as the energized particle trajectory path courses under electric field impetus from an overall accelerator structure input to its output.

Achieving compact accelerator architectures, these directionally changing particle directing paths may course from one to another of a sequence of parallel linear path segments with intra-path steering assemblies, or may employ circularly polarized EH-accelerators with continuous spirally-shaped acceleration channels having associated spirally-structured steering assemblies. Such a spiraling path arrangement is developed in conjunction with radially directed magnetic field formations evolved in accordance with the mandates of the system. Another approach to achieving spirally accelerating particle trajectories or paths employs longitudinally directed magnetic fields evolved from a unique core structuring and field winding arrangement which performs in conjunction with a centrally disposed open acceleration channel within which a spiral particle trajectory is formed and progresses from an accelerator structure input to its output.

Steering assemblies employed with the inventive accelerator architecture in general are formed with magnetically responsive core structures which are combined with a magnetic flux source to impose a magnetic field before an accelerating particle path of energized particles to Impose a curvature to that path. In one embodiment, rare earth magnets are employed to derive this magnetic field. In other embodiments, the permanent magnet derived fields may be modulated with electromagnetically derived fields to, in effect, tune the turning procedure. In one steering assembly arrangement, the turning magnetic field is combined with an accelerating electric field which is uniquely generated to evoke a particle accelerative effect within a turning environment. An advantageous feature of these steering assemblies resides in the development of a "cooling" effect with respect to energized particles within the particle path trajectory. This effect functions to refocus an accelerating energized particle beam within a turning procedure in a manner wherein those particles at higher energies and wider radial turning trajectories lose energy while those of shorter trajectories tend to gain energy to effect the focusing of the particle beam as it enters, is turned and returned to an accelerating channel.

Embodiments of the accelerator architecture will be seen to include sequences of mutually parallel linear acceleration stages formed in a single parallel arrangement or in cylindrical accelerator structures wherein an undulatory energized particle trajectory or path route is achieved in conjunction with steering assemblies. Multiple levels of these accelerator stage sequences are described with steering assemblies which may perform between the separated sequences or along each sequence of a given combination of sequences.

The accelerator architecture and methodologies also uniquely permit the common acceleration of particles of two different characteristics, for example, positive charge particles and negative charge particles which may progress along the same array of acceleration channels to emerge from the accelerator structure output as a composite beam of oppositely charged particles. With appropriate merger, this composite beam may then evolve a quasi-neutral or neutral beam output. Those neutral outputs have particular application to propulsion systems, as well as to a variety of industrial processes.

Where dual levels of accelerator stage sequences are employed in conjunction with steering assemblies, each such sequence of acceleration channel defined stages can be employed to evolve tandem or dual acceleration trajectories, for example, utilizing particles of opposite charge. The result is either a dual beam or composite beam output with an accelerator structure exhibiting little or dismissable transverse momentum or reaction due to particle path changes. In this regard, directionally induced forces will tend to cancel or mutually compensate.

Novel generic compact accelerators are now proposed which will produce charged particle beams with energies from a very low to the medium energy regimes. The maximum system lengths will be small (less than 3 meters) and no heavy electromagnets are involved. This compactness is achieved by folding the trajectory of the particle beam into a serpentine arrangement with the linear sections of the serpentine passing through magnetic material (ferrite) cylinders supplied with windings which are driven by RF currents. The compact nature of these accelerators will make it possible to arrange many of them into clusters (up to 10 to 200 units) into a small area to produce specialized equipment for the mass production of microelectronic circuits. This will assure maintenance of the momentum of advancement in the electronics industry. Overall, the relationship of this compact EH-accelerator to large high energy accelerators can be likened to the relationship of the small PC computer to the large mainframe computer.

In addition, the compact accelerators will fulfill other current industrial needs in the processing of materials and in the manufacture of microelectromechanical systems. In general, the invention also will provide novel and cost-effective applications in the production of:

(a) energetic anion and cation beams for etching and ion-milling in microelectronics and microelectromechanical device fabrication, (b) high-energy electron and ion beams for micro-welding and surface modification of dielectric and semiconductor surfaces, (c) high energy atomic beams for surface hardening of metals and alloys, (d) energetic neutral plasma beams for deposition and growth of thin amorphous and polycrystalline dielectric and semiconductor films, (e) monochromatic high energy electron and cation beam sources for very high energy accelerators, (f) cooling of electron and charged particle beams for very high energy accelerators, (g) high intensity short-wavelength x-ray beams for non-destructive examination of mechanical structures, and (h) sterilized foodstuffs against bacterial and virus infections.

See the following publications:

(7) N. Taniguchi, "Energy-Beam Processing of Materials. Clarendon Press-Oxford (Oxford, 1989).

(8) K. A. Wright, "High Energy Electron Beams for Radiation Applications," Chapter 16, pp 432–445, Introduction to Electron Beam Technology, R. Bakish, Editor, John Wiley & Sons (New York, 1962)

Other objects of the invention will, in part, be obvious and will, in part, appear hereinafter.

The invention, accordingly, comprises the method, apparatus and system possessing the construction, combination of elements, arrangement of parts and steps which are exemplified in the following detailed description.

For a fuller understanding of the nature and objects of the invention, reference should be had to the following detailed description taken in connection with the accompanying drawings.

DETAILED DESCRIPTION OF THE INVENTION

The EH-accelerators of the invention may assume a variety of possible configurations for their EH-fields. In general, three groupings for designs of these systems have evolved:

(a) where the crossed magnetic and vortex electric undulated fields which are developed are formed in the same parts of a constrained space utilizing dependent methods of generation of electric and magnetic fields;

(b) where both fields are generated in separate parts in the spacial volume of an accelerator, i.e., systems are employed with independent methods for generating electric and magnetic fields; and (c) where one part of a vortex electric and magnetic fields are generated in the same parts of the spacial region of the accelerator by independent methods and simultaneously another part is generated in separate parts of that space by dependent methods. These have been referred to as mixed systems.

The common feature of all of these modifications of fields is formation of an undulative-type particle trajectory. Such trajectories may be sine-wave-like, spiral or other more complex forms in what may be considered two-and three-dimensional trajectories or particle path routes. The EH-accelerator structures also can be classified with respect to the type of polarization of the EH-fields involved. For example, five types of EH-accelerators may be identified as follows:

(a) linearly polarized systems utilizing linearly polarized undulative EH-fields;

(b) circularly polarized systems where circularly polarized undulative EH-fields are applied;

(c) elliptically polarized systems where elliptically polarized undulated EH-fields are employed;

(d) accelerator systems with non-undulative fields, but with undulative particle path trajectories; and (e) mixed systems of the above, the circularly and elliptically polarized systems can be subdivided into cylindrical and coaxial architectures, while the linearly polarized systems can be classified into two-dimensional and three-dimensional architectures. The latter architectures are evidenced in multi-level mutually spaced sequences of accelerator stages. See the following publications:

(9) Kulish et al., "A Compact High-Power Electron EH-Accelerator for Experimental Realization", 12th International Pulsed Power Conference, IEEE, 1999, Monterey Calif.

(10) Kulish et al., "Compact Electron EH-Accelerator for Intensive X-Ray Flash Source". Proc. SPIE Int. Conf. Millimeter & Submillimeter Waves, Vol. 3771, p30 (1999).

Figure 1:
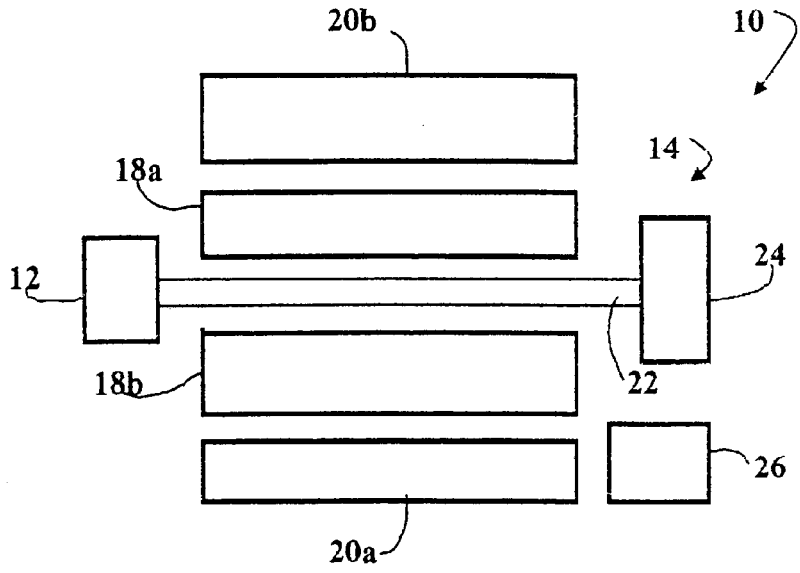
FIG. 1 is a schematic representation of an EH-accelerator according the invention.

In the discourse to follow, the figures being described may be considered to be provided in nine successive groups or categories. Certain of these groups of figures may be subcategorized into subgroups. Group 1 is considered to be of a general nature with respect to EH-accelerator concepts and is represented by FIG. 1. Group 2 includes FIGS. 2 through 7 and looks to the utilization of and architecture of particle sources. Group 3 incorporates FIGS. 8 through 12 and is concerned with the architecture of the acceleration channels for undulators employed with the method and system of the invention. Group 4 looks to designs for steering systems and includes FIGS. 13 through 15. Group 5 is concerned with single and multi-layer stacked accelerator channels and includes the subgroup 5A which includes FIGS. 16 through 21 looking to planar channel architecture, and Group 5B which includes FIGS. 22 through FIG. 24 concerning cylindrical and spiral channel constructions. Group 6 looks to designs for distributed R.F. current sources as are employed with the channel structures and is concerned with FIGS. 25 and 26. Group 7 is concerned with the formation of accelerated neutral molecular beams and is represented in FIG.

27. Group 8 is concerned with the principles of operation of EH-accelerator systems and is categorized having a subgroup, 8A incorporating FIGS. 28 through 37: and subgroup 8B, which is concerned with an independent generation of E and H fields and discusses FIGS. 38 through 43. Group 9 looks to techniques for particle steering and is represented by FIGS. 44 through 48.

Referring to FIG. 1, the general architecture or system of the invention is represented generally at 10. In the figure, a source of particles is represented at block 12. The source 12 may provide a broad variety of particle species which may be accelerated, including any charge carrying particles such as electrons, ions and the like. In general, the source of particles may be considered as being represented by four groups with respect to particle type. These groups are: (a) sources of separate charged particles; (b) sources of charged particle beams; (c) sources of plasma fluxes; and (d) sources of molecular fluxes. Those four groups may be subdivided into such sources as electron or ion guns or sources of plasma neutral molecular beams. Conventional electron guns which are used in the relativistic electronics and acceleration technologies may be employed. See generally the following publications:

(11) L. H. Leonard, "Electron Gun Design", chapter 3, pp 70–95, Introduction to Electron Beam Technology, R. Bakish, Editor, John Wiley & Sons (New York, 1962).

(12) F. Rosebury, "Handbook of Electron Tube and Vacuum Techniques", MIT, American Institute of Physics (New York, 1993).

(13) J. R. Pierce, "Theory and Design of Electron Beams", D. Van Nostrand Company (New York, 1949).

(14) J. H. Moore, C. C. Davis, M. A. Coplan, "Charged—Particle Optics", Section 5, Building Scientific Apparatus, 2$^{nd}$ Edition Addison-Wesley Publishing Company (Reading, Mass.; 1989).

(15) D. E. Redlay, "The Theory of the Pierce-Type Electron Gun", Electronics & Control, Vol 4, No. 1, pp 125–132 (1958).

Source 12 is represented as introducing a particle source into an electromagnetic undulator represented generally at 14. The undulator or acceleration channel structure 14 incorporates an acceleration channel path the input of which is represented generally at 16. This accelerator and associated channel are constructed with a spacially constrained configuration to achieve the highly desirable compact structuring of the invention. This is carried out typically in conjunction with directional transition regions which are evolved in a variety of architectures. With most of the architectures, steering components and the like are combined with specifically structured acceleration channels and inductive windings 18*a* and 18*b* to provide an accelerator structure. To impart accelerative drive to particles from the source 12, the acceleration channel design or undulator design incorporates a distributed time varying current source represented by paired blocks 20*a* and 20*b*. This distributed current source 20 may be implemented in a variety of ways, for example, utilizing staged and sequentially controlled amplification and phase control stages to drive magnetic material-implemented core structures and the like forming the structure generally represented at 14. The electromagnetic core architecture represented at paired blocks 18*a* and 18*b* will be driven with radio frequency (RF) current sources which function to provide a time varying magnetic field with respect to electromagnetic cores of the structure 14. As a consequence of the sinusoidal time-variation of the resultant magnetic field, a periodically time varying vortex electric field is generated by electromagnetic induction. The term "vortex" is utilized to describe the time-varying genesis of this field. The electric field inherits a spacial periodicity by virtue of the spacial periodicity of the underlying magnetic component of the resultant EH-field. It will be seen that a charged particle injected from the source 12 into the channel 16 typically will move along a serpentine trajectory under the influence of certain magnetic and crossed electric fields to realize a net acceleration. In general, a negatively charged particle from the source 12 will move and accelerate against the direction of the electric field lines of force, while a positive particle will move and accelerate in the same direction. The presence of the local magnetic field will cause the paths of both such particles to be bent in the same longitudinal direction which is perpendicular to the electric and magnetic vectors at the same time (See publication (7) above, p 40). The accelerated particle beam of the system 10 generally will be treated in correspondence with intended beam utilization as it emerges from the acceleration channel output 22. This treatment is represented as an output system or stage at block 24. Output stage 24 may be implemented, for example, as a "target" functioning, for example, to transform a negative ion beam into a neutral molecular beam. Such target stages may, for example, employ mercury vapors in accordance with the conventional practice observed in a particle acceleration technology. The entire system 10 generally will be controlled from a master control represented at block 26.

Figure 2:
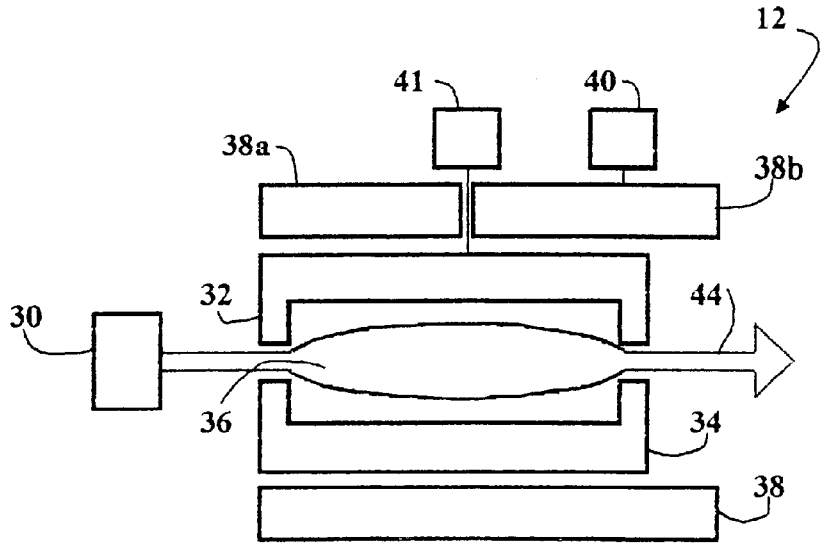
FIG. 2 is a schematic representation of a source component of the accelerator of FIG. 1 and is based on the utilization of a plasma trap.

Looking to FIG. 2 and to the commencement of the above-noted Group 2 of the figures, an embodiment for the source 12 represented in FIG. 1 is revealed which is based on the employment of a magnetic trap. This source 12 embodiment consists of a source of neutral molecules represented at block 30 which are introduced, as represented by introduction channel 32 to provide a molecular flux introduction into a discharge chamber 34 functioning to evoke an ionized plasma, schematically represented at 36. Containment of the plasma represented at 36 is provided in conventional fashion by a magnetic surround represented at block 38 and block pair 38*a* and 38*b*. A radio frequency (RF) source is represented at block 40, functioning to energize the driving source for the chamber 34 as represented at block 42. Thus, an electrode confining magnet is employed which has a current drive 42 evoked from the current source 40. The resultant plasma beam is represented at arrow 44 which is introduced to the accelerator input of the acceleration channel of the EH-accelerator structure. Those art-skilled will recognize that the magnetic trap of FIG. 2 is similar to those which are used in plasma fusion devices. Here however, the resultant plasma beam is introduced to the accelerator input of the EH-system of the invention. See generally the following publication:

(16) T. S. Green, Thermonuclear Power", George Newnes Limited (London, 1963).

Figure 3:
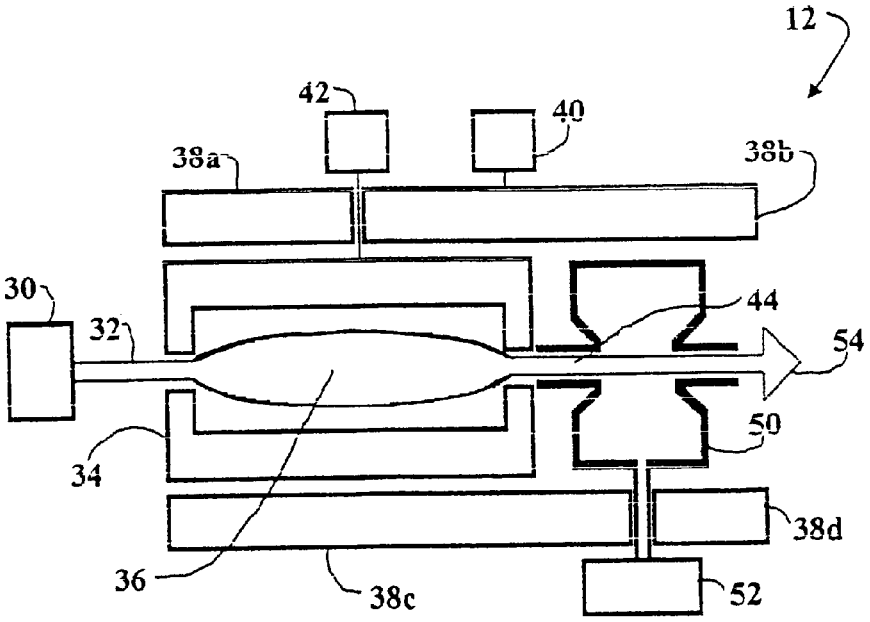
FIG. 3 is a schematic representation of a source represented in FIG. 2 with the inclusion of a microwave based beam modulation feature.

FIG. 3 represents an initial extension of the magnetic trap influenced source represented in FIG. 2. Accordingly, where appropriate, components of the source common with those described in connection with FIG. 2 are provided with the same identifying numeration with the exception that item 38 is represented having two components 38*c* and 38*d*. FIG. 3 provides an embodiment wherein a microwave resonator is coupled to the output plasma beam 44 as described in connection with FIG. 2. With this addition, a density modulated quasi-neutral plasma beam can be developed. Accordingly, depending upon the application desired, for example, pulses of the charged particles may be injected into the accelerator structure; positive and negative ions being extracted with the resonator addition. In the figure, the microwave resonator is shown at 50 being connected in driven relationship with a microwave oscillator or power generator 52 which incorporates a control system. It should be understood that the term "microwave" incorporates millimeter or sub-millimeter wavelengths. The output of the resonator is represented at arrow 54. As modified, this embodiment of the source 12 may be used, for example, as a source representing periodical, sequence-separated electron and ion micro-bunches. See the following publications:

(17) S. A. Cohen, "An Introduction to Plasma Physics for Material Processing", chapter 3, pp 185–258, Plasma Etching, D. M. Manos & D. L. Flamm, Editors, Academic Press (San Diego, Calif.; 1989).

(18) H. P. Winter, "Applications of High-Performance Multicharged Ion Sources", chapter 1, pp 1–32. Accelerator-Based Atomic Physics Techniques and Applications", S. M. Shafroth & J. C. Austin, Editors, American Institute of Physics (New York; 1997).

(19) F. Kalinichenco, V. Khomenko, S. Lebed, S. Mordic, V. Voznij, "Optimization of an R.F. Ion Source for Production of a High-Energy Ion Microbeam", Nuclear Instruments and Methods in Physics Research B, Vol 122, pp 274–277 (1997).

Figure 4:
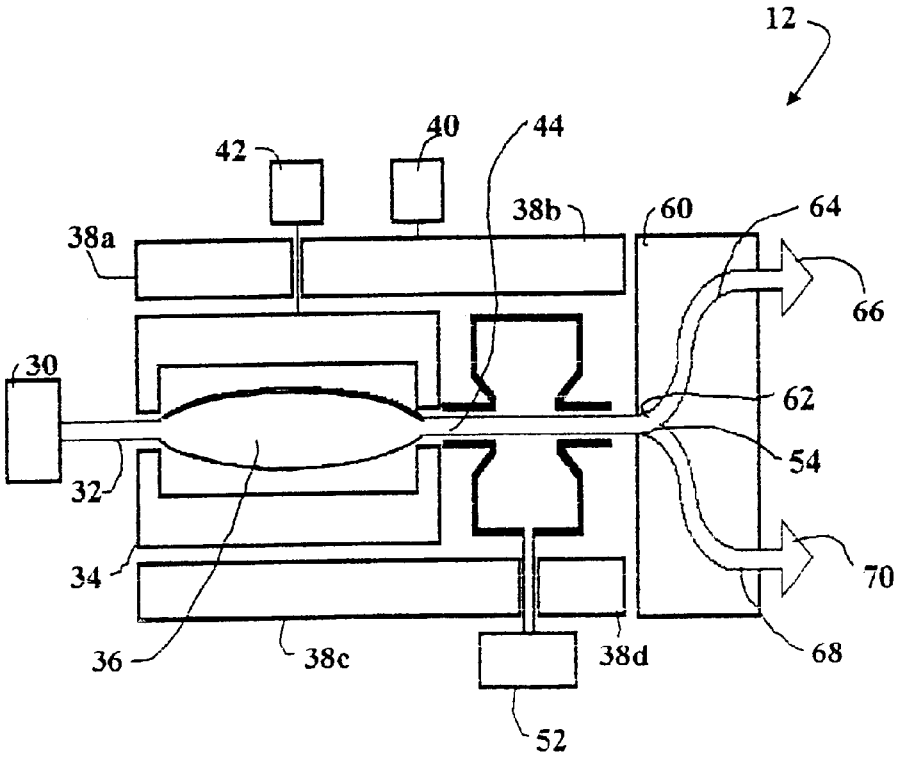
FIG. 4 is a schematic representation of the accelerator arrangement of FIG. 3 with the inclusion of a system for the separation of negatively and positively charged components of a charged particle beam.

Turning to FIG. 4, a representation of the particle source 12 embodiment shown in FIG. 3 is reproduced, again illustrating the arrangement wherein the output 54 provides a consolidation of positive and negative particles as derived from the resonator 50. With the instant embodiment, this dual particle output 54 is directed to the input 62 of a charged particle separator stage 60. Stage 60 functions to direct particles of one polarity, for example, positive particles along one path represented at 64 to an output represented at arrow 66; and particles of another or opposite polarity along a path 68 to an output represented as an arrow 70. Thus, the separator stage 60 functions to separate the positive ions from the electrons or negative ions at output 54. Such stages as at 60 typically are employed in accelerative and mass-spectrometric technologies. Outputs 66 and 70 generally are connected with two separate accelerator inputs of the acceleration channel of an EH-accelerator structure. A variety of employments may be made with the physically separated paths 64 and 68 carrying different types of charged particles. For example, the separate paths may provide the input to dual accelerator structures (FIG. 20) or a merger can be effected at the accelerator structure itself for developing a quasi-neutral particle beam output. See the following publications:

(20) P. F. Knewstubb, "Mass Spectrometry and Ion-Molecule Reactions", Cambridge University Press (New York, 1969).

(21) H. Wollnil, "Ion Optics in Mass Spectrometers", J. Mass Spectrometry, vol 34, pp 991–1006 (1999).

(22) H. Wollnil, "Multi-pass time-of-flight mass analyzer" Int. J. Mass Spectrom. Ion Processes, vol 96, p 267 (1990).

(23) M. I. Yavor, "Progress in Ion Optics for Mass Separation Design", Nuclear Instruments & Methods in Physics Research B, vol 126, pp 266–273 (1997).

(24) M. I. Yavor, "Transformation of charged particles trajectories by a narrow gap between two magnetic prisms." Nuclear Instruments & Methods in Physics Research A, vol 337, p 16 (1993).

(25) J. Roboz, "introduction to Mass-Spectrometry Instrumentation and Techniques", John Wiley & Sons (New York, 1968).

A form of quasi-neutral plasma beam representing a source 12 particularly is illustrated in connection with FIG. 5. Referring to that figure, an approach for mixing electron and cation beams is disclosed wherein a cation source represented at block 76 has a quasi-discontinuous cation beam represented at 78. Beam 78 is directed to the window of an electron gun represented at blocks 80*a* and 80*b* having a coaxial electron or negative ion particle output 82 which is aligned coaxially with the cation beam 78. The discrete electron beam and cation beam then are magnetically merged at a merging stage represented at blocks 84*a* and 84*b* to provide a quasi-neutral output beam represented at arrow 86. This quasi-neutral beam will have co-joined positive and negative particles, the merged mixture which evokes the quasi-neutral status thereof. As indicated above, with the present invention, such a beam, carrying oppositely polarized particles, may be accelerated with respect to both particle species along the same system directional vector.

Figure 5:
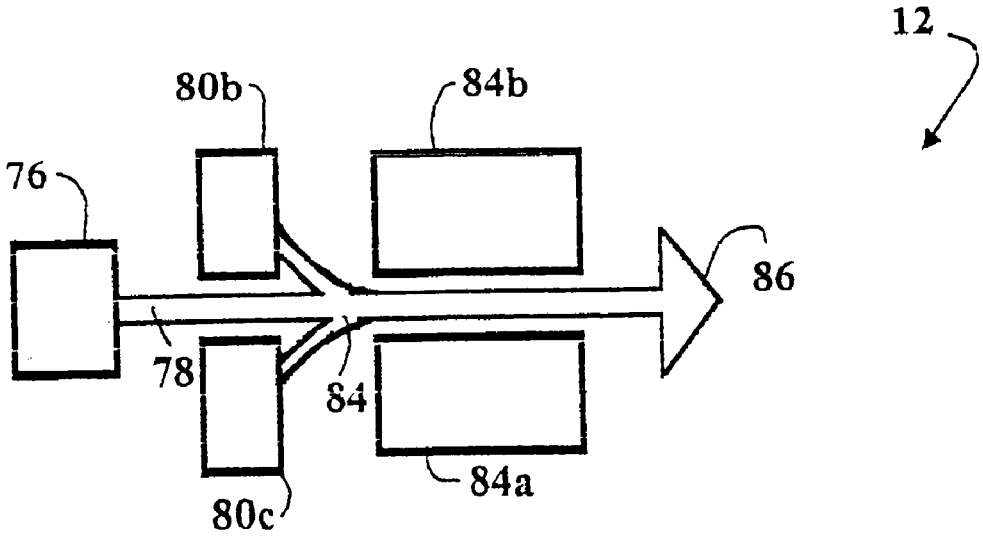
FIG. 5 is a schematic representation of a source component utilized in FIG. 1 which is based upon employment of a single-velocity electron gun and an ion source.
Figure 6:
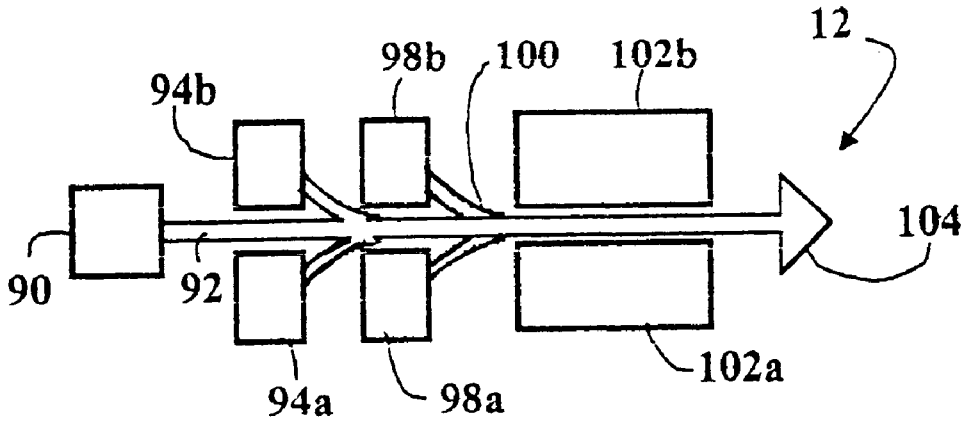
FIG. 6 is a schematic representation of a source according to FIG. 5 with the inclusion of a second electron gun of second velocity.

The source 12 construction represented in FIG. 5 may be modified to develop a modulation approach having two velocities of the electron beams utilized in merging with the cation beams to evoke a quasi-neutral beam source. In FIG. 6, a source 12 is shown wherein a cation source 90 provides a quasi-discontinuous cation beam 92. Beam 92 is joined with electrons at a first beam velocity generated by an initial electron gun represented at blocks 94*a* and 94*b*. The electron stream evoked with respect to electron gun 94 is joined in coaxial fashion with the cation beam 92 and this combination, representing discrete cation and ion particles is represented as a composite beam 96 to which is joined a second electron stream at a second predetermined stream velocity. That second electron gun implementation is represented at blocks 98*a* and 98*b*. The resulting composite beam, carrying electron streams at two distinct velocities, is represented at 100. Beam 100 then is submitted to a merging stage represented at blocks 102*a* and 102*b* which provides a merged composite beam represented at arrow 104. The beam 104 may be considered to be a mixed and focused quasi-neutral, two-velocity plasma beam, the merging stage 102 being employed for developing the focusing attribute of this beam 104.

Figure 7:
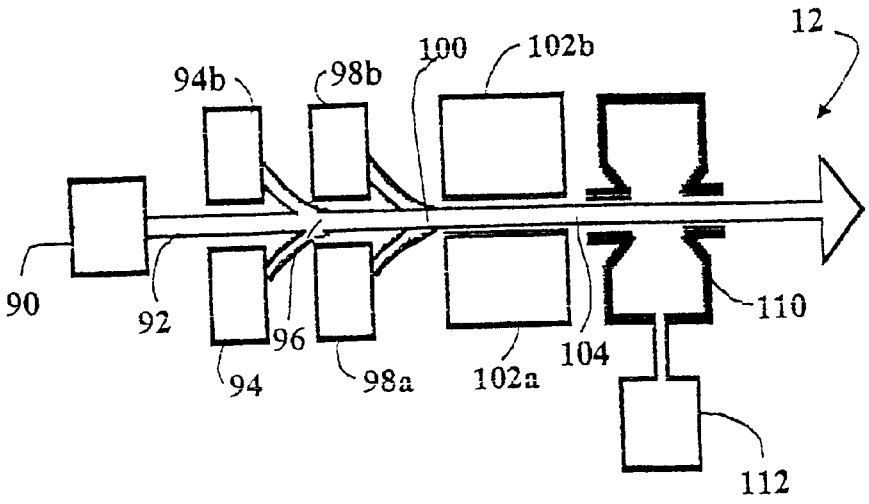
FIG. 7 is a schematic representation of the source arrangement of FIG. 6 with the addition of an electron modulator.

The particle source 12 embodiment shown in FIG. 7 builds upon that described in connection with FIG. 6 by further treating the quasi-neutral plasma beam with two velocities of electrons. In this regard, the beam is then microwave modulated to, for example, provide a pulsed quasi-neutral plasma beam. Generally, the two-velocity electron beam system exhibits an apparent instability or randomness. The instant embodiment employs that aspect of instability such that it functions as the origin of an oscillation utility. Thus, advantage is taken of the self-perturbation or non-stable state of the incoming composite beam to provide for the selection of a specific instability or modulation of particular frequency or the like. The system shown in FIG. 6 is repeated in FIG. 7. Thus, the same numeration is utilized for identifying parts or components common between the two figures. In the figure, a cation beam source is provided as represented at 90 which develops a quasi-discontinuous cation beam 92. Beam 92 is cojoined in coaxial relationship with the electron beam evoked from an initial electron gun stage represented at blocks 94*a* and 94*b*. The resultant composite beam is represented at 96 which is modified with a coaxially joined electron beam stream emanating from the electron gun stage represented at blocks 98*a*–98*b*. A composite beam 100 then is evolved containing electrons at two velocities which then is merged at a merging stage represented at blocks 102*a*–102*b* to provide a merged composite beam 104. Beam 104 may represent the periodic sequence of plasma micro-bunches in microwave, millimeter, sub-millimeter or infrared wavelength range. For the instant source 12 embodiment, the composite beam 104 is modulated at a modulator stage 110 which may be implemented as a microwave stage incorporating a microwave generator 112. As noted above, the self-perturbed or unstable particle stream 104 then is modulated by, in effect, picking out a select instability as a frequency modulation to take advantage of an otherwise chaotic-random aspect of the incoming beam.

As discussed above, the electromagnetic undulator 14 (FIG. 1) may assume architectures which can be categorized as previously set forth. Aspects of such architectures are discussed in the following discourse concerning earlier identified Group 3 of the drawings.

Figure 8:
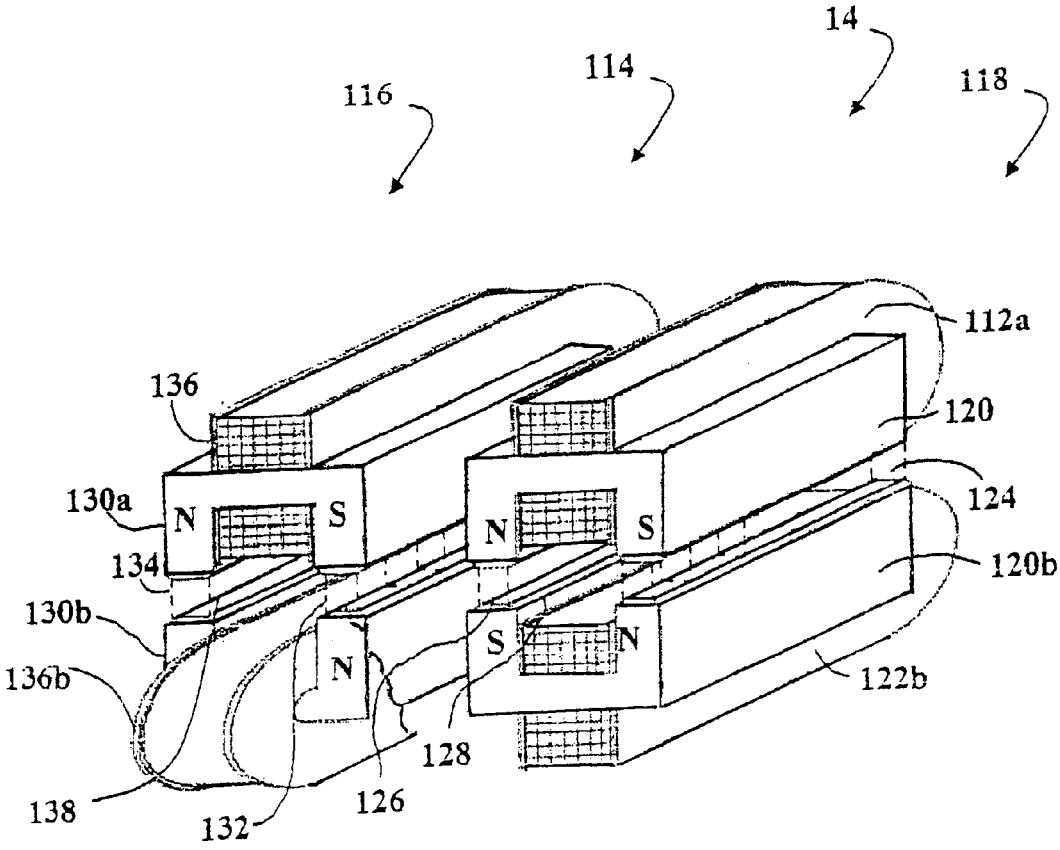
FIG. 8 is a partial sectional perspective view of two components of two adjacent stages of an accelerator structure according to the invention.

Referring to FIG. 8, a partial sectional view representation of two adjacent accelerator stages or accelerator periods of a sequence 114 of such stages, which typically will be arranged in a parallel relationship, i.e., along a generally centrally disposed plane is portrayed. An initial stage of this sequence 114 is represented generally at 118 and is seen to be formed of two, U-shaped core components 120*a* and 120*b*. Wound about these core components 120*a* and 120*b* are respective inductive winding assemblies or field winding assemblies, components of which are shown at 122*a* and 122*b*. Components 120*a* and 120*b* are mutually spaced apart in a vertical direction as represented in the figure to define gaps 124 and 126 between their pole-designated legs or limbs. Note in the figure that these pole designated limbs are identified as exhibiting north and south (N and S) polarities. In this regard, current direction in all of the electromagnet coils or field windings of the oppositely disposed core parts are the same. Thus, where the upper poles at core component 120*a* are designated N and S, the corresponding poles of the lower component 120*b* will be designated S and N. In consequence, a magnetic field generated between these poles in a long accelerator core turns out to be a transversely periodically reversed (undulative) one or one which is "H-undulated". The gaps 124 and 126 permit the positioning of any of a variety of possible non-magnetic inserts which may be employed as windows to ion beams, electron beams or the like. The core components and winding assembly represented at the stage 118 function to define an acceleration channel portion which may be constricted within a constrained structural configuration of an incorporating accelerator, and for the instant embodiment provides for a generally linear form of particle accelerator channel extending along the stage 118 as represented at 128. The second stage 116 of sequence 114 is structured essentially identically as stage 118. In this regard, stage 116 is formed with oppositely disposed core components 130*a* and 130*b* which are generally U-shaped and spaced apart to define gaps or windows 132 and 134. Each core component 130*a* and 130*b* supports a field winding component shown respectively at 136*a* and 136*b* of a field winding assembly. These field winding components cooperate with respective core components 130*a* and 130*b* to define an acceleration channel 138 which will be seen to be generally disposed in parallel with acceleration channel 128 of stage 118. In general, the stages or periods as at 116 and 118 will be repeated, for example, from first through nth in a sequence and each stage will extend to or between directional transition regions which will contain some form of a magnetic steering architecture causing the energized particle beams to traverse in an undulating pattern from one generally linear acceleration channel to the next. These directional transition regions and associated components, where applicable, will be seen to be configurable to evoke an improvement in the accelerative aspects of the system. Windings as at 122 and 136 along with their source of excitation are configured to provide what in fact may, be termed a distributed time varying current source which generates a core carried magnetic field about the acceleration channels 128 and 138 along with a corresponding crossed vortex electric field having particle accelerating directional vectors which result in a common system directional vector with respect to particles of both positive and negative polarity. This feature is discussed later herein, particularly in connection with FIG. 33 with respect to linearly polarized electromagnetic EH-undulator accelerators evolved with the features of FIG. 8.

Inasmuch as the method and system of the invention operates the acceleration channels as defined by core components and associated inductive windings in conjunction with a distributed time varying current source, for example, at radio frequencies, the selection of the material constituting the cores becomes an important consideration. In the latter regard, the core materiai, should be one which permits the oscillation of contained, inductively generated time varying flux to be in essentially sympathetic correspondence with the frequency of the distributed exciting current. The material used to constitute the cores, referred to in the physics disciplines as "ferrite" material, should be capable of flux conveyance for a sympathetic response at frequencies greater than about 0.1 MHz. Stated otherwise, the materials herein deemed "magnetic materials" are called upon to be effective to promote the inductive generation of magnetic fields at frequencies above about 0.1 MHz, for example, within a range of about 0.1 MHz to 10 GHz. In general, this calls for a magnetic material exhibiting a relative permeability within a range of about 100 to 200 and a B field saturation of about 0.2 to 0.5 Tesla. Such materials are marketed under the trade designation, "61 Material", for instance, by Fair-Rite Products Corp., of Wallkill, N.Y. See the following publications:

(26) B. Lox, K. J. Button, "Microwave Ferrites and Ferrimagnetics", McGraw-Hill Book Company (New York, 1962).

(27) Fair-Rite Products Corp., Catalog 13$^{th}$ Editon, "Fair-Rite Soft Ferrites", Wallhill, N.Y. (1998).

(28) A. H. Eschenfelder, "Magnetic Bubble Technology", Springer-Verlag (Berlin, 1980).

(29) A. H. Bobeck, E. Della Torre, "Magnetic Bubbles", North-Holland Publishing Company (Amsterdam, 1975).

Figure 9A:
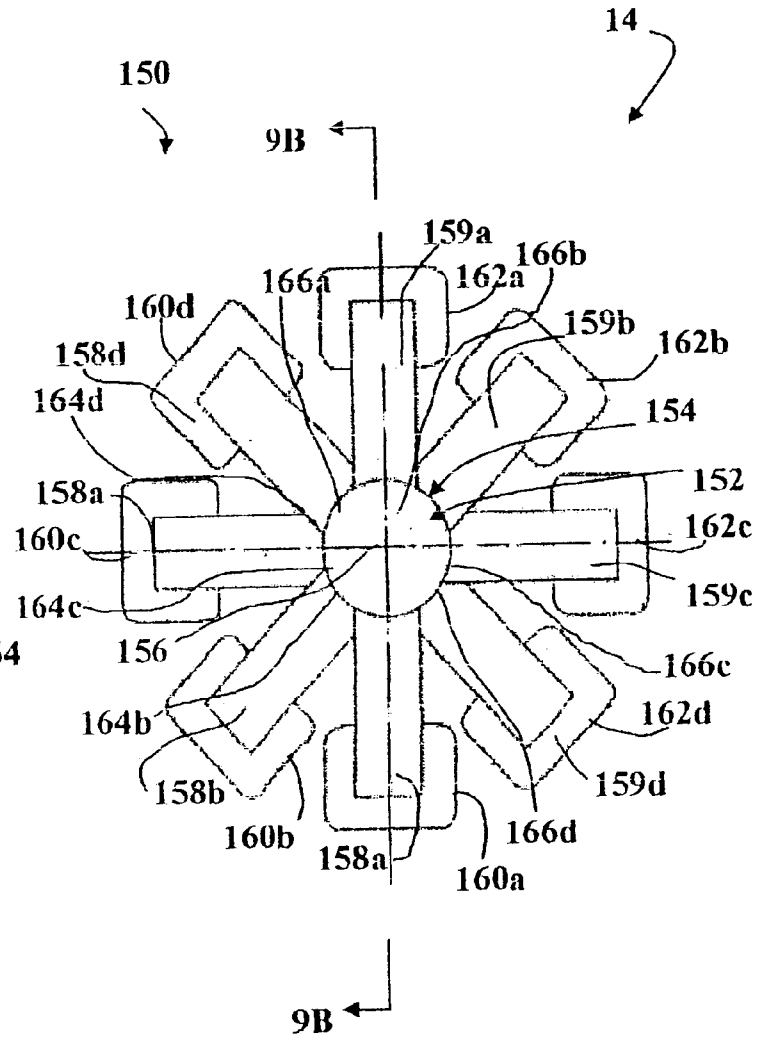
FIG. 9A is a top view of an accelerator of a circularly polarized type.

Referring to FIG. 9A, an EH-accelerator structure 14, is represented in general at 150. This accelerator structure is one which is termed to be "circularly polarized". FIG. 9A may be considered to look downwardly upon the top of the structure 150 which is seen to have an elongate acceleration channel 152 having a generally circularly curvilinear multi-faceted outer boundary 154 extending about the centrally disposed longitudinal axis 156. Boundary 154 preferably is of a geometrically defined circular shape but may be varied somewhat, the criteria of its shape being a requirement that it accommodate the induced magnetic field and vortex electric field which function to accelerate a particle stream into what may be termed a spiraling path route from an accelerator input, for example, at the topmost entrance region looking at FIG. 9A, to a lower region at an accelerator output. Channel 152 does not exhibit a continuous peripheral boundary surface, but that boundary is defined by the spaced-apart pole faces of the multiple stages of staggered sequences of accelerator stages from first to nth.

The top view of FIG. 9A shows that the accelerator sequences which develop an accelerator channel within the outer boundary 154 of channel 152 are in general parallel with the longitudinal axis 156 and are radially symmetrical with respect thereto and each, in effect, is disposed about one diameter extending through that axis 156. FIG. 9A shows that one such sequence is represented by the core and winding assembly including a core component represented generally at 158*a* and one oppositely disposed core component 159*a*. Component 158*a* will be seen to be formed with magnetic material support cores combined with a plurality of mutually oppositely disposed core legs arranged transversely to the longitudinal axis 156. About the support cores there are wound a sequence of stage field windings, the sequence of such windings being shown at 160*a* and 162*a*.

Configured in similar fashion, the next sequence of accelerator stages is represented by core assemblies 158*b* and 159*b* which, as before, are radially aligned with the longitudinal axis 156, and, in effect, arranged on a diameter extending from that axis which is angularly positioned 45° from the position of the accelerator stage represented by core component or assemblies 158*a* and 159*a*. Stage windings, the uppermost ones of which are shown at 160*b* and 162*b* extend about support cores forming part of the respective assemblies 158*b* and 159*b*. The next sequence of accelerator stages is shown in conjunction with the core assemblies 158*c* and 159*c* and the associated stage windings shown respectively at 160*c* and 162*c*. Note that this latter sequence also is radially disposed about the longitudinal axis 156 and lies along a common diameter which is displaced angularly 45° from the accelerator sequence of stages represented by pole assemblies 158*b* and 159*b*. As before, this sequence includes the stage windings 160*d* and 162*d* and note that the sequence of stages is radially disposed with respect to longitudinal axis 156 and is symmetrical about a common diameter extending through that axis and displaced angularly 45° from the sequences represented by pole assemblies 158*c*–159*c* and 158*a*–159*a*. FIG. 9A shows a particular symmetric arrangement of four stages azimuthally placed at 45° intervals but n (>4) stages could be used which would be azimuthally spaced at 180/n degrees apart.

Figure 9B:
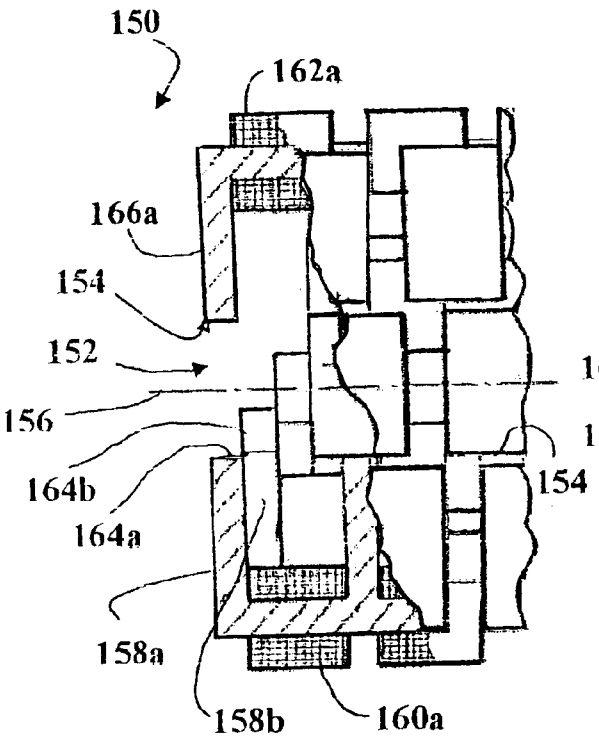
FIG. 9B is a partial sectional view taken through the plane 9B—9B in FIG. 9A.
Figure 9C:
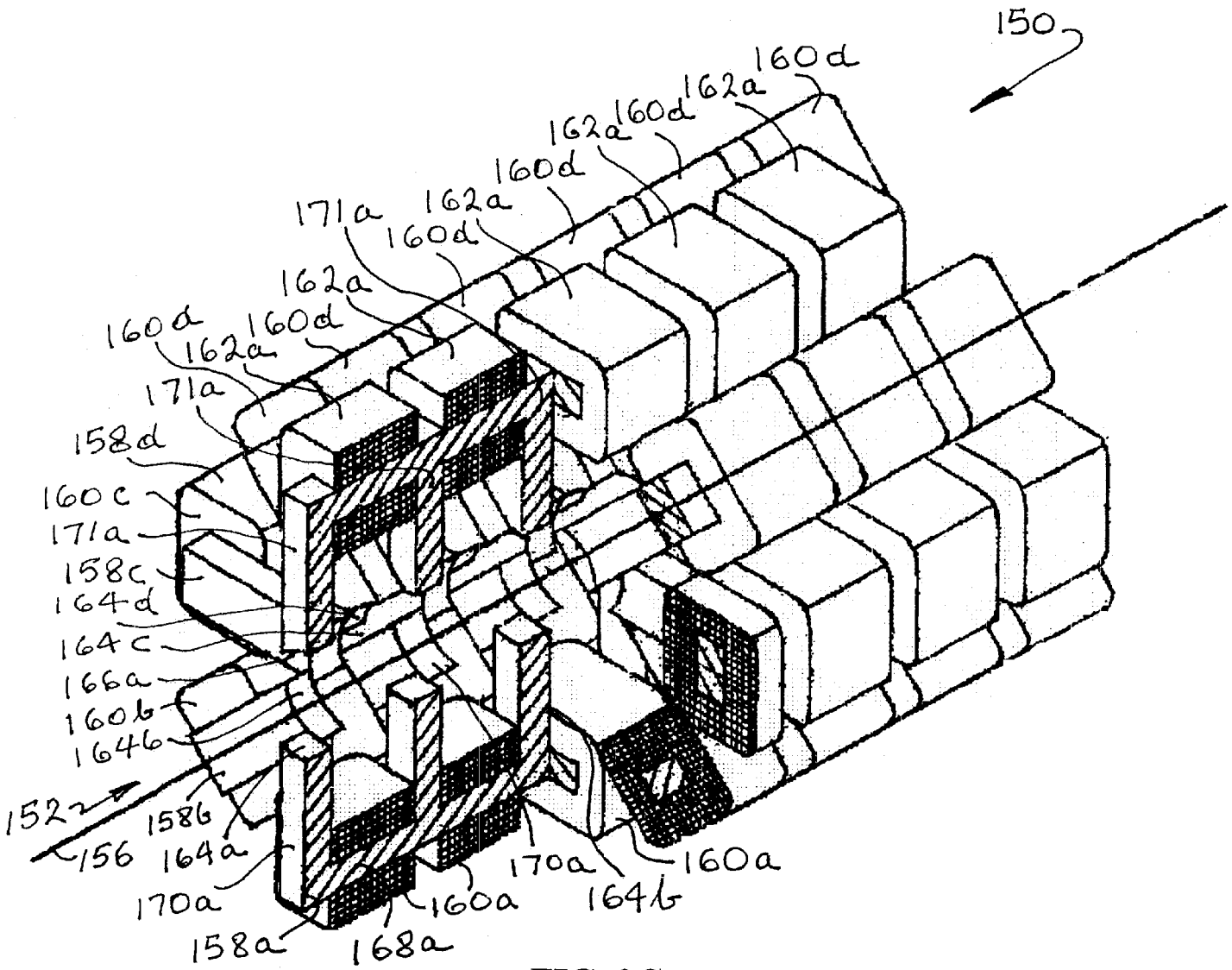
FIG. 9C is a perspective view of the accelerator of FIGS. 9A and 9B with portions broken away to reveal internal structure.

FIGS. 9B and 9C reveal the somewhat common structuring of the sequences described above. In this regard, the core assembly represented at 158*a* is seen to include support cores 168*a* and 168*b* about which a sequence of respective stage field windings 160*a* and 162*a* are wound. Note that integrally formed with and extending from these magnetic material core legs is a sequence of radially disposed magnetic fields. It may be observed that from the support cores and integrally formed therewith are a plurality of stage core legs. In this regard, core legs 170*a* are integrally formed with and extend from support core 168*a* to a sequence of curved pole faces 164*a*. Those faces define the outer boundary 154 extending about the longitudinal axis 156. Similarly, core legs 171*a* extend from the support 168*b* to pole faces 166*a*. Curved pole faces 166*a* are diametrically opposite pole faces 164*a*. The same arrangement of components applies with respect to each of the sequences. By applying an appropriately phase controlled excitation current to the stage windings of the system thus revealed a magnetic field is formed within the core assemblies for each sequence which exhibits a particle turning effect and a corresponding cross electric field having a particle accelerating vector along the axis 156. These latter vectors effect the accelerational propagation of the particles from the entrance region of the system toward the exit region and that particle path of acceleration is one of a curvilinear or circular variety which spirals from the entrance to the exit of the system. This approach also works in conjunction with particles of different characteristics, for example, particles of positive charge and particles of negative charge. For such a source particle combination, the particles of one charge designation will be accelerated in a one spiral trajectory or path from the entrance to the exit of the acceleration channel, while particles of an opposite polar designation will spiral in a correspondingly opposite but spiral direction from the entrance of the system to the exit of the system. Such an arrangement provides a neutral or quasi-neutral form of energized particle beam output. Of particular interest about this form of generation of that neutral output, the trajectories of acceleration of these particles are essentially of mutually oppositely disposed momentum which, in effect, cancels any transverse force development. This feature is quite beneficial when dealing, for example, with space propulsion or beam propagation under conditions where forces transverse to the direction of particle propagation at the exit of the system are not particularly a desirable effect.

Figure 35:
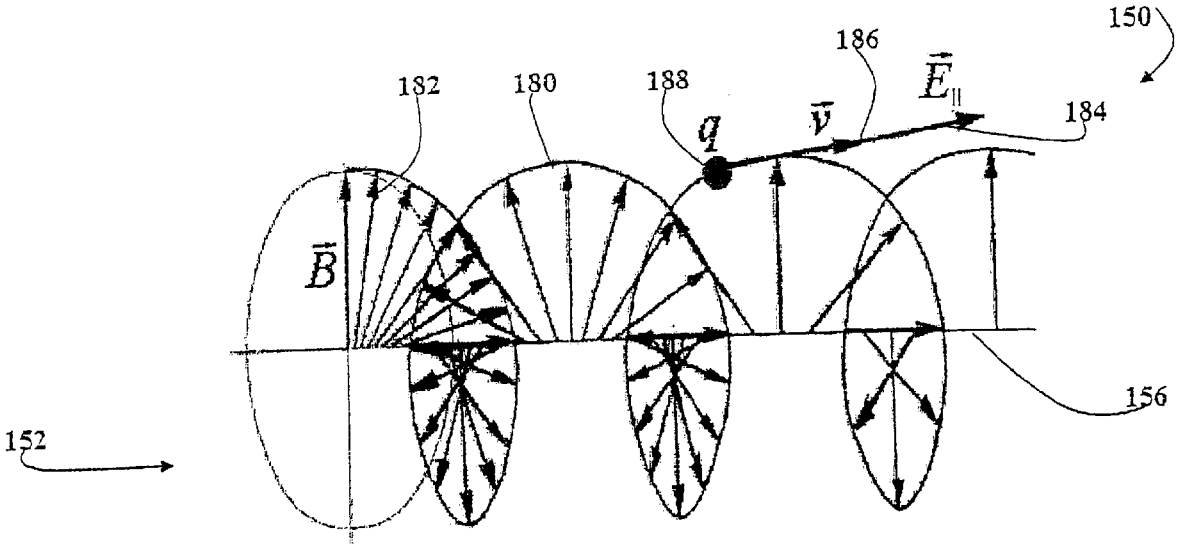
FIG. 35 is a schematic representation of the trajectory of an electron in a circularly polarized EH-accelerator.

Looking momentarily to FIG. 35, the spiral-like particle path route for the accelerator 150 is represented at 180 in conjunction with a sequence of vectors 182 showing the corresponding magnetic field vectors generated by the time-varying winding excitation as it affects the pole pieces of the system. Note that the vectors 182 are generated in a distributed sequential fashion to evoke crossed electric fields functioning to accelerate the particles along the particle path having an electric field vector represented at 184 which both represents the system vector and is seen to be tangentially oriented to the helix or spiral path 180. Vector 184 additionally is represented at $\vec{E}_{II}$. This vector 184 also incorporates a velocity vector, $\vec{v}$, as at 186 and is associated with a charged particle, q at 188. The magnetic field is represented at $\vec{B}$ thus, the particle trajectory or path route 180 is formed under an action generated as a transverse circularly polarized undulative magnetic field $\vec{B}$. The plane or surface, which is formed by the association of vectors of induction $\vec{B}$ (182), has a spiral-like configuration.

Figure 10:
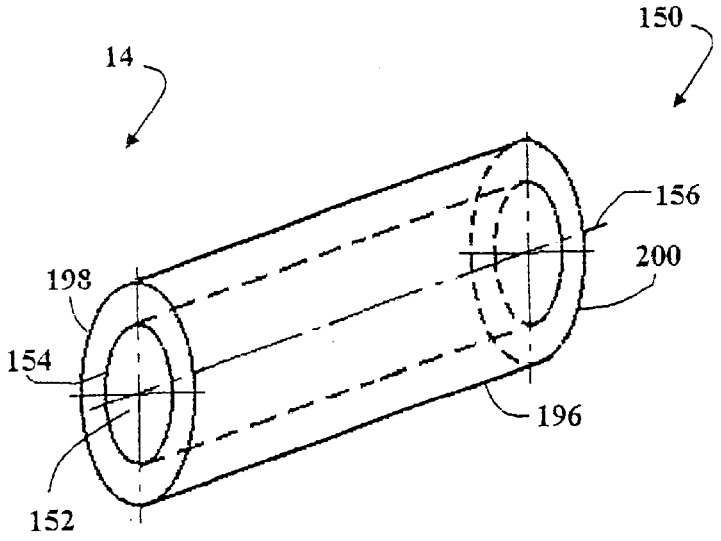
FIG. 10 is a schematic representation of spacial regions containing components according to the arrangement of FIGS. 9A, 9B and 9C.

To gain a perspective visualization of the overall structure of the accelerator 150 in space, reference is made to FIG. 10. In FIG. 10, the accelerator or undulator 150 is shown to be formed having a core and winding assembly which may be confined between a cylindrical outer boundary 196 and the above-noted acceleration chamber boundary 154. The accelerator input will be adjacent one side of this structural volume as represented at 198, while the corresponding accelerator output will be adjacent to the opposite extent of the boundary 154 and outer cylindrical confinement 196.

Figure 11:
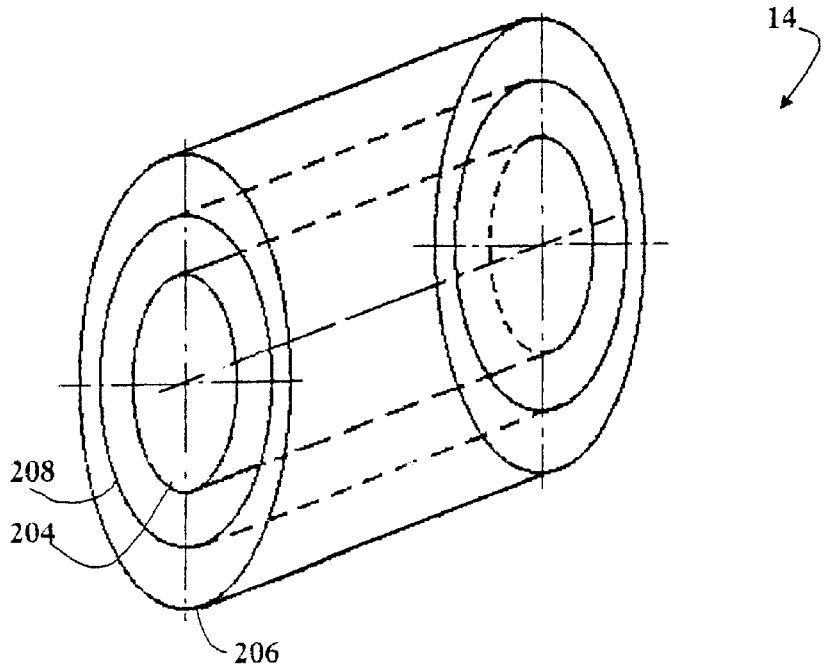
FIG. 11 is another embodiment of the spacial arrangement which may be utilized for accelerators according to the design aspects of FIGS. 9A, 9B and 9C.

A coaxial form of architecture also may be realized with the circularly polarized electromagnetic accelerator or undulator. A schematic spacial arrangement for such an architecture is illustrated in FIG. 11. For this configuration, the accelerator is formed of two separate parts which are spacially represented as an internal core and winding assembly as at the cylindrical space 204 and an outer cylindrical space configured as a cylinder with an annular cross section as represented at 206. The outer space 204 and inner space 206 cooperate in terms of their radial extent to define an acceleration channel 208. Thus, the acceleration channel 208 is confined within two cylindrical boundaries from each of which the undulative magnetic field emanating from appropriately positioned pole faces evokes a spiral circular trajectory-based particle route as described supra in connection with FIG. 35. In effect, the acceleration channel has a pipe-like form. The stage pole faces are so arranged within the configuration of FIG. 11 that a north facing external electromagnetic pole face of the external spiral "sees" the corresponding opposite south pole of the internal spiral magnetic face and vice versa.

A similar arrangement is evolved with elliptically polarized electromagnetic accelerators or undulators which may be configured in accordance with the spacial arrangements illustrated in connection with FIGS. 10 and 11. The difference between those electrical systems and the instantly described circularly polarized one is that in the case of the elliptically polarized system, the acceleration channel has the form of a cylinder with an elliptical boundary.

A conical version of this arrangement also is within the scope of the invention. With such a conical arrangement, the circularly or elliptically polarized versions of the accelerator structure are configured such that lateral cross-sections, for example, through axis 156 (FIG. 10) vary to define a conical arrangement from accelerator input to accelerator output. A conical shaping or truncated conical shaping of the structure of the instant accelerators may be evolved as consequence of the gradually increasing particle energies as the accelerator channel progresses from its accelerator input to the accelerator output. Larger diameter outer boundaries of the acceleration channel will accommodate for these larger particle energies, thus leading to the noted variation in overall shape of the accelerator structure.

A significant aspect of the parallel form of an accelerator stage sequence resides in a facile opportunity to form the magnetic material core in unitary or integral fashion. In this regard, in contrast to FIG. 8 the core component pole faces are not spaced apart between one and the opposite side of a gap and, accordingly, the reluctance otherwise evoked at a narrow gap or the like is avoided. The result is a more efficient construction from the standpoint of requisite drive current or power demand.

Figure 12:
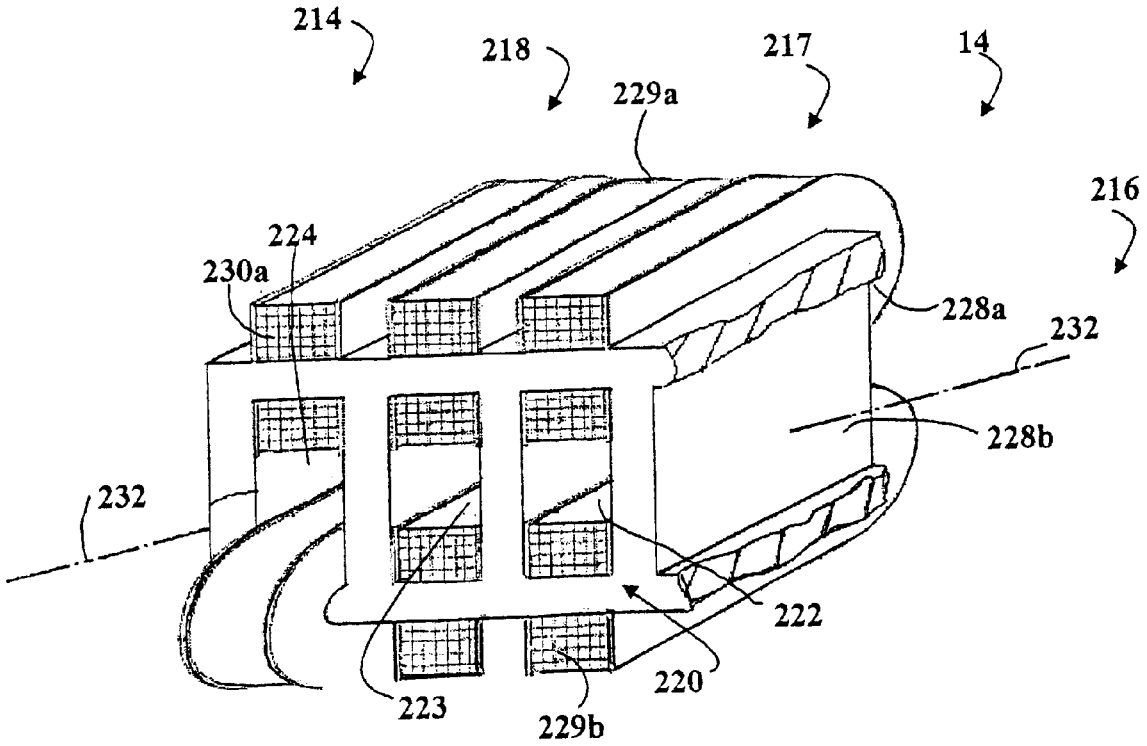
FIG. 12 is a perspective sectional view of an accelerator according to the invention employing an integral core structure.

Referring to FIG. 12, an accelerator structure is represented generally at 214 which incorporates a sequence of stages arranged in the above-noted orientation wherein they incorporate linear acceleration channel components which are arranged generally in mutually anti-parallel fashion. This type of accelerator structure corresponds with the above-noted independent method of generation of the vortex electric and magnetic fields. Note that three stages of the sequence are shown as represented in general at 216–218. Stages 216–218 perform in conjunction with a singular integrally formed core member represented generally at 220 and configured of magnetic material meeting the above-identified criteria. Core member 220 is configured having a sequence of open channels 222–224. As in the case of stages 216–218, the acceleration channels 222–224 are linear and arranged in parallel with each other, each having a channel entrance (not shown) and a channel exit which is oppositely disposed therefrom. In the same fashion as described in FIG. 8, each of the stages 216–218 incorporates a field winding assembly functioning to respond to an applied, time varying current source to, in turn, generate a magnetic field coursing along the core member 220 and evoking crossed electric fields at the location of each of the acceleration stage channels 222–224. The field windings for respective stages 216–218 are represented at 228–230, the uppermost winding components being identified with the suffix "a" and the lower winding components being identified with the suffix "b". It should be understood that a predetermined number of such acceleration stages will be incorporated in any particular sequence, including the parallel oriented sequence shown, for example a number extending from first to last such stages. For example, the sequence of stages 216–218 and any further stages adjacent to those stages such as might be represented to the right of stage 216 may be arranged in a continuing parallel fashion. In this regard, the channels 222–224 and any contiguous such acceleration channels may be considered to be somewhat symmetrically disposed about a plane represented at line 232 in the drawing.

As thus described, the stages 216–218 will function to drive particles along the linear extents of their acceleration channels, for example, represented at 222–224. Particularly for embodiments where linear accelerator channel components are utilized, a magnetic steering assembly is provided. This magnetic steering assembly will be located at the exit and corresponding entrance of an adjacent acceleration channel and will function to cause the charged particle beam to turn from one acceleration channel exit and enter into another, for example, at the next adjacent accelerator channel entrance. In effect, at these turning assemblies, the EH-fields of the accelerator stages are excited and the magnetic fields evoked by the steering assembly carries out the turning or an imposed curvature of the accelerating particle beam. Unusual advantage will be seen to accrue by virtue of the utilization of the steering assemblies. In this regard, a later-described "cooling" effect can be developed as well as a desirable particle beam focusing effect. For some applications, a supplementary accelerating energy can be induced into the charged particles as they are moved within these directional changing features of the system.

The instant discussion now turns to the subject matter of the steering assembly which is earlier-described as being associated with Group 3 encompassing FIGS. 8 through 12. Of course, these steering assemblies constitute an important contribution to the highly desirable constrained configuration or structuring of the acceleration channels of systems 10. Any of the given steering assemblies to be described may be considered to have an input which receives an emerging particle beam from the exit of an accelerator channel. The steering assembly, curves or turns the particle beam to emerge from a steering assembly output into the input of another or a next acceleration channel in any given sequence of such channels where discrete channel segments are involved.

Figure 13A:
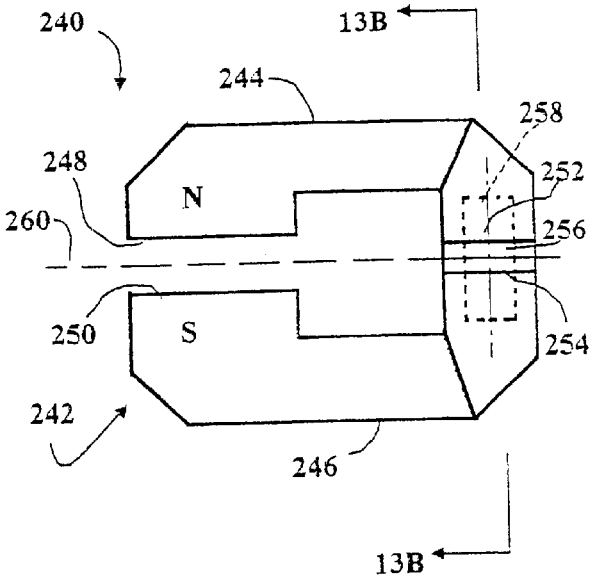
FIG. 13A is a plan view of a steering assembly according to the invention.
Figure 13B:
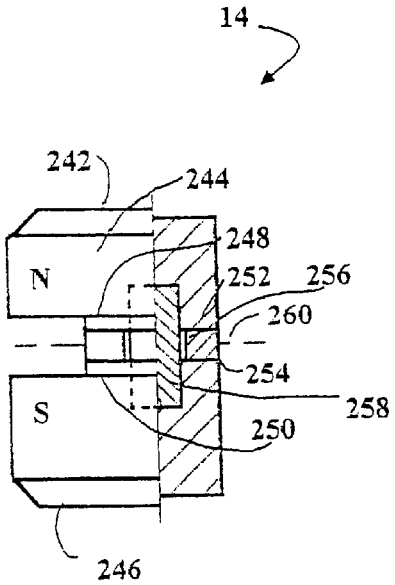
FIG. 13B is a partial sectional view taken through the plane 13B—13B in FIG. 13A.

Referring to FIGS. 13A and 13B, an initial embodiment of a steering assembly is revealed. In FIG. 13A, the assembly 240 is shown to be constructed with a core assembly represented generally at 242. Core assembly 242 is fashioned of magnetically responsive material and incorporates spaced apart core legs or limbs 244 and 246 which extend to respective polar designated pole faces 248 and 250. Note in this regard that face 248 is designated arbitrarily as "North", while face 250 is designated as being "South". Looking additionally to FIG. 13B, it may be seen that core legs 244 and 246 extend to respective rear faces 252 and 254 at which position they are spaced apart, as well as joined by an insulative or non-magnetic material insert 256. A source of magnetization for the steering assembly 240 is provided by a rare earth magnet, for example, formed of samarium cobalt (SmCo) and shown having a rectangular periphery as is represented at 258.

With the arrangement shown, steering assembly 240 will be positioned at an acceleration channel directional transitional region such that the magnetic field derived between pole faces 248 and 250 will cause a turning or transition of the particle beam from one acceleration channel to the next. The arrangement of the assembly 240 with respect, for example, to an acceleration channel 222–224 as described in connection with FIG. 12, will be one wherein the plane parallel to pole faces 248 and 250 as represented at 260 will be parallel to the acceleration channel plane of particle movement represented at plane 232 in FIG. 12.

The strength of the magnetic field evoked with the steering assemblies is selected in correspondence with the particle energy of acceleration involved. As that energy increases, for example, as the accelerator output is approached, the extent of turning developed by the steering assembly will be accommodated correspondingly by increasing magnetic strength. Practical experience with turning assemblies show that they are effective, for example, in turning about radii at least as small as about 1½ cm. The particle beam path may exhibit some fringing during its entry into this turning maneuver, a condition which will be seen to be accommodated for.

Figure 14A:
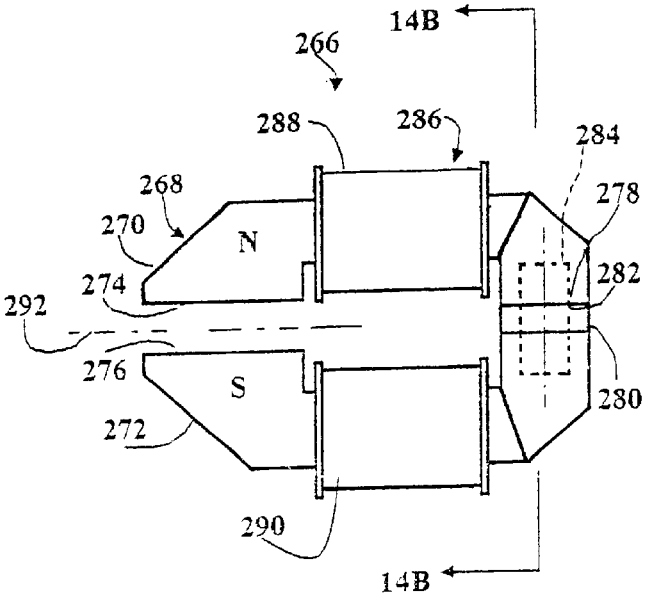
FIG. 14A is a plan view of another embodiment of a steering assembly according to the invention.
Figure 14B:
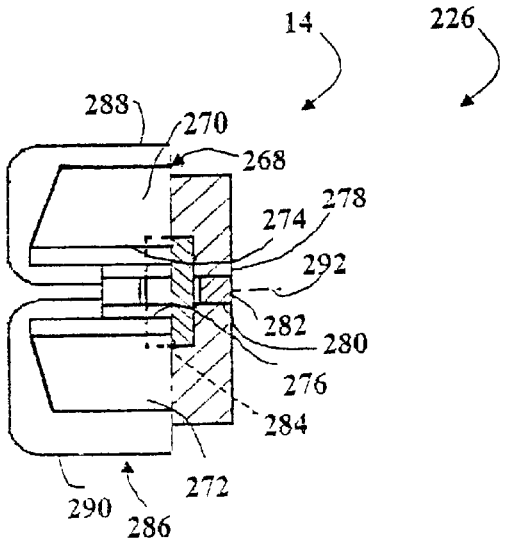
FIG. 14B is a partial sectional view taken through the plane 14B—14B in FIG. 14A.

Looking to FIGS. 14A and 14B, a next adaptation of the steering assembly is represented in general at 266. Somewhat similar to the embodiment of FIGS. 13, the steering assembly 266 is seen in FIG. 14A to be comprised of a core assembly shown generally at 268. Assembly 268 is comprised of two magnetically responsive core legs 270 and 272 which extend forwardly to respective pole faces 274 and 276 and rearwardly to respective spaced apart rear faces 278 and 280. Rear faces 278 and 280 are joined by a non-magnetic spacer 282 and, as before, are each combined with one polar side or end of a permanent magnet which may be provided, for example, as a rare earth magnet such as one comprised of samarium cobalt. In the instant embodiment, the permanent magnet magnetized core assembly 268 additionally is connected in magnetic flux transfer relationship with an electromagnetic assembly represented generally at 286 and comprised of inductive windings or coils 288 and 290 coupled in magnetic flux transfer relationship with respective core legs 270 and 272. These electromagnetic devices 288 and 290 may be excited with current to provide an operator adjustment of the magnetic turning field at the gap between faces 274 and 276. As before, that gap is aligned such that pole faces 274 and 276 are parallel with what may be considered the corresponding plane of an associated acceleration channel exit and adjacent acceleration channel entrance. The plane so described is represented in the present figures at 292. It should be observed that by appropriate manipulation of applied current direction and levels at the windings 288 and 290, the magnetic field derived intermediate pole faces 274 and 276 may be adjusted to increase or decrease as determined or selected by the operator.

Figure 15A:
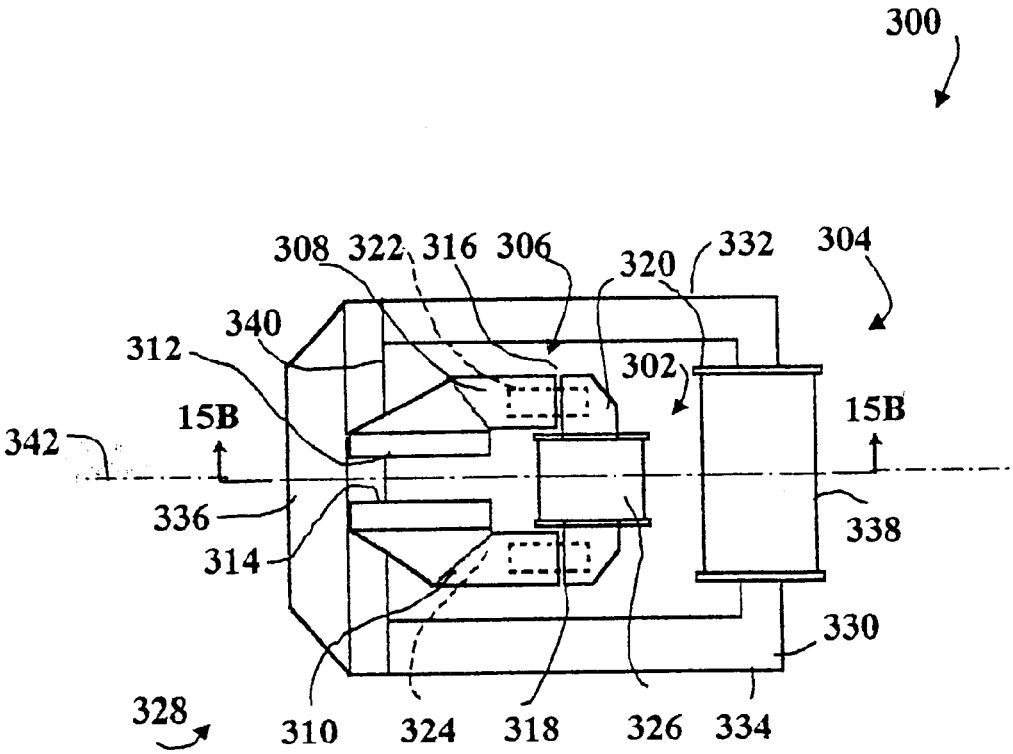
FIG. 15A is a plan view of a steering assembly of the invention.

Looking to FIGS. 15A and 15B, a composite steering assembly 300 is revealed which, in part, incorporates a permanent magnet based steering assembly with electromagnetic trimming for adjustment of the resultant magnetic turning field, an arrangement generally described in connection with FIGS. 14 and shown in general at 302 in the instant figures. Superimposed upon this turning magnet assembly 302 is a steering article accelerator assembly represented generally at 304.

Looking to the steering assembly 302, as before, it is seen to be comprised of a core assembly represented generally at 306 and including oppositely disposed core legs 308 and 310 formed of magnetically responsive material. Legs 308 and 310 extend forwardly to provide magnetic pole faces shown respectively at 312 and 314 in parallel relationship with plane 342, and extend rearwardly to rear faces shown respectively at 316 and 318. Faces 316 and 318 are positioned in spaced adjacency but in magnetic flux communication with a rear core component 320. Mounted intermediate and in flux transfer relationship between component 320 and core rear face 316 is a rare earth permanent magnet 322 and, correspondingly, mounted between rear face 318 of core leg 310 and rear component 320 is a similar permanent magnet 324. Permanent magnets 322 and 324 function to provide a steady state turning magnetic field between pole faces 312 and 314. This turning magnetic field may be modified or tuned by the select excitation of an inductive winding 326 mounted in flux transfer relationship with the rear core component 320 which, as in the case of core legs 308 and 310 is formed of magnetically responsive material.

The accelerator assembly 304 comprises a closed magnetic material outer loop represented generally at 328 which includes a rear core limb or portion 330 integrally formed with upper and lower core limbs shown respectively at 332 and 334. Limbs 332 and 334, in turn, are magnetically and physically coupled to an upstanding magnetic accelerator core assembly 336. Assembly 336, as seen in FIG. 15B will exhibit a predetermined typically competed, cross sectional configuration selected for invoking an acceleration of particles forming a turning particle beam. The vortex crossed electric field evoked with assembly 336 is generated by a field winding or coil 338 which is positioned about the rear core limb 330. Coil 338 is excited with the above-noted time varying current which will be selected, as discussed above, from the R.F. frequency spectrum or at higher frequency levels.

Figure 15B:
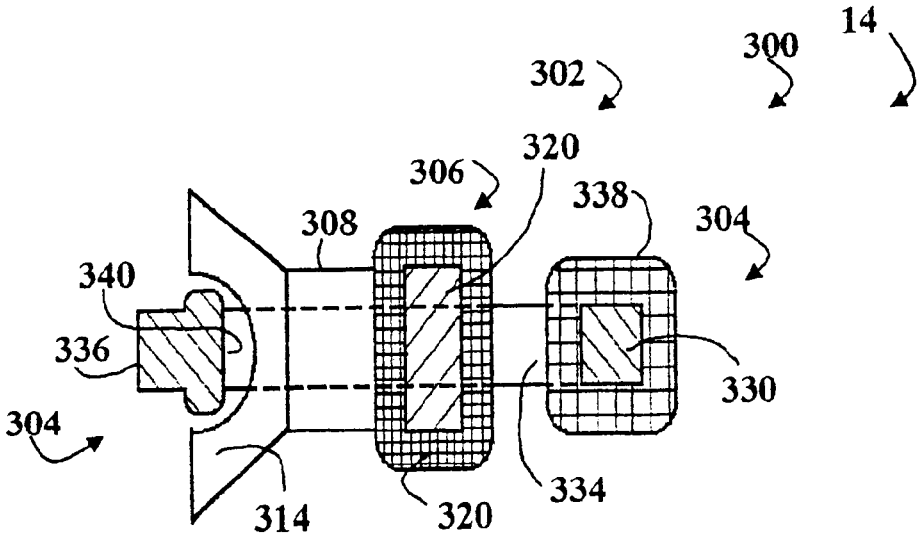
FIG. 15B is a sectional view taken through the plane 15B—15B shown in FIG. 15A.

Examination of FIG. 15B reveals that the predetermined cross-section of assembly 336 is configured with a core face 340 to develop a shaped vortex electric field to carry out particle acceleration or energization. The shaped electric field importantly provides an opportunity to carry out some focusing of the particle beam as it is turned with the steering assembly at a transition region. While particles exiting from, for example, a linear acceleration channel will tend to fringe, disburse or spread, some focusability then becomes quite valuable and is realized, for the instant embodiment, by appropriately designing the pole face of component 336. Note, additionally, that the pole faces 312 and 314 also are formed in a curvilinear fashion in compliment with the design of the core face of assembly 336.

Additional discussion of this turning, focusing and accelerating arrangement is provided in connection with FIGS. 47 and 48, discussed later herein.

The description now turns to the earlier described Group 5 of the figures which encompasses FIGS. 16 through 27 and is generally concerned with the architecture of single and multi-layer stacked acceleration channels. The grouping is subdivided into a subgroup 5A concerning planar constructions and a subgroup 5B looking to cylindrical and spiral constructions.

Figure 16:
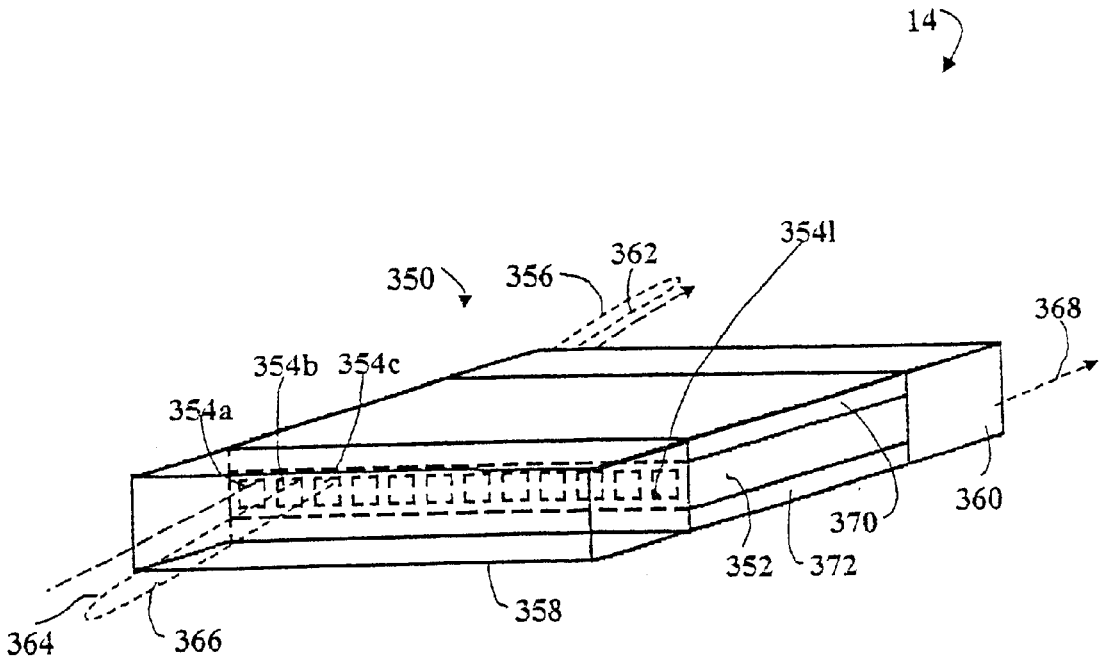
FIG. 16 is a perspective schematic view of a planar, one-level multi-stage accelerator according to the invention.
Figure 17:
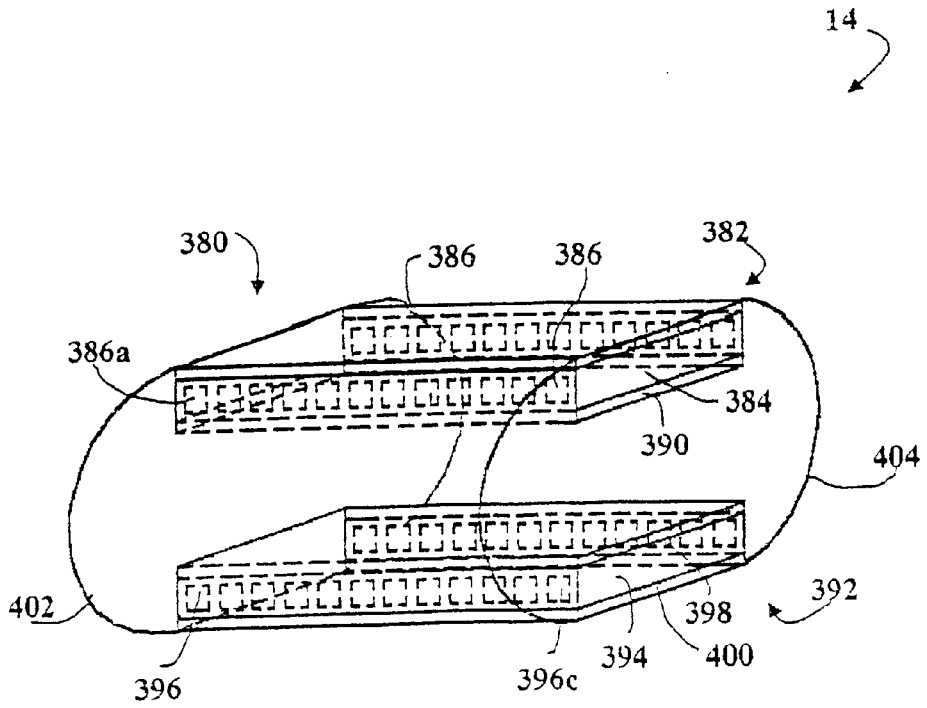
FIG. 17 is a schematic perspective view of a two-level accelerator structure according to the invention.

Referring to FIG. 16, a single-level multi-channel accelerator or undulator is represented generally at 350. The single-level arrangement of the accelerator assembly 350 is shown providing a general acceleration channel which comprises a sequence of adjacent linear, substantially anti-parallel accelerator stages formed within a singular or integral magnetic material core 352. Core 352 is formed with core channels, an initial one which may be represented at 354*a*, and an nth or here, 12th of which may be represented at 354*l*. The linear accelerator stages represented by these channels will be provided with a side-most one of which representing an accelerator input, for example, that at 354*a*. This accelerator input or system accelerator input receives a particle beam from a source as at 12 (FIG. 1) and accelerates it linearly to a stage channel exit. A symbolic representation of this path of particles, now energized, is represented at path portion 356. Steering assemblies are positioned at the appropriate entrance and exits of the accelerator stages, as represented by the block-shaped boundaries 358 and 360. As an energized particle beam emerges from the initial stage represented at channel 354*a*, a component of the steering assembly 360 will turn it, as represented in exaggerated form at path portion 356. A turning of this particle beam will result in an introduction of the particle path, as represented at path portion 362, into the entrance of the next adjacent accelerator stage channel represented at 354*b*. The energized particle beam exiting from the stage represented at channel 354*b* is depicted in exaggerated form at path portion 364. This particle beam then is turned by a component of the steering assembly 358, as represented at path portion 366, to enter into the channel entrance of a next successive stage represented by the core channel 354*c*. This undulating acceleration of the particle beam continues through the sequence of stages until the last stage 354 is encountered, at which point an accelerator output or system output of an energized particle beam is provided, as represented at path portion 368. The inductive or field winding assemblies for each of the stages represented at channels 354*a*–354*l* are provided at the spacial block designations 370 and 372. With the arrangement, it may be observed that the input of one steering assembly is responsive to the output of any given accelerator stage and the output of that turning assembly is connected to the input of a next designated accelerator stage. This continues until such time as the accelerator output is derived. While the assembly 350 is shown as a somewhat singular planar one, this single level arrangement may take on a variety of curved orientations, one being discussed in connection with FIG. 22.

Where it is contemplated that the linear accelerator stage sequences are spaced apart in two levels and the turning assemblies are operative between those two levels, then an architecture as schematically represented by the acceleration channel or structure shown generally at 380 in FIG. 17 may be evoked. In the figure, a first accelerator channel sequence is represented generally at 382 which is comprised of a magnetic material integral core 384 corresponding with core 352 in FIG. 16. Core 384 is configured with a sequence of parallel and adjacent channels, defining corresponding stages 386*a*–386*l*. Such stages may continue to an nth stage here shown as the $12^{th}$ stage 386*l*. Select channel-form stages 386*a*–386*l* are figured in conjunction with field winding schematically represented at block regions 388 and 390.

Spaced below the linear structure or sequence 382 is another or second accelerator stage linear sequence represented generally at 392. Structure 392, as before, includes an integrally formed magnetic material core within which a sequence of parallel linear channels are formed, select ones of which being configured with a field winding assembly to form an accelerator stage. The resultant sequence of accelerator stages may extend from first to nth which, for the instant illustration, showing utilization of all channels, is seen at 396*a*–396*l*. The field windings for such stages of the sequence 396*a*–396*l* are provided as represented at the block boundaries 398 and 400.

Steering assemblies for this accelerator embodiment 380 are schematically represented by U-shaped spacial regions of curved inner and outer peripheries represented by the end faces of the turning system at 402 and 404. The geometry for the turning systems indicated herein is one wherein the exit of a stage of the sequence at 382 is coupled to the corresponding entrance of stage of sequence 392. A peculiarity of this design approach is that only one half of the total number of particular accelerator stages or acceleration channels are used for acceleration of a charged particle beam. The vortex electric field in the other half of the total number of channels is found to perform as a decelerating field. Thus, an isolating stage spacing is used and "empty" alternate channels may be applied to support field windings. See publication (4) above it should further be made clear that the mounting of two multi-stage accelerator channel levels calls for close maintenance of the relative position of stages. The requisite physical constrainment of the sequences, for a given design, may pose more stringent structural requirements. Those structural mandates may be ameliorated through the utilization of a singular or integrated core structure of magnetic material. An advantage of two levels of accelerator stage sequences resides in an opportunity to significantly reduce the length of these stages to achieve a given particle beam output energy. Another unusually interesting advantage accrues from the use of the dual level accelerator structures. Inasmuch as alternate channels are used to avoid conflicting acceleration vectors of the adjacent electric fields, alternate channels within each sequence can be utilized for defining accelerator stages of an independent sequence of stages. This means that one category of particles can be accelerated through one pair of sequences of the dual level accelerator stage sequences and a particle stream of a different particle categorization can be accelerated through the sequence of alternate stages. The result will be two energized beams of different particle category such as positive charged particles and negative charged particles to evoke a neutral or quasi-neutral particle beam output. Advantageously, any transversely generated forces due to acceleration of these particles throughout the accelerator channel are mutually cancelled rendering such systems quite ideal for use, for example, in conjunction with space vehicular propulsion or in industrial applications where transverse forces otherwise developed may be detrimental to a manufacturing process.

Figure 18:
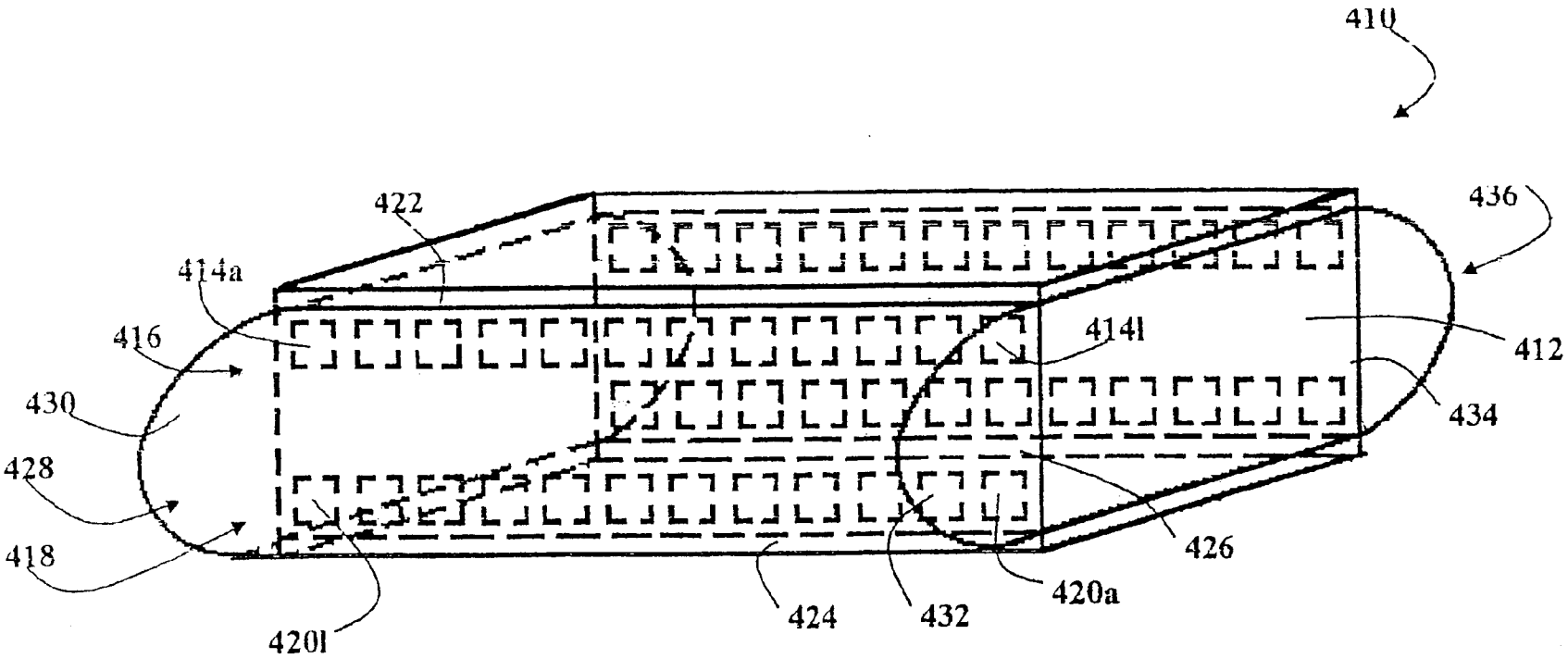
FIG. 18 is a schematic perspective view of an accelerator according to the invention with parallel accelerator stages formed with spaced apart paired channels.

Referring to FIG. 18, a multilevel, multistage accelerator structure configured with an integral or unitary magnetic material core is represented in general at 410. The integral or singular magnetic core is represented at block 412 which is configured with two levels of sequences of accelerator stages. One such sequence being represented as parallel spaced channels and identified as 414*a* representing a first stage of a sequence of acceleration channels and a $12^{th}$ stage 414*l*, representing an nth or last such stage of a sequence 416. Correspondingly, a second or lower sequence is represented generally at 418 as incorporating channel-defined accelerator stages 420*a* through 420*l*. The spacial regions for retaining inductive (field) windings or portions thereof are shown at 422 and 424. Those field windings and the mode of their excitation with distributed currents determines the respective entrance and exit locations of each of the stages. A steering assembly located at the forward face 426 of core 412 is shown generally at 428 and at the outline side surfaces thereof 430 and 432. A corresponding steering assembly shown in general at 436 is represented at the rear face 434 of core 412.

The advantage accruing with the use of a unitary or integral magnetic material core resides in the physical stability of one accelerator sequence as at 416 with respect to the sequence of accelerators stages 418. System physical distortion is substantially minimized with such an arrangement. As in the case of the two-level sequence systems described above, when the type of accelerator channel structuring as illustrated is employed, every other channel forms a stage or acceleration channel with associated windings in order to maintain proper electric field vectoring.

Preferred particle beam path configurations as developed by the designs of the accelerator sequence of stages as well as by the steering assemblies is discussed later herein in connection, for example, with FIGS. 40 through 43.

Figure 19:
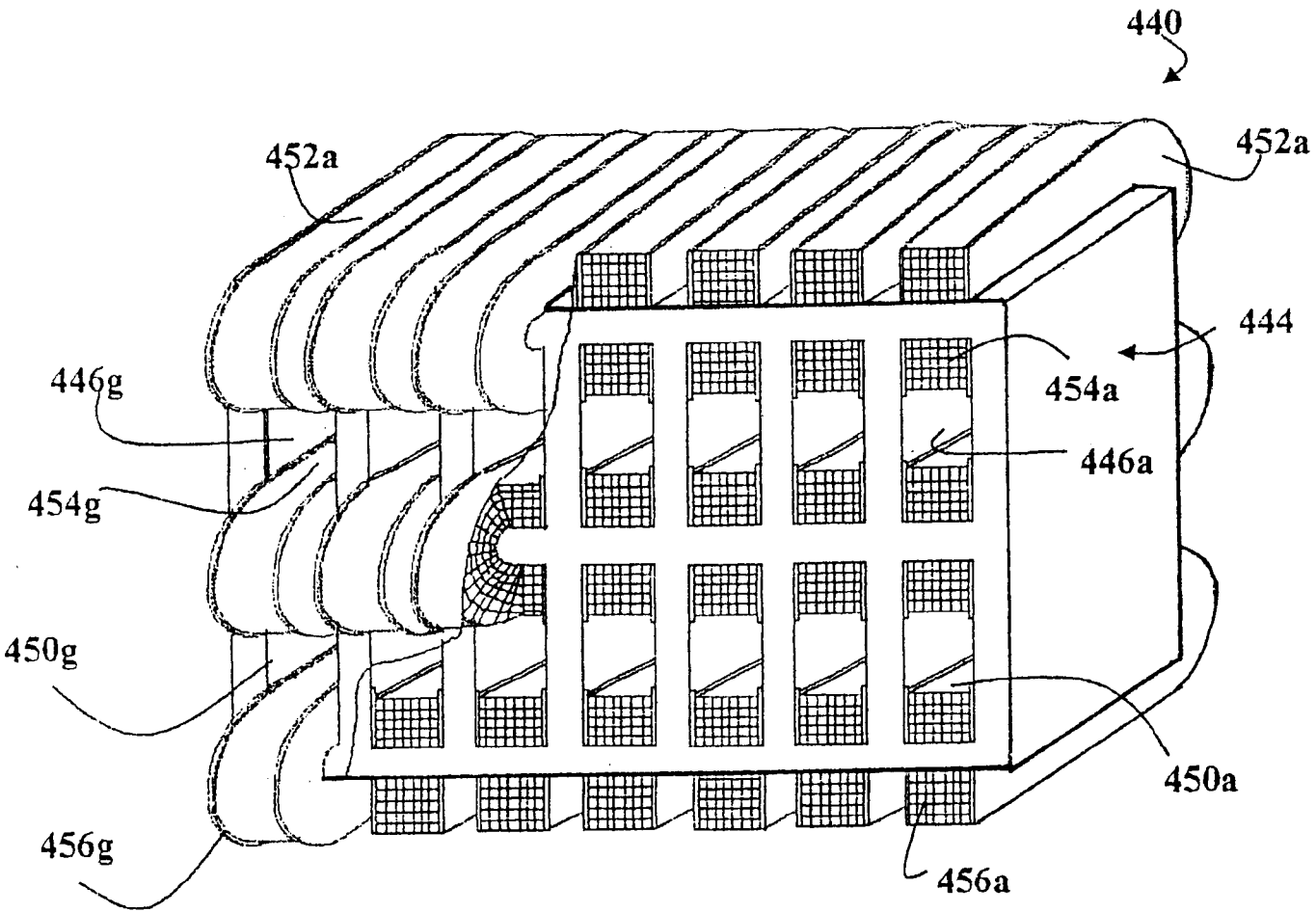
FIG. 19 is a schematic perspective view of a multi-level accelerator according to the invention with a unitary or integrally formed core component.

Looking to FIG. 19, a more detailed illustration of the accelerator channel structure with a dual level sequence of stages is portrayed. No steering assemblies are shown in this figure in the interest of clarity, nor are particle paths or trajectories depicted. The figure reveals that the accelerator structure represented generally at 440 is formed having an integral or unitary core formed of magnetic material as described above and represented at 442. Core 442 is configured having a first linear sequence 444 of channels 446*a*–446*g*.

Formed below the channel sequence 444 is another sequence 448 of channels formed within the unitary magnetic material core 442 and shown at 450*a*–450*g*. To form adjacent and parallel accelerator stages at the channels 446*a*–446*g* of sequence 444, field winding pair components 452*a*–452*g* and 454*a*–454*g* are provided. Accelerator stages at sequence 448 similarly are formed with one portion of the winding components 454*a*–454*g* in combination with windings 456*a*–456*g*. The election of undulating particle beam paths for the structure 440 is a matter of the particular steering assembly implementation as desired by the user.

The methodology of the invention permits the utilization of two particle beams incorporating respective charged particles of different polarity. For example, one particle beam trajectory may incorporate only positive particles, while another and separate particle beam may incorporate negatively charge particles. With the system, those two particle beams with opposed polarity may be merged to evoke a singular quasi-neutral or neutral particle beam. One approach to carrying this out is described in connection with FIG. 20. In the figure, a dual output beam EH-accelerator is represented generally at 460. This dual EH-accelerator is formed in a manner wherein four inductive levels are developed with two each of which being dedicated to a particle beam of a particular polarity designation. A unitary integral magnetic material core 462 is utilized to provide channel structures for each of two sequences of accelerator stages dedicated to a select particle type.

Figure 21:
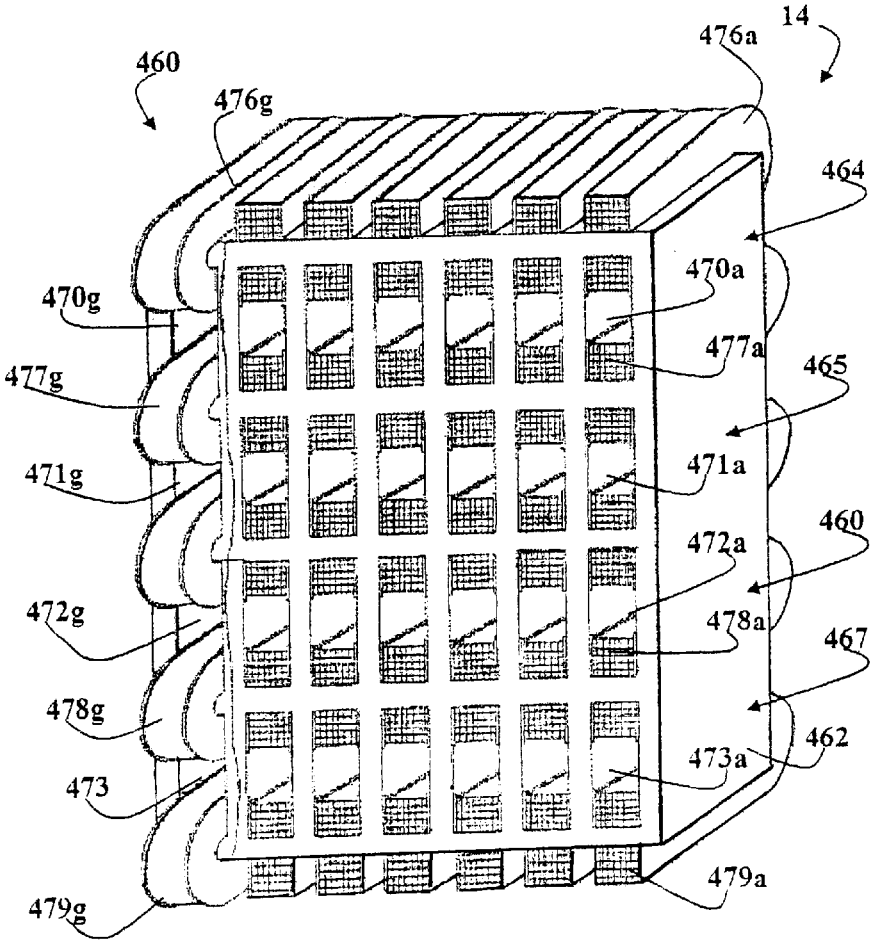
FIG. 21 is a schematic perspective representation of a multi-level accelerator with portions broken away to reveal internal structure.

Looking additionally to FIG. 21, the core 462 is revealed having been formed with the noted magnetic material and incorporating core sequences of channels at adjacent levels, each channel of the sequence being complemented with field windings to define a corresponding sequence of accelerator stages. These sequences of accelerator stages from top to bottom are represented at 464–467. The mutually anti-parallel accelerator stages of sequence 464 are represented at 470*a*–470*g*. Stage sequence 465 is represented at stages 471*a*–471*g*. The mutually parallel accelerator stages of sequence 466 are represented at 472*a*–472*g;* and the accelerator stages of sequence 467 are represented at 473*a*–473*g*. Entrances and exits of the stages within the sequences 464–467 are arranged such that the resultant particle beam trajectory or path route is one of continuing accelerative energization extending from a designated stage input to an overall accelerator output for that one bi-level acceleration system. The accelerator stage designs incorporate field winding pairs 476*a*–476*g* and 477*a*–477*g* with respect to sequence 474; and the accelerator stages 471*a*–471*g* are implemented with field winding pairs 477*a*–477*g* and 478*a*–478*g*. Finally, accelerator stage sequence 467 is implemented with field winding pairs 478*a*–478*g* and 479*a*–479*g*.

Accelerator stage sequences 464 and 465 combine to provide one complete undulative accelerator channel for particles of one charge designation, while sequences 466 and 467 combine to provide a second accelerator channel configured to accelerate or energize particles of another charge designation. As before, where the sequences involved are located at two-levels and the path or trajectory for energized particles is one progressing from an upper sequence to a lower one, then the alternate channel arrangement described earlier is utilized.

Returning to FIG. 20, the steering assemblies for the discrete accelerator stages of sequences 464 and 465 are shown at 480 and 482, while the corresponding steering assemblies for accelerator stage sequences 466 and 467 are shown at 484 and 486.

A merging of the charged particle beams resulting from accelerative treatment is carried out by a merging or joining assembly represented at 488 and the thus merged particle beams are outputted at the accelerator system output 490. Preferablv, the steering assemblies 480–482–484 and 486 are of a variety providing for particle beam shape correction and focusing.

Figure 22A:
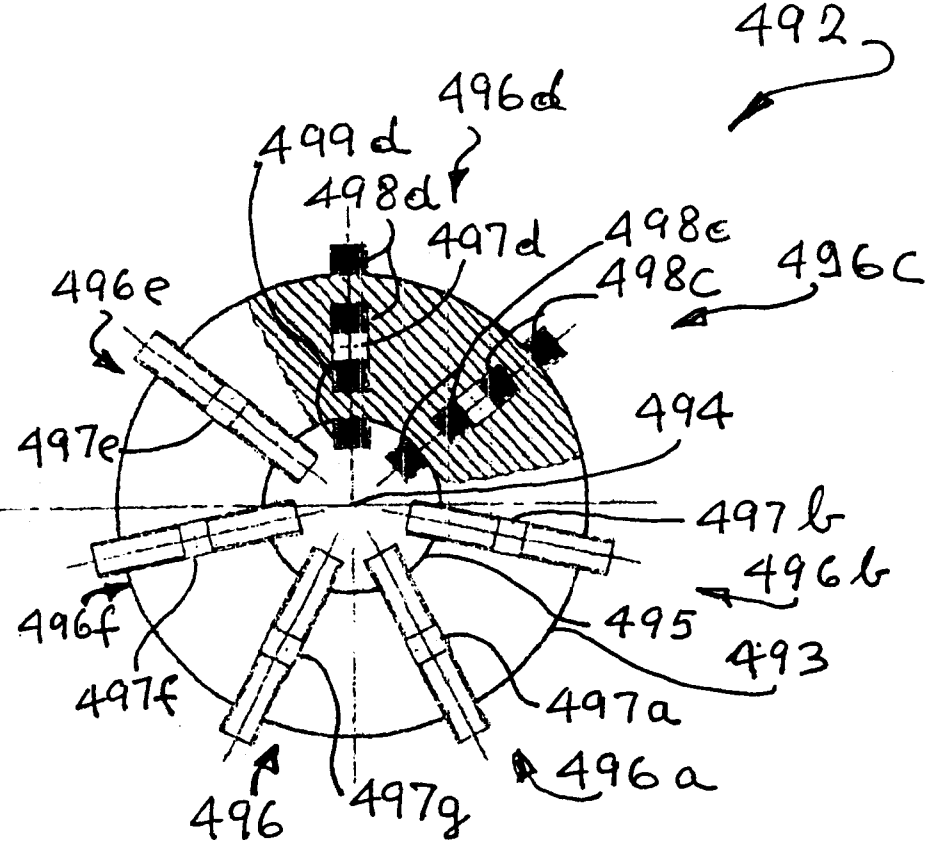
FIG. 22A is a top view of a cylindrical accelerator according to the invention with portions broken away to reveal internal structure.
Figure 22B:
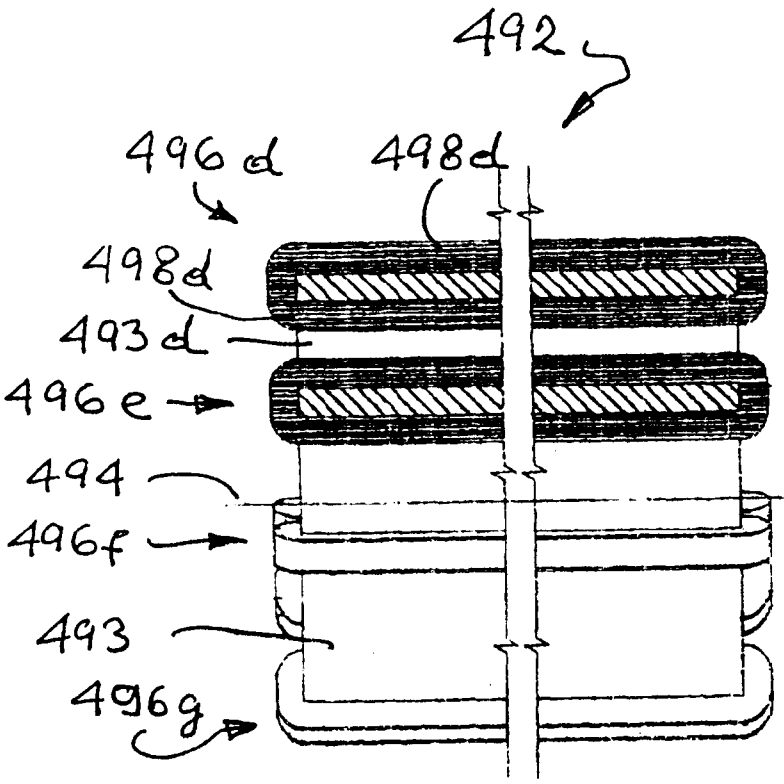
FIG. 22B is a partially sectional side view of the accelerator structure of FIG. 22A with portions broken away to reveal internal structure.
Figure 22C:
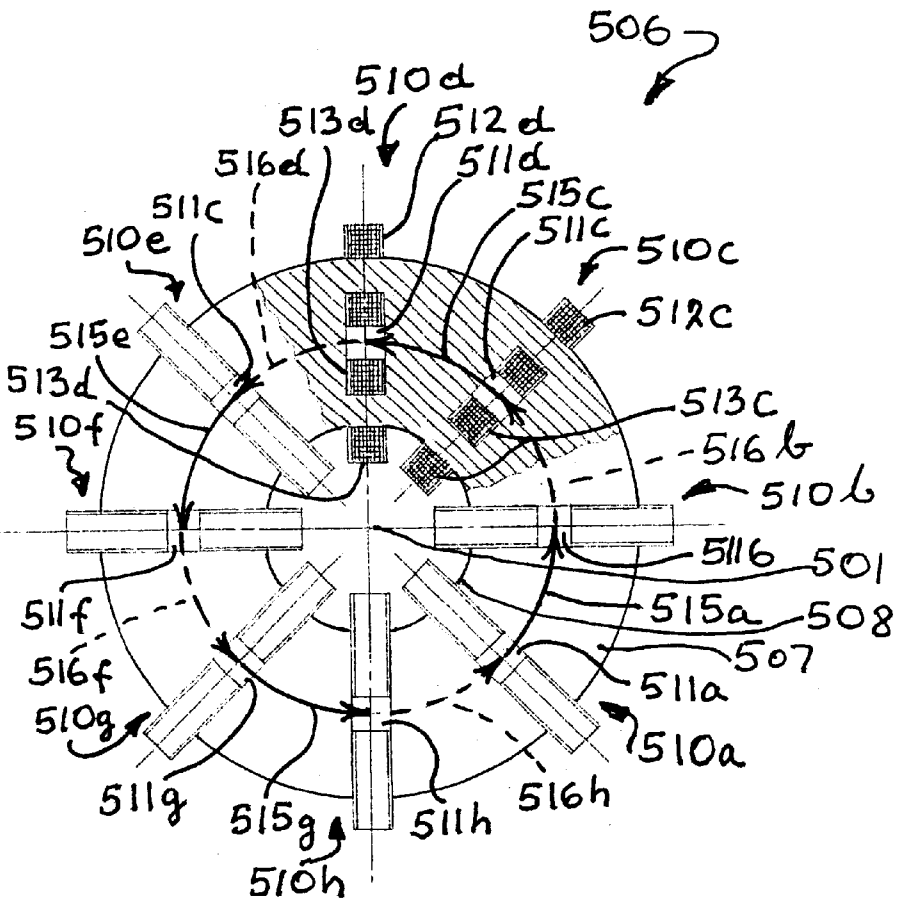
FIG. 22C is a top view of a cylindrical accelerator according to the invention with portions broken away to reveal internal structure.
Figure 22D:
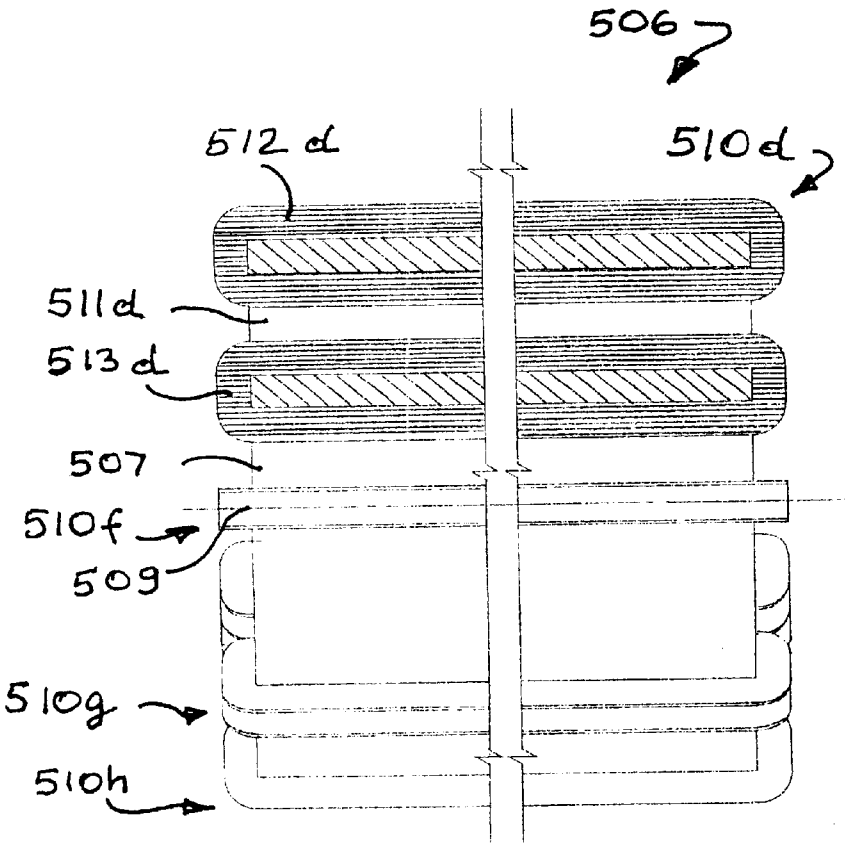
FIG. 22D is a broken away side view of the accelerator structure of FIG. 22C with portions removed to reveal internal structure.
Figure 23:
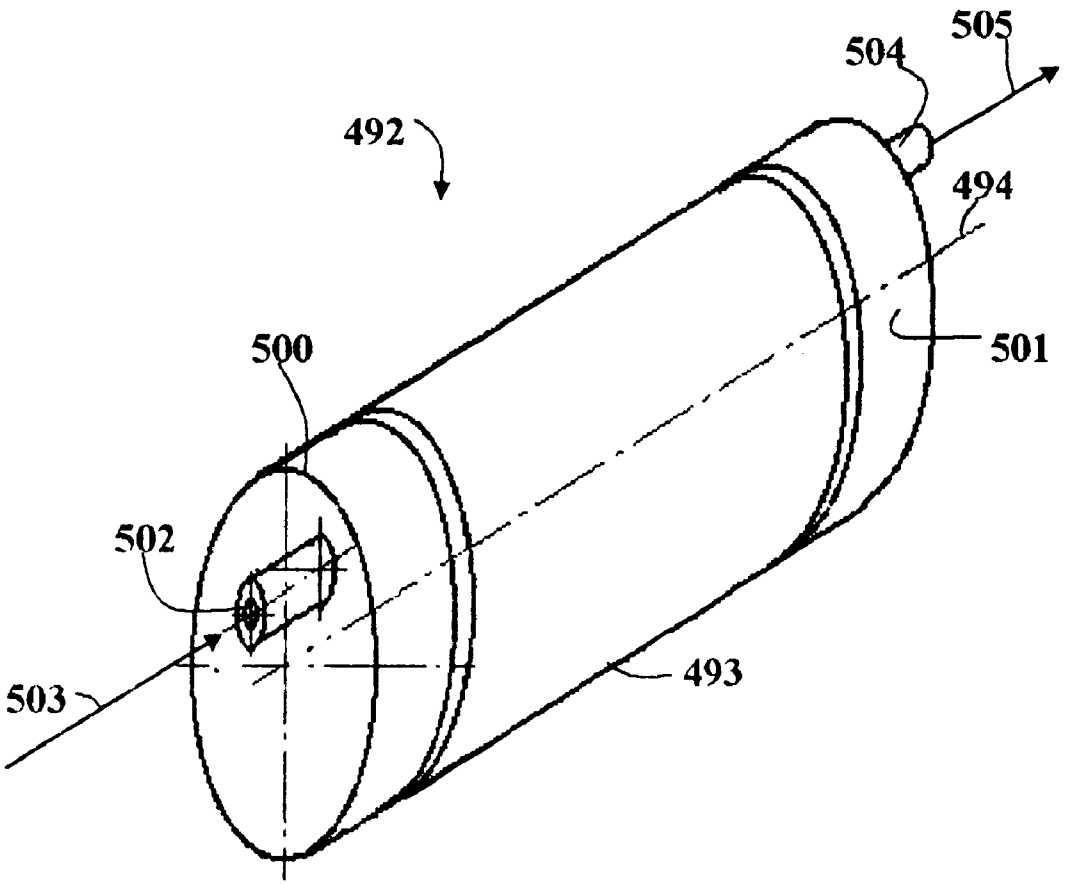
FIG. 23 is a perspective view of an accelerator according to the structure of FIGS. 22A–22D.
Figure 24:
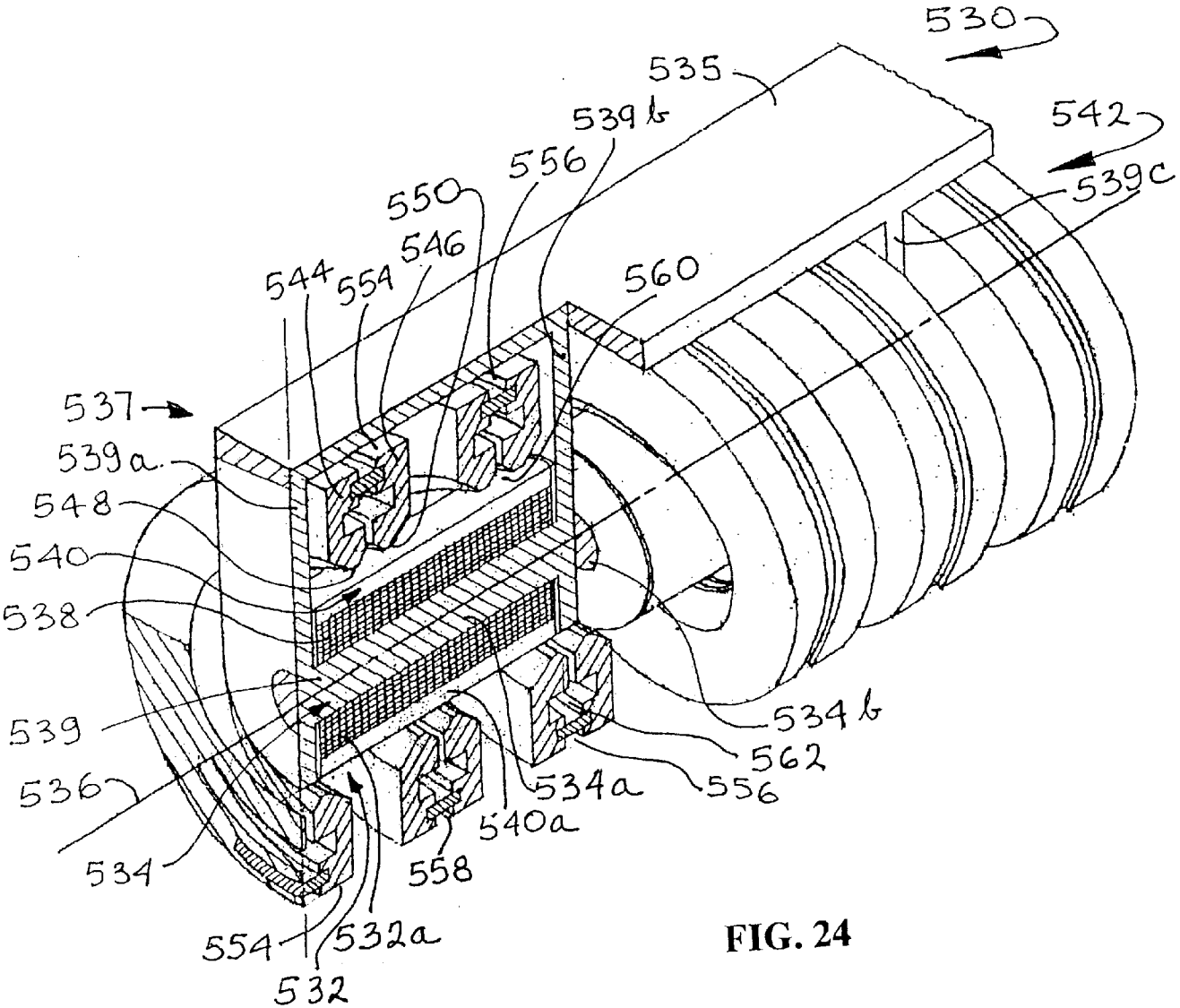
FIG. 24 is a partial sectional view of a circularly polarized coaxial-type of accelerator structure.

The discussion now turns to a description of the figure sub-group, 5B representing cylindrical and spiral constructions of accelerator structures and encompassing FIGS. 22–24.

Referring to FIGS. 22A, 22B and 22C, 22D accelerator structures which are incorporated with a cylindrically-shaped core or block of magnetic material and which utilize a multi-channel form of accelerator structure are revealed. The initial embodiment of this form of accelerator is shown in general at 492 in connection with FIGS. 22A and 22B. For this embodiment, a cylindrical core or block 493 of magnetic material is employed which is symmetrically disposed about a longitudinal axis 494. FIG. 22A reveals that this block 493 is formed with a hollow or open core or channel with border at 495. Radially disposed about the longitudinal axis 494 are seven accelerator stages 496*a*–496*g*. Stages 496*a*–496*g* are formed, respectively, with open, longitudinal channels 497*a*–497*g* through which driving electric fields and resultant particle path trajectories are developed. The electric field development is provided in conjunction with the concurrent generation of a time varying magnetic field evoked from winding pairs which are formed about the acceleration channels. In this regard, the winding pairs associated with channel 497*c* are shown at 498*c* and at 499*c*. Similarly, winding pairs 498*d* and 499*d* may be observed to be configured in stage definition in conjunction with channel 497*d*. Similar winding pairs are incorporated with stages 496*a,* 496*b* and 496*e* through 496*g*. With the arrangement shown, stages 496*a*–496*g* form a sequence of stages through which particles are accelerated in an undulating path or trajectory extending through one channel, for example, from top to bottom as at 497*a,* whereupon a turning assembly alters the direction of the particle path or trajectory to extend upward in the sense of FIG. 22A through the channel 497*b* of stage 496*b*. This arrangement continues until the last stage. Note, in FIGS. 22A and 22B that an odd number of stages 496*a*–496*g* are present.

Looking momentarily to FIG. 23, the accelerator core block is represented again at 492 in its cylindrical form in combination with annexed steering assemblies 500 and 501. Of particular interest, the input from the particle source 12 (FIG. 1) to the accelerator system is represented at input component 502 which is shown receiving a particle source represented by the arrow 503. The particles then are accelerated along an undulating route or path by the EH-accelerator system, those paths being turned by steering assemblies 500 and 501. The output of the system then is represented at exit or output component 504 and arrow 505 representing an output particle beam which is seen to be initially parallel to the system axis 494. Note, additionally, that the input 502 is radially outwardly disposed from the longitudinal axis 494 as is the system output at arrow 505.

Turning to FIGS. 22C and 22D, another version of the accelerators which incorporate a cylindrical core or block is represented in general at 506. Accelerator 506 formed, as before, with a cylindrically-shaped core or block 507 which is configured with an inner-open channel or defined by the cylindrical boundary 508. Boundary 508 is seen to be disposed symmetrically about a longitudinal axis 509. The architecture of accelerator 506 is one wherein there are provided an even number of stages for the singular sequence shown, in this regard, stages 510*a*–510*h*. Each of the stages 510*a*–510*h* incorporate an elongate channel represented respectively at 511*a*–511*h* which, in turn, are surmounted by winding pairs 512*a*–512*h*, 513*a*–513*h* to evolve an accelerator stage assembly. Of the winding pairs, those at 512*c*, 513*c* and 512*d*, 513*d* are revealed through sectional details. However, the remaining stages as at 510*a*, 510*b* and 510*e*–510*h* will be configured in the same manner. Stages 510*a*–510*h*, as before, are radially disposed with respect to the longitudinal axis 509 and, for the instant embodiment employing an even number of such stages, they are angularily mutually displaced at 40° increments. As before, an undulating charged particle accelerating particle path or trajectory is developed with the sequence represented by the stages 510*a*–510*h* which may be exemplified by the dot-represented arrow directions and "X" arrow directions arbitrarily located next to each of the channels 511*a*–511*h*. Turning assemblies as described in connection with FIG. 23, for example, at 500 and 501 are included, as before, to provide magnetic turning at each end of the assembly of channels 511*a*–511*h*. An approach to such turning is represented by a sequence of curved arrows in FIG. 22C. For example, solid arrows 515*a*, 515*c*, 515*e* and 515*g* represent a turning assembly function at one side of the accelerator 493, for example, at turning assembly 500 (FIG. 23). Correspondingly, the oppositely disposed steering assembly is represented by phantom arrows 516*b*, 516*d*, 516*f* and 516*h*. With this arrangement, the noted undulatory particle trajectory path is developed in the instantly taught fashion for an eight-stage sequence. However, note that a switch symbol is incorporated within a solid arrow 515*g* as represented at 517. Located at the output steering assembly, for example, steering assembly 501 as shown in FIG. 23, this component of the steering assembly arrangement is one which is electromagnetic in design and which is switchable between on and off states. When switched on, the steering assembly represented at arrow 515*g* turns the particle trajectory from acceleration channel 511*g* into the entrance of acceleration channel 511*h*. However, when the switching function 517 is turned off to de-energize the electromagnetic turning or steering assembly represented at arrow 515*g*, then stage 510*g* becomes an output stage and a corresponding accelerator output as described at 504 in conjunction with arrow 505 in FIG. 23. However, the undulatory accelerating paths may be reused or the system may rotationally accelerratively reiterate about the axis 509 to further increase the acceleration of the charged particles in a sense of each trajectory revolution about the stages 510*a*–510*h*. In consequence, within a very compact configuration, substantial particle accelerated energies can be achieved. Following a predetermined number of such rotational reiterations, by opening or de-energizing the steering assembly 516*g* at switching function 517 an energized particle output is produced, for example, following four iterations about the sequence of stages 510*a*–510*h*, the equivalent of the output of a thirty-two stage linear single-level sequence accelerator is achieved.

Another configuration may be gleaned from the cylindrical architecture of accelerators 492 and 506. In this regard, the open channel disposed centrally along longitudinal axis 494 or 509 may be used as a common accelerator stage channel. When so employed, for example, in connection with FIGS. 22A and 22B, then each of the stages 496*a*–496*g* becomes a radially disposed sequence of stages incorporating the earlier-described acceleration channels 497*a*–497*g* in combination with a common channel within the open cylindrical channel represented at bore 495. A similar arrangement obtains with the architecture of accelerator 506. In this regard, each of the stages 510*a*–510*h* becomes a radially disposed sequence of stages wherein an accelerator channel as at 511*a*–511*h* represents a single stage which is combined with a second stage developed within the common accelerator channel within boundary 508. Such common utilization of the central core channel to evoke a sequence of stages calls for a commutative control over both the field windings and a centrally disposed steering assembly. In general, such control will operate at the RF frequencies envisioned for the instant accelerator system.

A variety of advantages accrue with this architecture for the accelerators 492 and 506. Of course, accelerator architectures incorporating the embodiments of FIGS. 22C and 22D achieve a substantial acceleration of particles within a very compact volume through the utilization of a stage pair wherein a switched steering assembly is employed. Such lightness and compactness is highly beneficial for applications within a broad variety of industrial functions. By providing for the particle beam output near the outer radius or adjacent the circumference of the accelerator, the structure provides enhanced access to physical control systems such as machine controls which may be utilized, for example, in the creation of silicon wafer-based devices. Additionally in this same regard, observing or aiming optical or like systems are more easily implemented with this form of structure to give more accurate optical and visual feedback to a manufacturing user.

Referring to FIG. 24, an EH-accelerator structure is revealed generally at 530 which evolves a spirally-shaped acceleration channel and associated energized particle beam or trajectory. The undulating advantages of the invention accrued due to a sequence of linear acceleration channel segments with discrete entrance-exit steering assemblies now assumes a smooth transitional energized particle path route as opposed to a more or less repetitiously abrupt one. In the figure, the accelerator structure 530 is seen to comprise a generally cylindrically-shaped core or core region 532 having a centrally disposed winding post shown generally at 534 and incorporating portions 534*a*, 534*b* and additional integrally formed portions along the structure 530. The assembly of the core region 532 and post 534 is seen to be disposed symmetrically about a longitudinal axis 536 to provide for an acceleration of particles in a circle-like or curvilinear path or route. Wound about the post 534 and within the core region 532 is a field winding 538 for applying the noted distributed current. Such current evolves a magnetic field in the magnetic material of core region 532. Accelerator 530 is formed of a sequence of such field windings 532 as at 532*a* . . . disposed with magnetic material core post 534 portions 534*a*, 534*b*, etc. Magnetic material is provided as above discussed. However, the electric field inducing magnetic field is provided with field vectors which are parallel to the axis 536, i.e., along the axis of this particle energization and beam forming system. As before, the current generated within the winding structure 538 is of a time varying variety as above described and what ultimately is evolved is a helically-shaped energized particle trajectory or route between the accelerator input (not shown) and the accelerator output (not shown). Note that the field windings as at 538 are segmented or provided in current drive phase designated portions defined, in turn, by a magnetic material flux return structure represented generally at 537. The structure 537 is seen to comprise winding segregating magnetic path-defining walls 539*a,* 539*b,* which extend integrally for the first portion of center core or post portion 534*a* to an outer magnetic path completing component 535 extending the length of axis 536. Component 535 is integrally formed of magnetic material with walls 539*a,* 539*b* and 539*c.* The acceleration channel is defined by a helical or spiral steering core assembly 542 formed of magnetically responsive material and surmounting the circumferentially disposed surface 540 of the core region 532. For each portion or segment of the winding and core arrangement along the length of axis 536, surface 540 is formed as a component as at 548 of insulating material, such components being provided with each segment or portion of field windings as at 532*a,* etc. Steering assembly 542 is formed as a spirally-shaped bifurcate magnetic steering core having spaced-apart pole pieces 544 and 546. Pole pieces 544 and 546 exteno, respectively, from chamber defining faces 548 and 550 to spiral outer surfaces 552 and 554. Pole pieces 544 and 546 are mutually spaced apart to define a gap 556 between which a substantially continuous, spirally-shaped rare earth permanent magnet 558 such as one formed of samarium cobalt is positioned. This provides a generally continuous steering magnetic field at the forward faces 548 and 550. Additionally, it may be observed that those continuous faces 548 and 550, by their mutual adjacency, as well as their adjacency with the surface 540 of core region of 532, form an acceleration channel 560 of continuous nature. Further defining the pole structure, is a continuous spiral cavity 562 defined between the pole pieces 544 and 546. Accelerator structure 530, in effect, is subdivided with a sequences of stages defined by the vertical walls, for example, as shown at 539*a*–539*c.* Each of those stages incorporates two cyclical windings of the accelerator channel 560. In order to form the requisite magnetic fields and induced electric fields, a return magnetic path is called for, and that path is developed with the wall structures 539*a*–539*c,* etc., in combination with the integrally formed path-completing component 535. Of particular note, that return magnetic path is seen to be taken outside of the spirally or helically formed acceleration channel 560 and its defining pole pieces as at 544 and 546.

Figure 37:
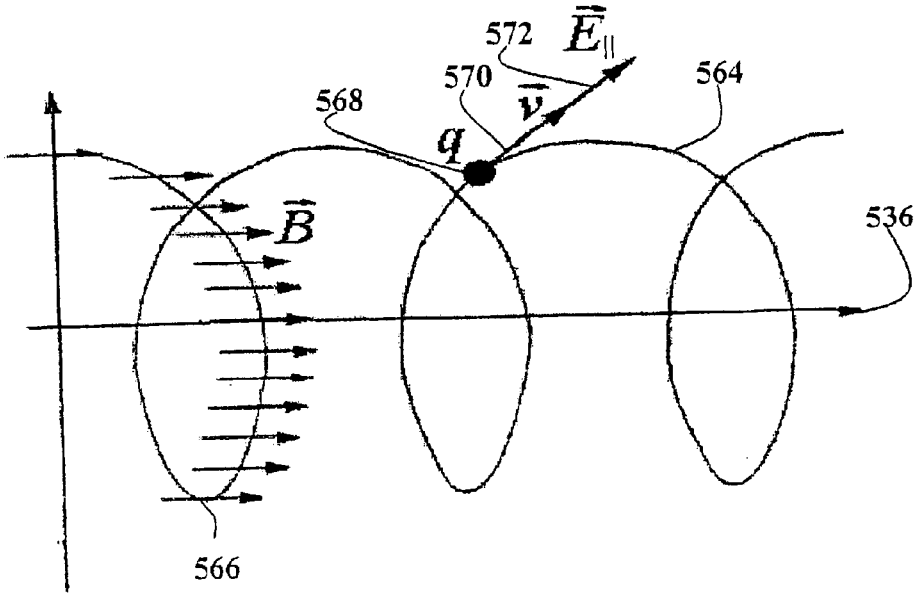
FIG. 37 shows another arrangement for the motion of charged particles in a circularly polarized EH-accelerator with an axially directed undulative magnetic field.

Referring momentarily to FIG. 37, the acceleration channel shape or particle trajectory may be represented by the spiral or helical path 564 as it maneuvers about the longitudinal axis 536. The magnetic field $\vec{B}$ produced by the field winding, is represented by the vector arrows 566 as they would exist with respect to the particle trajectory or shape of acceleration channel 564. A particle charge or charge point, q, is represented at 568 positioned along the trajectory 564. That particle will participate with a velocity, $\vec{v}$ as represented at the vector 570. That vector of velocity of particle motion is along tangent to a trajectory 564 as is the electric field vector, $\vec{E}_{II}$ shown at vector 572.

Of interest with respect to accelerator system 530 is the arrangement wherein the magnetic field is generated along the longitudinal axis 530 to provide an electric field that creates particle acceleration in a direction orthogonal to that same axis 536. The magnetic field which provides a steering along the acceleration channel 560 also is parallel to the axis 536 at every point of its helical path. Thus, there is a magnetic field at the channel 560 at every point along the spiral or helical length and the vector representing that field is parallel with the longitudinal axis. As is noted in connection with the latter figure, the accelerating electric field is tangential to the spiral or helix-shaped particle trajectory or path. Note that the velocity vector 570 is superimposed on the electric field vector 572 and those vectors act upon the same charge point, q at 568.

EH-accelerators 14 can assume a variety of forms as evidenced from the above description. For example, separate and parallel accelerator components may be employed as discussed above. In one arrangement, an accelerator may be employed for "cooling" of the electron or negative ion components of the plasma flux, while a second such accelerator may be used for acceleration and cooling of positive-ion components. For such utilization, a separation of plasma flux into negative and positive charged beams is introduced between the source of charged particles 12 and the input to the accelerator 14. A variety of techniques are available for merging the individually excited particle types into a united plasma beam.

Contrasting electromagnetic accelerators with independent methods for generation of steering magnetic fields resides in the observation that systems for generation of steering fields are implemented with permanent magnets or relevant quasi-permanent electromagnets. By contrast, the approaches for generation of vortex electric fields, i.e., fields which are time varying develop them in effect, within an acceleration channel. The magnetic field occasioned by field windings or inductors is not present or of consequence within the acceleration channel.

Figure 25:
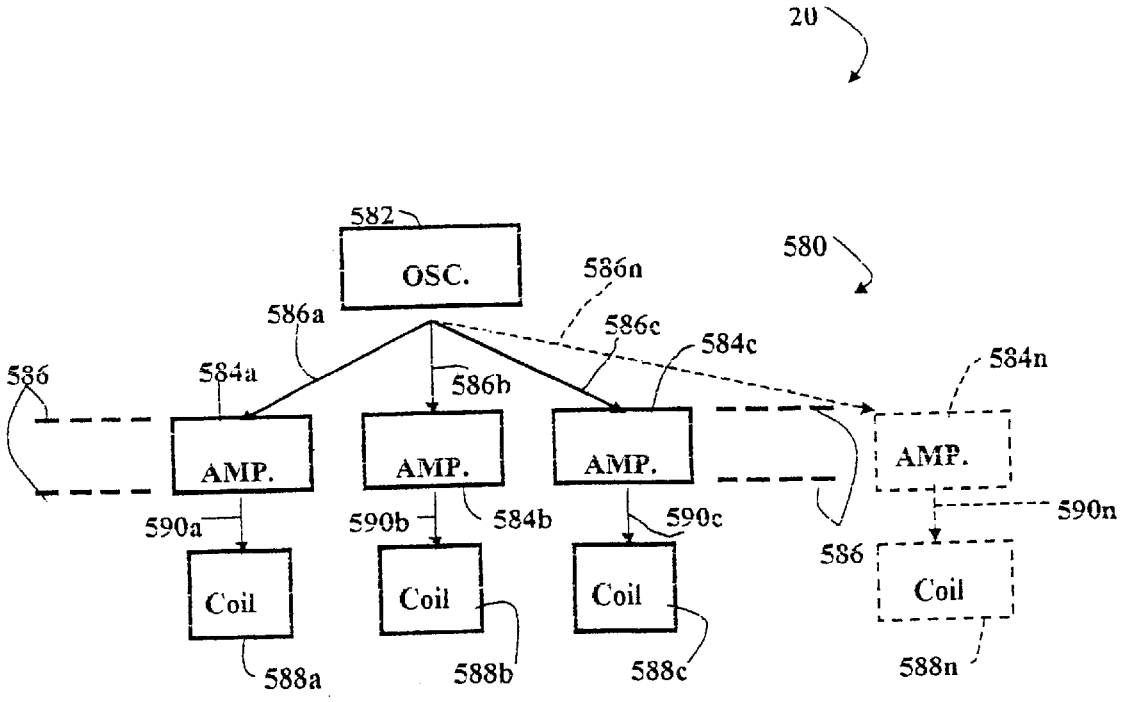
FIG. 25 is a block diagram of a distributed time varying current source according to the invention.
Figure 26:
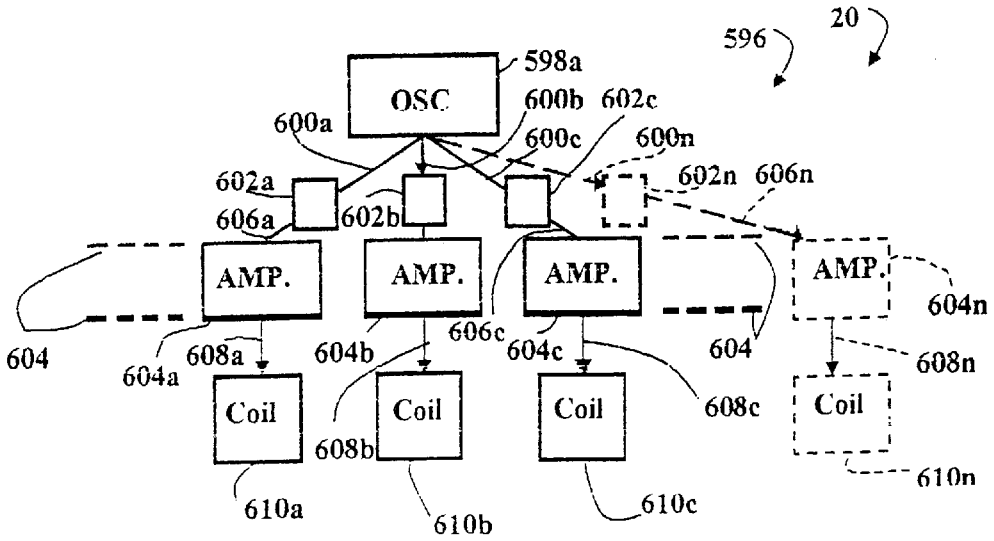
FIG. 26 is a block diagram of a distributed time varying current source as shown in FIG. 25 with the further utilization of phase control components.

The description now turns to figure Group C represented by FIGS. 25 and 26 and looking to a consideration of the designs of distributed R.F. current sources as was earlier represented in block format at 20A and 20B in FIG. 1.

In general, the time varying or R.F. current utilized in the generation of magnetic fields and the corresponding vortex electric fields may be evolved from, for example, three sources:

a. lumped oscillator of current pulses;

b. distributed oscillator of current pulses without a phase correction; and c. distributed oscillator of current pulses with phase correction.

Referring to FIG. 25, a somewhat elementary format for an R.F. driver or core winding assembly excitable from an associated distributed time varying current is revealed generally at 580. This field generation source 580 is seen to be formed with a master oscillator 582 which functions to provide an oscillative input at a desired high frequency time varying level, for example, at R.F. frequencies to a sequence of distributed amplifiers certain of which are represented at blocks 584*a*–584*c,* and 584*n.* As represented by the dashed lines 586, this sequence of distributed amplifiers may continue through an nth amplifier stage. In general, the extent of these stages will depend upon the length of the accelerator channel involved. Oscillator feed to these amplifier stages 584*a*–584*n* is represented by arrows 586*a*–586*c* and 586*n.* See publications concerning high-power high frequency electronics such as:

(30) Motorola Semiconductor Products, Inc., "RF Device Data", Third Edition, Phoenix, Ariz. (1983).

(31) H. Granberg, "Get 600 Watts RF from Four Power FETS", Application Note EB104, Motorola Semiconductor Products Inc. (1983).

The distributed amplifier stages 584 preferably will be physically located as near as possible to the field windings which they drive. Those field windings are just opposite the acceleration channel. These field windings or coils are shown in the figure at blocks 588*a*–588*c* and 588*n*, while the driving association between the distributed amplifiers 584*a*–584*c* and 584*n* and these coils 588 is represented respectively at arrows 590*a*–590*c* and 590*n*.

Referring to FIG. 26, an enhancement of the field generation source shown in FIG. 25 is revealed in general at 596. Where more extended acceleration channels or particle beam trajectory paths or routes are involved, then it is necessary to synchronize the driving R.F. current with respect to the location of the field windings along the accelerator path. Thus the term "distributed current" is utilized in connection with these EH-accelerator structures. Source 596 incorporates a sequence of phase controls with respect to each of the distributed amplifiers. Thus, for a given amplification stage, a phase control, for example, manifested as an electronic delay can be utilized at progressive locations along the acceleration channel as it extends from the accelerator input to the accelerator output.

Source 596 again includes a master oscillator represented at block 598. The output of oscillator 598, at some elected R.F. frequencies, is directed, as represented by arrows 600*a*–600*c* and arrow 600*n* to the respective inputs of phase control components 602*a*–602*c* and 602*n*, the progression of such stages in correspondence with the distributed amplifier stages being provided in the manner described in connection with FIG. 25. Phase control components 602 impose a progressive delay to the signals applied to each of a sequence of amplifier stages from first through nth which apply the distributed excitation current to the field windings of the system in progressively delayed increments along the acceleration path. These amplifiers are represented in the drawing at blocks 604*a*–604*c* and 604*n*, the progression of multiple stages of these components being represented by dashed lines 604 and the inputs to each from the phase control components 602 being represented at respective arrows 606*a*–606*c* and 606*n*. As before, the amplifier stages 604 feed R.F. level and now phase controlled drive currents to a corresponding sequence of winding coil segments as represented by arrows 608*a*–608*c* and 608*n* extending to respective coil segment designated blocks 610*a*–610*c* and 610*n*.

Figure 27:
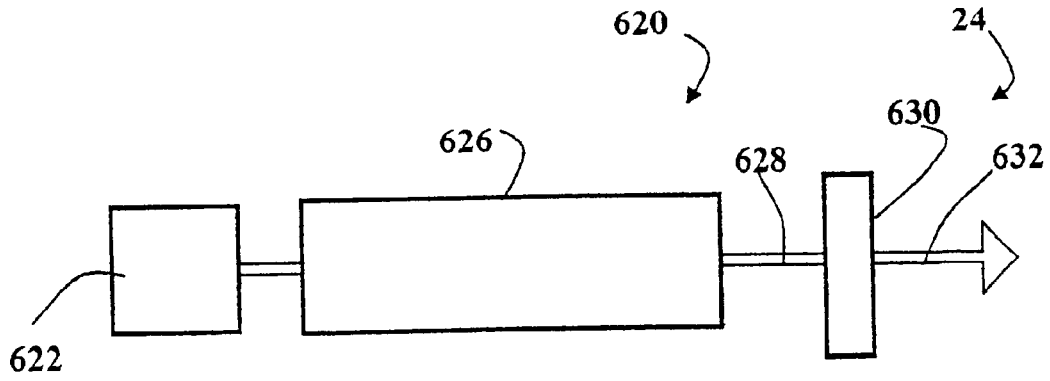
FIG. 27 is a block diagram of an accelerator system for forming relativistic beams of neutral particles.

FIG. 27 constitutes a one figure Group 7 which is concerned with the formation of accelerated neutral molecular beams. The figure at hand is one concerned with an implementation of output stage 24 shown in FIG. 1. In FIG. 24, an EH-accelerator system is represented generally at 620. System 620 is one that looks to an application of the general system described above wherein it is used as the generator of a neutral molecular beam. This form of output is evolved by a selection of a source in combination with the selection of the design of an output stage. In the figure, the source of particles 622 provides a source of negative ions which are introduced, as represented at channel 624 to an EH-accelerator 626 configured in accordance with the invention. The resulting output from the accelerator stage 626 at 628 is constituted as a path of energized negative ion particles. This path of energized negative ion particles then is submitted to a stripping target 630 which removes negative particle defining electrons from the energized particles of the incoming beam to provide a path of energized neutral particles at the accelerator output represented at arrow 632. Such electron stripping targets as at 630 are employed, for example, with tandem accelerators. See, for example, publication:

(32) P. H. Rose, "he Three-stage Tandem Accelerator" Nuclear Instruments & Methods, vol 11, p 49 (1961).

With respect to this Group 7, the source 12 (FIG. 1) of particles may be provided as hydrogen ions or protons and the output stage 24 may be provided to transform the proton beam into a neutron beam.

The EH-accelerator system as described above exhibits somewhat extensive utility. In this regard, it may be used as a source of charged particle beams for various forms of material processing. Those material processing forms include the technologies of plasma treatment of non-conductive and high-resistant materials; and the treatment of conductive and semi-conductive material by electron and ion beams fabrication procedures. Further, the EH-accelerators may be employed, for example, as a source of neutral-particle-beams for material processing; as a system for forming untwisted charged, spiral-like particle beams for gyroresonant electronic and ionic devices; as a space propulsion engine; as a confinement system for fusion reactors; as a source of plasma, electron or ion beams for beam weapons; as a pumping system of excimer lasers; as a source of high quality ion beams for ionic sounding; and for the generation of X-rays.

The discourse now turns to Group 8 of the figures which is concerned with the general principles of operation of accelerators. In particular, the group is subdivided into a subgroup 8A concerning the basic principles for such accelerators encompassing FIGS. 28 through 37 and a subgroup 8B which looks to the principles of operation of EH-accelerators with independent generation of E and H fields. The latter subgrouping encompasses FIGS. 38 through 43.

Consideration of such basic concepts as provided in connection with this Group 8 is submitted in the interest of affording an improved appreciation of the apparatus and method of the invention. Certain of the subject matter to follow additionally is discussed in detail in publications (1) and (2) identified above.

Figure 28:
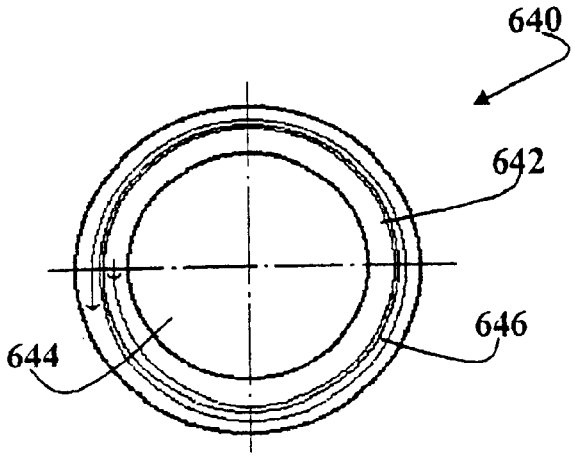
FIG. 28 Prior Art
FIG. 28 is a schematic illustration showing the trajectory of charged particles within a cyclic-type accelerator.

Referring to FIG. 28, a schematic representation of the well known Betatron electron accelerator (Cyclotron) is revealed in general at 640. Betatron 640 comprises a generally circular structure incorporating an accelerator channel which appears at 642 being shown as an annulus in the schematic view represented. Internally of this annulus-shaped accelerator channel is a magnetic core/winding structure 644, the windings of which are excited in time varying fashion to evoke an acceleration of particles in a circle-type of curvilinear cyclic form represented by the path trajectory lines 646. This somewhat spiral trajectory path 646 necessarily contains particles at different energies which are in the course of successive accelerative impulses from an applied electric field. To achieve this driving field the deriving magnetic field must increase with time such that a natural limit will be reached. Thus a concern with utilization of these accelerators resides in their reciprocal synchronization in terms of time and space simultaneously with the range of changing of the current particle parameters. Because there are alterations in energy momentum and velocity of the particles as they traverse various and conflicting accelerator channel path trajectories, design problems are inherit in this approach to acceleration of particles. Structures as at 640 are relatively large, having a diameter of about 2 meters and a weight amounting to about 10 tons in view of the relatively heavy core structure 644. Thus, their practical application to now contemplated industrial implementation is problematic. See relevant publications such as:

(33) D. W. Kerst, "The Acceleration of Electrons by Magnetic Induction", Phys Rev, vol 60, pp 47–53 (1941).

(34) D. W. Kerst, R. Serber, "Electronic Orbits in the Induction Accelerator", Phys Rev, vol 60, pp 53–58 (1941).

(35) R. A. Howard, "Charged-Particle Accelerators", Appendix A, Nuclear Physics, Wadsworth Publishing Company (Belmont, Calif., 1963).

Figure 29:
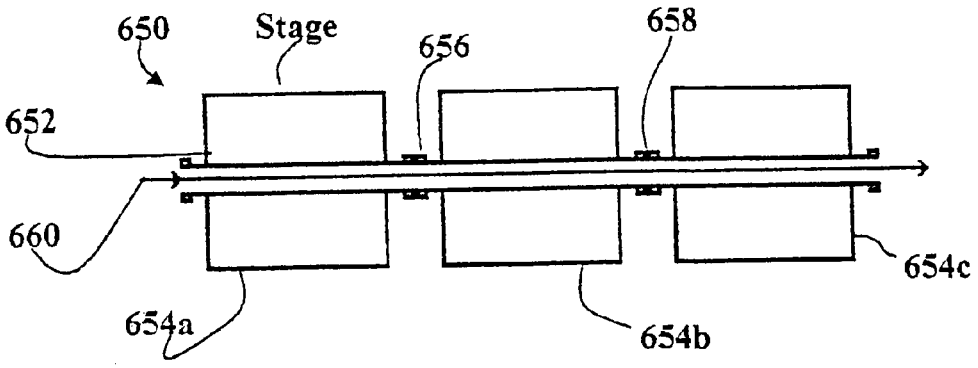
FIG. 29 Prior Art
FIG. 29 is a block diagram illustrating a linear acceleration system.

A linear induction accelerator is represented schematically in FIG. 29. These accelerators, as indicated above, are somewhat linear and typically of extensive length such length ranging from about 10 meters to a number of miles. Such a linear accelerator system is represented schematically at 650 and is seen to include a somewhat linear accelerator channel 652 about which is surmounted a sequence of inductors or field winding stages as represented at blocks 654*a*–654*c*. Because all such systems operate in a vacuum, the channel 652 and successive stages 654 are inter-coupled with, for example, vacuum couplers represented symbolically at 656 and 658. A particle beam introduced from a source will follow a somewhat linear trajectory represented by arrow 660. As is apparent, the extensive length along with associated required extensive distribution of field windings and maintenance of an extensive vacuum derogate from a practical application of the linear accelerator to the spatial restraints or compactness now required for industrial application. By way of comparison, a linear accelerator, for example, having a length of about 20 meters may provide an output particle energy of around 10 Mev. By contrast, a corresponding folded accelerator path system with the turning features of the invention, having a length of about 2 to 3 meters, has the capability of generating an output beam of energized particles at the same energy level. See sample publications:

(36) M. Conte, W. W. MacKay, "An Introduction to the Physics of Particle Accelerators", World Scientific (Singapore, 1991)

(37) D. H. Sloan, E. O. Lawrence, "The Production of Heavy High Speed Fans Without the Use of High Voltages", Phys Rev. vol 38. pp 2021–2032 (1931).

(38) E. L. Ginzton, W. W. Hansen, W. R. Kennedy, "A Linear Electron Accelerator", Rev Sci Inst, vol 19, pp 89–108 (1948)

Figure 30:
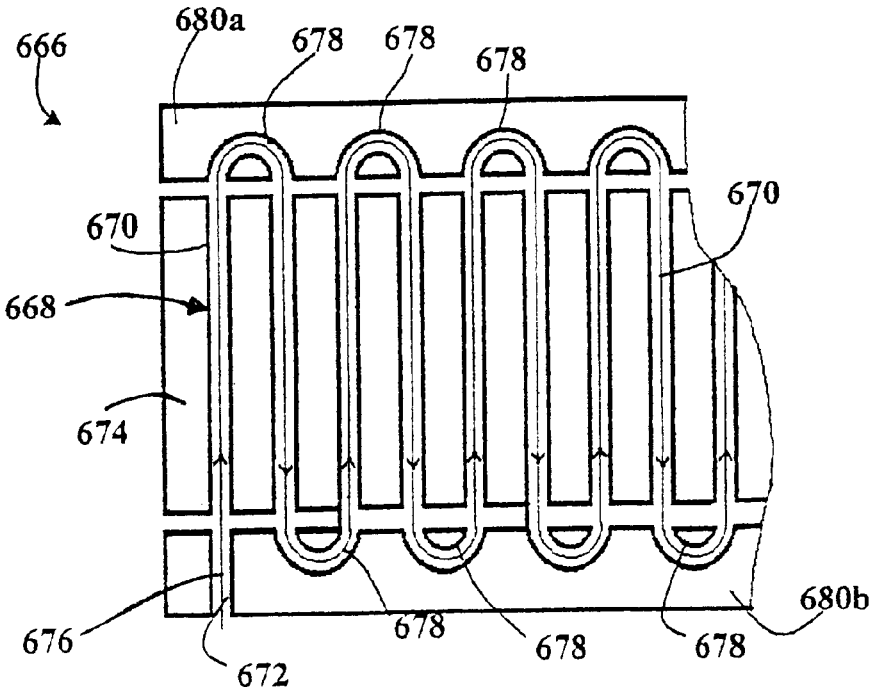
FIG. 30 is a schematic representation showing an undulating sequence of linear charged particle trajectories in combination with a steering arrangement.
Figure 31:
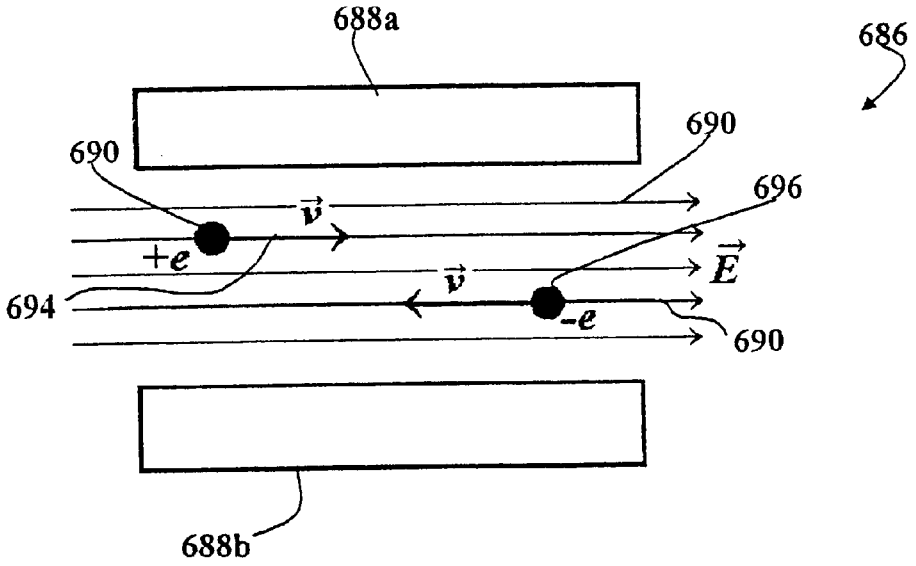
FIG. 31 Prior Art
FIG. 31 is a schematic illustration representative of the direction of motion, trajectory and force lines in a conventional linear accelerator.

FIG. 30 schematically represents the folded version of the instant undulative EH-accelerators for the purpose of comparison with the subject matter of FIGS. 28 and 29. In FIG. 30, the accelerator structure 666 is seen to comprise a folded acceleration channel represented generally at 668. This folding approach involves the utilization of linear acceleration channel portions as at 670. The accelerator input to the channel 668 is represented at 672. A core and winding assembly which is excitable with a distributed time varying current source is represented at 674. This assembly 674 develops a magnetic field within a core structure, as well as a crossed vortex electric field which functions to accelerate particles introduced from accelerator input 672 to progress along an undulating trajectory represented by path line or route 676. The folded and spatially constrained configuration represented by the channel 668 is achieved by combining the linear portions 670 with a turning arrangement at directional transition regions represented, for instance, at 678. A magnetic steering assembly generating a steering or turning magnetic field is positioned at each one of these transition regions 678, as represented by blocks 680*a* and 680*b*. While a turning at these regions 678 is achieved with a magnetic field and a turning is developed in connection with the betatron described in connection with FIG. 28, note that the turning approach of the system as provided at accelerator structure 666 is one where the turning is associated with a linear section or portion 670. Its turning path portions are relatively short with consequent small if negligible loss and there is no intra-particle collision between particles of different energizations, i.e., collisions between particles exhibiting different energies. The result is an accelerator structure quite compact and relatively light in weight. Also it may be recognized that the achieved compactness also contributes to substantial reduction in bulk and cost because of a smaller spatial volume caused to be held under vacuum.

Some contrast also can be evidenced with an observation of the very basic physical principles underlying a conventional linear induction accelerator. In this regard, looking to FIG. 31, a schematic representation of the basic performance of such an accelerator is presented as it pertains to its simultaneous effect upon positively charged particles and negatively charged particles. In the figure, an inductively based system represented at blocks 688*a* and 688*b* functions, in general, to create an electrical field represented by field lines 690. This longitudinal electric field is seen to have a direction, for demonstration purposes, from left to right in the sense of the figure. A positive charge particle 692 will move in this electric field from left to right in accordance of the velocity vector, $\vec{v}$ 694. Correspondingly, a negative charge particle 696 will move from right to left in the sense of the figure. This movement is represented by the velocity vector 698. These opposite particle velocity directions which are predicated upon the charge of a given particle may be contrasted or compared with the common output directional vector of systems according to the invention. In general see publication (1) above.

Figure 32:
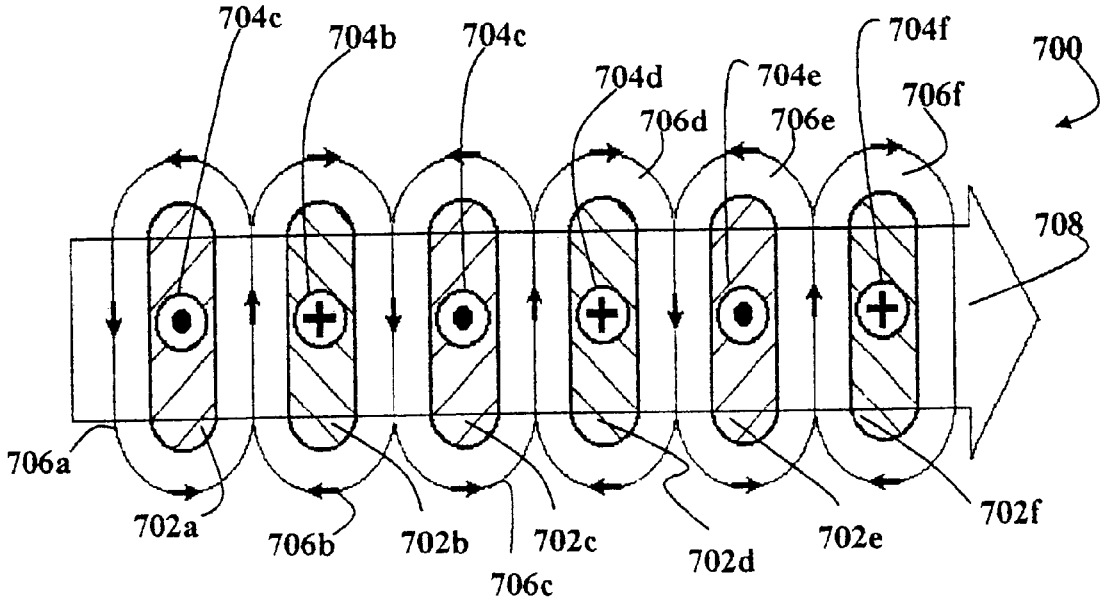
FIG. 32 is a schematic plan view of a crossed EH-undulative field.

Looking to FIG. 32, a plan view representation of an EH-undulative field pattern is presented showing magnetic poles and vortex electric field lines for a sequence of accelerator stages. This accelerator system, as represented in general at 700 is seen to be formed with a sequence of magnetic pole faces 702*a*–702*f*. Such an arrangement is described, for example, in connection with FIG. 8 above. The dots 704*a*, 704*c* and 704*e* represent one direction of the magnetic field generated which is perpendicular to the sheet on which the figure is drawn and the crosses as at 704*b*, 704*d* and 704*f* represent an opposite magnetic field. Electric field lines of force about these faces are represented at 706*a*–706*f*. These electric field lines of force 706*a*–706*f* are seen to be in a direction under which particles will undergo acceleration in accordance with the system directional vector represented by the large arrow 708. The charge characteristic of the particles involved is of no moment in evolving this vector, particles of opposite charge moving in its designated direction.

Figure 33:
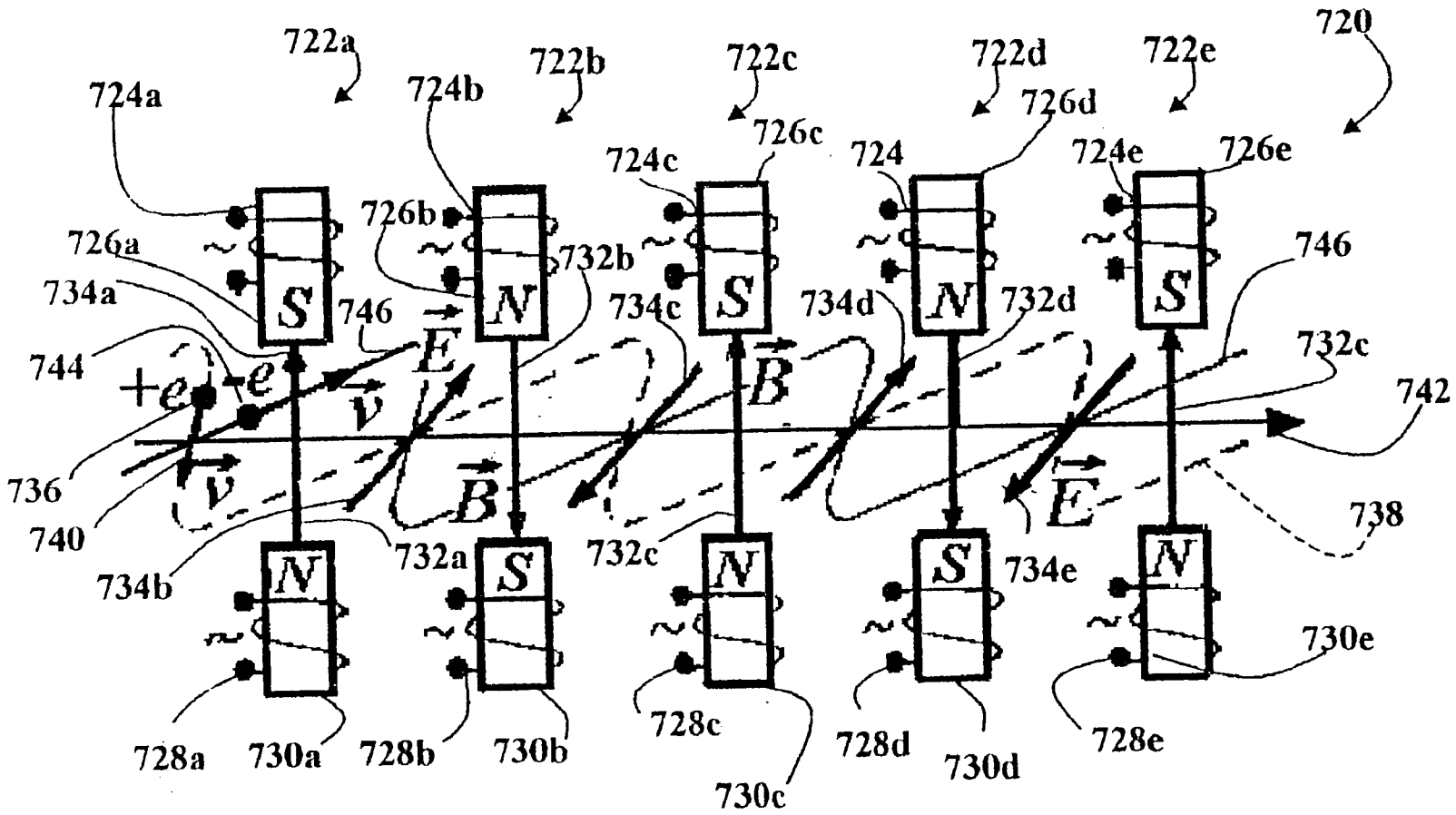
FIG. 33 is a schematic representation of an accelerator according to the invention showing the motion of charged particles and the arrangement of electrical and magnetic components of an EH-undulative field.

Referring to FIG. 33, a somewhat three-dimensional form of illustration of the performance of the system 700 at FIG. 32 is presented as represented in general at 720. The schematic representation in the figure of the EH-undulative field system shows the fields and trajectories of both negative (−e) and positive (+e) charge particles.

Running along the longitudinal extent of the system 720 are a sequence of accelerator stages represented generally at 722*a*–722*e*. Each of these stages is formed with a core component of magnetic material combined with a field winding for generating oppositely disposed, N, S polarity defining core faces. Thus, windings 724*a*–724*e* are operatively associated with respective core components 726*a*–726*e*. Oppositely disposed from the windings 724*a*–724*e* are corresponding field windings 728*a*–728*e* which are operatively associated with respective core components 730*a*–730*e*. Excitation current supplied to the windings 728*a*–728*e* provides the noted core face polarities N, S. These oppositely disposed inductive components with opposite faces of opposite polarity produce the mutually oppositely directed magnetic field vectors (induction vectors) 732*a*–732*e*. That magnetic field sequence evolves the electric field stage evolved vectors 734*a*–734*e*. Those electric field directions then generate a sinusoidal or undulative path or trajectory from left to right in the sense of the figure. A positive charge particle, +e, at 736 will move along the undulating trajectory represented by the dashed line 738. That movement will be with an instantaneous velocity and direction represented at arrow 740, and will progressively move in the direction represented by the axis of symmetry and direction of net propagation of the particles shown at arrow 742. Correspondingly, the negative charge particle, −e, at 744 will be accelerated along the sinusoidal or undulative trajectory route or path represented by the solid trajectory line 746. That negative particle 744 is shown moving in accordance with the vector represented at arrow 734*a*. Note that both the positive particles as at 736 and the negative particles as at 744 are propagated in the same system direction represented by the arrow 742. A key feature which becomes apparent from an observation of FIG. 33 is that the positions of maximum electric field are spacially exactly out of phase with the positions of maximum value of magnetic field. Accordingly, the maximum value of electric field occurs simultaneously with the occurrence of the minimum magnetic field. That condition is important inasmuch as, where the particles are achieving maximum acceleration, the involved magnetic field exhibits a minimum value, therefore providing a minimum turning force. Thus, the particles remain for a maximal time in the electric field to gain energy from that field. The majority of energy achieving acceleration of the particle occurs at those spacial locations where the electric field is a maximum value. That electric field maximum value occurs midway between the positions of maximum magnetic field, which is oriented in an opposite direction. Maximum and minimum electric field coincidence, as noted, occurs midway between the pole faces of each stage. At the extreme ends of the pole faces, the electric field is completed such that the particles are naturally turned. This evokes a sinusoidal motion.

It is well known that a charged particle moves in magnetic field under action of the magnetic Lorenz force:

$$\vec{F}_L = \frac{q}{c}[\vec{v}\times\vec{B}], \tag{1}$$

where q is the particle charge (q=±e in our case), c is the light velocity in vacuum. See reference texts such as:

(39) J. D. Kraus, D. A. Fleisch, "Electrodynamics", chapter 6, Electromagnetics with Applications, McGraw-Hill (Boston, 1999).

(40) W. K. H. Panofsky, M. Phillips, "Classical Electricity and Magnetism", Addison-Wesley Publishing Company (Reading, Mass.; 1964)

In the particular case of homogeneous magnetic field, action of the force (1) leads to motion of a particle in a circle or some arc of the circle trajectory (in a case when the scale of motion is smaller than is the circle radius scale). Besides that, because of the Lorenz force (1) dependence on the particle-charge sign, the negative and positive particles turn in any magnetic field in reciprocally opposite directions. In the case of the undulative magnetic field (see FIG. 33) the particle motion can be treated as a motion in circle arcs with currently varying cyclotron radius. The positive and negative charged particles under the action of the force (1) turn on curvilinear trajectories in mutually opposite directions (which depend on charge of the particles). Inasmuch as direction of the induction vector $\vec{B}$ periodically changes by undulative manner that the directions of turns of the particles are changed in undulative manner, too. As a result, the charged particles follow the sinewave-like trajectories. The distinctive feature of these trajectories is that their amplitudes are lower the higher the energies of the particles.

The vortex electric field is generated owing to the rapidly varying (in time) undulative magnetic field. One is readily convinced that in this case the force lines of the electric field have transversely undulative shapes in the plane, which coincides with the plane of particle trajectories. This plane lies between the magnetic-pole faces. However, it is easily seen that general physical picture of action of local electric field on a particle in any separate local point of its trajectory, in principle, is identical with the picture that takes place in the case of the linear induction accelerator (see FIG. 31). Indeed, owing to the Lorenz force (1) the negatively charged particle has direction of the transverse motion against the direction of the intensity vector $\vec{E}$. At the same time, direction of the analogous component of the positive particle motion is the same as the direction of the vector $\vec{E}$. Thus, in both cases the vortex electric field acts on the particles in an accelerative manner. But, in the case of linear inductional accelerators this occurs in longitudinal direction whereas in EH-accelerators such motion takes place in the transverse plane.

The work, which an electric field performs under acceleration of the charged particles, is:

$$A = q\int_0^{\vec{L}} \vec{E}(\vec{l})\cdot d\vec{l} \tag{2}$$

where $\vec{l}=l\vec{\tau}$, l is the current trajectory length, $\vec{\tau}$ is the tangential unit vector $\vec{L}=L\vec{\tau}_L$, L is the total trajectory length, $\vec{\tau}_L=\vec{\tau}|_{l=L}$. It is readily seen that according with the formula (2) synchronous changing of the particle sign and the direction of the vector of intensity of electric field $\vec{E}$ simultaneously, does not change sign of the performed work A. Hence, inasmuch as the negative and positive particles move in the work bulk of the EH-accelerator in the reciprocally opposite directions that they are accelerated here under action of the same undulative vortex electrical $\vec{E}$.

The utilization of the non-stationary linearly polarized EH-accelerator with dependent method of generation of the electric and magnetic field (see FIGS. 8, 32, and 33) may be contemplated for the forming of the pico-second relativistic bunches. This possibility follows from the physical features of this design, including the effect of phase discrimination of electron beam. Essence of this effect is the following.

As it is well known, characteristic feature of all undulative systems (for instance, Free Electron Lasers) is the possibility of realization of the effect of a threshold for the particle energy. In this situation all particles, whose energies are less than some threshold energy are rejected from the input of the system. This effect can be described by some threshold condition (which easily can be obtained) with respect to the particle energy. It is important to note that the threshold energy strongly depends on the magnitude of the magnetic undulative field.

In the case of non-stationary EH-accelerators, the threshold effect can appear in the two following possible forms.

The first is the traditional form and it can be treated as the phenomenon of the reflection of particles from the input of the system. This form we regard as the external reflection effect. The second has some more subtle nature. It appears in EH-accelerators as the capture-effect. The point is that the above-mentioned threshold condition essentially depends on magnitude of the magnetic field. A specific feature of the non-stationary EH-systems is that here the magnetic field turns out to be a slowly changing (increasing) function of time. It means that each particle, which moves within the working bulk of the accelerative channel, "meets" different magnitudes of the magnetic field at different points of the trajectory. Hence, the threshold energy (and corresponding threshold condition) also should change with longitudinal coordinate of the system during the particle flight. Correspondingly, the threshold condition may be violated in some cross-section of working bulk of the accelerator for some group of particles because their energy becomes here lower than the threshold energy. As a result, these particles should be reflected from this cross-section onto a lateral side of the accelerative channel. This phenomenon we treat as internal reflection or as the "capture effect".

In the case, when the transverse size of the accelerative channel is sufficiently large, these particles are captured in the neighborhood of some magnetic poles, performing the characteristic spiral-like motion in the plane between the poles. As an analysis showed, only those particles can further fluently move within the accelerative channel without any capture ("isochronous" particles), which enter at the input of the system strictly in that time moment (or, alternatively in that phase) when the magnetic field here equals zero. Together with these particles some part of the closest (in time of entry "non-isochronous") particles also can pass without capture. The range of "permitted "non-isochronous" particles can also pass without capture. The range of the "permitted non-isochronious" particles (that is, the particles that move without capture) is determined by the characteristics of the system and particle input energy. These particles constitute the pico-second pulse at the output of the system.

Figure 34:
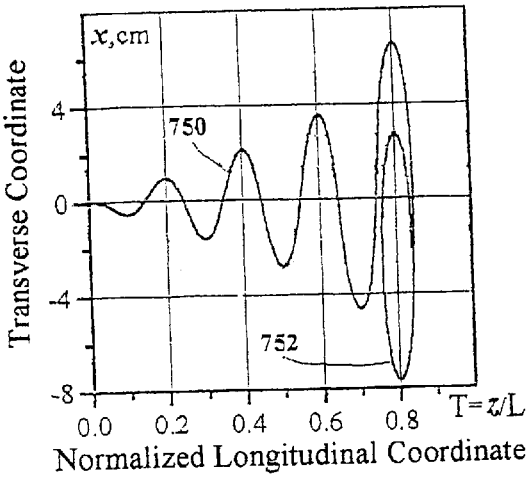
FIG. 34 is a graph showing the trajectory of an electron in a crossed EH-undulated field environment.

A detailed illustration of the capture effect is shown in FIG. 34. Here curve 750 represents the trajectory of the optimal "isochronous" electron in transverse plan XZ, x and z are the spatial coordinates, L is the length of accelerative region of the design. Calculations have been carried out for the following set of the design parameters: maximal magnetic field $B_{max}$=3 kGs, intensity of the vortex electric field E=300 kV/m (linear current in the coils), period of the electromagnetic undulator $\Lambda$=10 cm, length L=1 m, critical magnetic field $B_{cr}$=1.27 kGs (i.e., the field at the capture), initial kinetic energy of the electron $E_o$=20 keV, width of a pole of the electromagnetic undulator d=3 cm, form-factor for the undulative magnetic field n=0.7. It is readily seen that the capture of the electron occurs in the vicinity of the normalized location $T=T_{cr\ max}\approx z/L$. The calculation showed that any other electrons, which enter the acceleration channel later than this optimal electron are captured at normalized distances $T<T_{cr\ max}$, from the input.

Thus, all captured particles are neither reflected to the system input nor are absorbed by the walls within the EH-accelerator. This phenomenon we call the effect of phase discrimination of the electron beam. In this connection, we can say that the EH-accelerator of the depicted in FIGS. 32 and 33 type can work as a peculiar electron-beam-discriminator with respect to phase (time) at entry of the input electrons. This discriminator "cuts-out" from the initially relatively wide electron bunch, a very narrow pico-second bunch, which is "permitted" further acceleration by the threshold condition. Thus, from the above discourse one may observe that the curve 750 in FIG. 34, depicting the trajectory of an accelerated particle in an EH-field system shows that the particle increases in energy with distance along the acceleration channel in moving from left to right in the sense of the figure. This increasing particle energy results in an increasing, (somewhat) sideways motion of the particle trajectory. The simplified depiction shows the possibility of capture of the particles. Such particles may enter a certain distance but instead of exiting from the system they undergo a turn in reverse resulting in a spiraling motion represented at curve portion 752. Thus, such particles are lost from the accelerator output. Such, particle loss occurs because of the system symmetry wherein a particle is exposed to oppositely disposed forces with no built in impedance to its motion from right to left in the sense of the figure.

In view of the above, the "capture effect" of the EH-accelerator system may be employed for creating pico-second bunches or packets of high energy particles.

FIG. 35 has been the subject of earlier discourse. The process of motion of a charged particle (that possesses the charge q and the velocity $\vec{v}$) in a circularly polarized EH-accelerator (see FIG. 9) is illustrated in this earlier described FIG. 35. Here: 178 is the projection of the particle trajectory in a transverse plane, 180 is the particle trajectory, 182 are the vectors of induction of the magnetic field ($\vec{B}$), 188 is the accelerated particle, which is characterized by charge q and velocity vector $\vec{v}$. In this case the particle trajectory 182 is formed under an action of transverse circularly polarized undulative magnetic field $\vec{B}$. As it is obviously seen, that the plane, which is formed by the vectors of induction $\vec{B}$, turns out to be a spiral-like one. As a result (see formula (1)) the particle trajectory 182 also possesses a spiral-like form. The spiral-like force lines of accelerative vortex electric field $\vec{E}$ always have a parallel component with the particle trajectory.

The circularly polarized EH-accelerator (see FIGS. 9, 34) may be used as a system for improving the emmitance of charged particle beams. Non-stationary as well as stationary designs can be used for this purpose. Analogously to the non-stationary linearly polarized EH-accelerators (see FIGS. 8, 32, and 33) here are also possible the effect of reflection of charged particles at the input of the electromagnetic undulator and the capture effect. In the case of the stationary designs only the first effect can occur. Whereas in the non-stationary designs both effects are possible. The following peculiarity of the mentioned effects in the circularly polarized EH-accelerators is utilized. In contrast to the linearly polarized EH-accelerators in the case of circularly polarized design the reflection and capture effects appear with respect to an angle of entry of a charged particle at the input of the electromagnetic undulator. The particles, which enter at the input parallel to the axis of the undulator, undergo acceleration in its bulk without reflection and capture. The particles, which enter at the input non-parallel to the axis can be reflected and captured. As a result the specific mechanism of separation of the particles with respect to the angle of entry is realized (see FIG. 36). This mechanism is important in improving the emmitance of accelerated beams.

Figure 36:
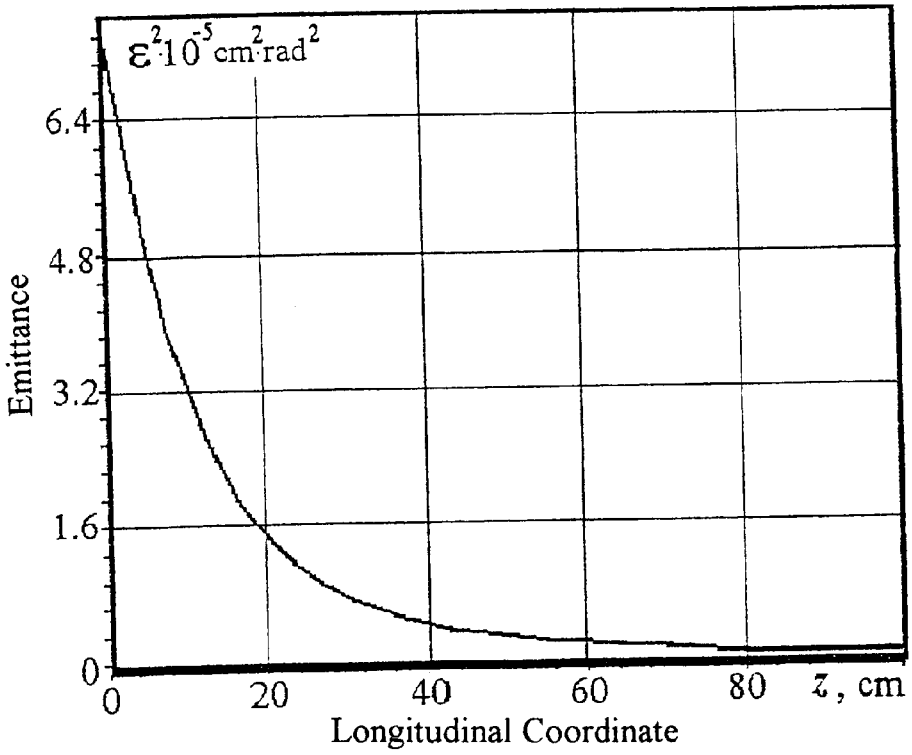
FIG. 36 is a graph illustrating the dependency of the normalized quadratic emmitance on longitudinal coordinate for a non-stationary circularly polarized undulator.

The physical feature of the effect of improving emmitance is illustrated in FIG. 36. Here the dependence of the normalized quadratic emmitance on the length of the non-stationary circularly polarized undulator is shown. The calculation has been accomplished for the following set of design parameters: maximum induction of the magnetic field $B_{max}$=3 kGs, intensity of the vortex electric field E=400 kV/m, period of the undulator Λ=10 cm, length of acceleration region of the design L=1 m, duration of the input bunch $\tau=10^{-9}$ second, initial energy of the bunch $E_o$=100 keV, width of a pole of the undulator d=0.8 cm, form-factor of the magnetic field n=0.7, and initial magnitude of the normalized quadratic emmitance $\epsilon^2(z=0)=2.4\ 10^{-5}\ cm^2\ rad^2$.

Also contemplated herein is the utilization of the non-stationary elliptically polarized EH-accelerator as a system for forming especially short bunches of charged particles and for improving the emmitance of the bunch, simultaneously. The elliptically polarized designs have an intermediate place between the linearly polarized and circularly polarized systems. Correspondingly, the capture effect and the effect of improving the beam emmitance can appear simultaneously.

As it is mentioned above, FIG. 34 illustrates the trajectory of an accelerated particle in the systems with radially-directed vectors of the undulative magnetic field induction $\vec{B}$. The vortex electric field here can be generated as well, owing to the same dependence on the slowly changing magnetic component of the EH-field—see, for instance, FIG. 9) and by virtue of some independent method (when both components are generated by different systems). Another version of the circularly polarized EH-accelerator is realized in the design, which is shown in FIG. 24. The physics of the process involved there is illustrated in FIG. 37 which has been discussed briefly earlier. Here: 566 are vectors of induction of the axial magnetic ($\vec{B}$), 564 is the particle trajectory, 568 is the charge of the particle (q), 570 is the vector of velocity of its motion $\vec{v}$, 572 is the projection of the vector of intensity of the electric field on the trajectory 564 ($\vec{E}_{II}$). The characteristic feature of this system is the axial direction of the vector of induction of the magnetic field $\vec{B}$. In principle, such a system can be considered to be a peculiar spiral version of the betatron. Strictly speaking, this type of EH-accelerator, with respect to the form of the magnetic field, should not be considered to be an undulative one. But, this configuration of the EH-fields provides a form of undulative-like (spiral-like) trajectory of the accelerated particles. Therefore, this class of devices we also can classify as undulative inductional accelerators (EH-accelerators).

It should be noted that designs of the circularly polarized EH-accelerators might have also cylindrical and coaxial implementations (see FIGS. 10 and 11). In the first case the acceleration channel has cylindrical form, while in the second case it possesses a pipe-like form. However, this design difference does not change the above physical explanation of basic accelerator operation. The same situation is realized also with respect to all designs, which use both dependent and independent methods of generation of magnetic and vortex electric fields.

Figure 38:
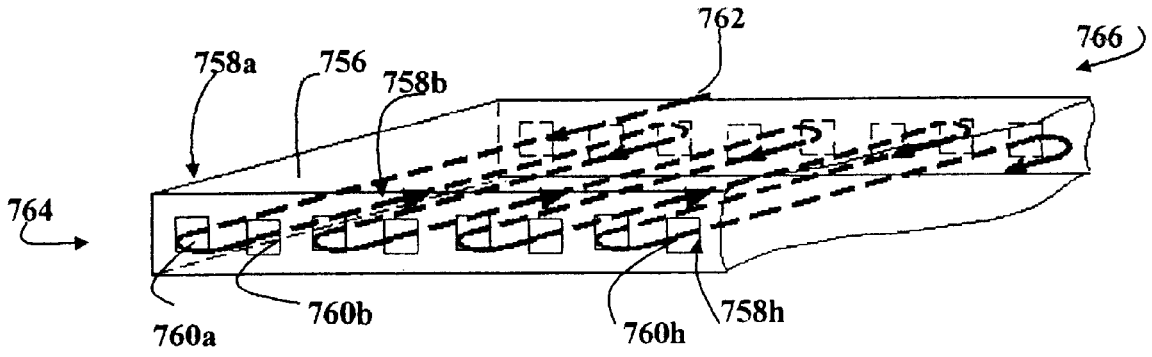
FIG. 38 is a schematic perspective representation showing a folded field trajectory for a single-level, multi-channel EH-accelerator.

The discourse now turns to subgroup 8B wherein the principles of operation of the EH-accelerators with independent generation of their E and H fields is presented in connection with FIGS. 38–43. Looking to FIG. 38, the scheme of passing a particle beam in the one-level design with independent methods of generation of the magnetic and electric fields as discussed in connection with FIG. 16 is represented. In the figure, an integrally formed magnetic material block is represented at 756 within which are located a sequence of adjacent, linear substantially parallel accelerator stages from first to nth, the first such stage being represented in general at 758*a* and the last illustrated being shown at 758*h*. Each of the stages 758*a*–758*h* is configured having an open elongate channel 760*a*–760*h* about which field windings are located as discussed above. FIG. 38 shows a trajectory for particle beam components as they extend from a channel entrance to a channel exit. The accelerator input is represented at 762 with particles from a source entering the stage 758*a* entrance and leaving the channel exit at a steering assembly region which will be present at the region 764. From the stage 758*a* exit, the particle beam path turns to enter the entrance of acceleration stage 758*b*, whereupon it proceeds to the exit of channel 760*b* to turn under the influence of a steering assembly at the region represented at 766. This winding or undulative path of the particle beam trajectory or path route continues until the last or nth accelerator stage. As it is seen in FIG. 38, trajectories of the charged particle beam possess the line-like form within particular accelerative channels and it is curvilinear within the turning systems. The main acceleration occurs at the straight parts of the particle trajectories under action of the vortex electric field.

Figure 39:
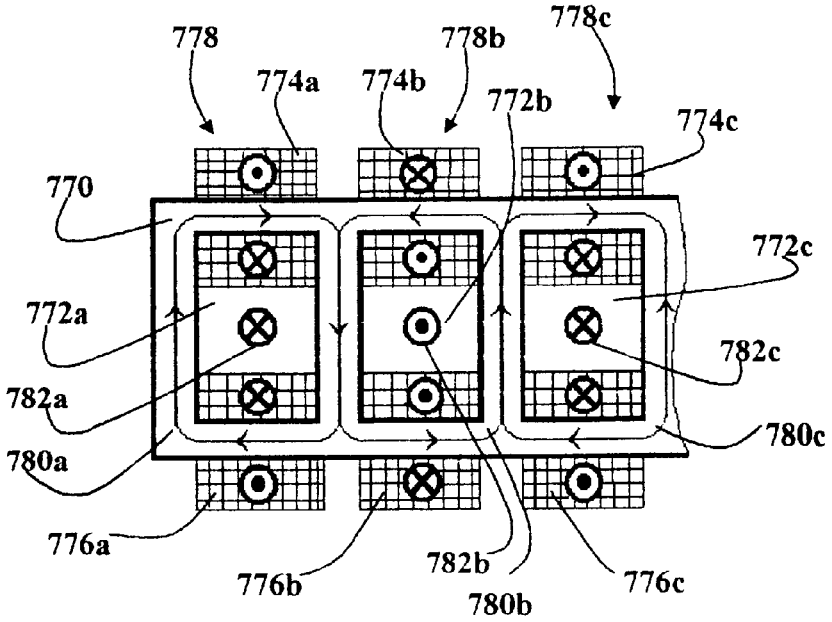
FIG. 39 is a plan schematic view illustrating the physical mechanism of generation of a vortex electric field with respect to accelerator stages.

FIG. 39 is a frontal schematic view of multi-channel single level and parallel accelerator stages as shown in FIG. 38. The figure reveals a representation of the magnetic material core at 770 as it would face the reader in the sense of FIG. 38. Within this core 770 there are positioned a sequence of parallel channels, three being shown as 772*a*–772*c*. These channels 772*a*–772*c* correspond with the channel 760 in FIG. 38. A sequence of stages is developed by providing field windings about each of the channels 772*a*–772*c*. In this regard, winding upper components are represented at 774*a*–774*c*. Corresponding lower components wound about channels 772*a*–772*c* are shown respectively at 776*a*–776*c*. Directions of current of the applied time varying current (R.F. current) are represented by the dots and crosses within the winding component 774 and 776. Those induced time varying currents will create a continuous, closed loop magnetic field in each of the magnetic material cores. Thus, a sequence of accelerator stages which are parallel in singular level are evolved as represented at 778*a*–778*c*. Core-containing time varying magnetic fields are shown by the arrow paths at 780*a*–780*c*. The resulting electric fields within each channel 772*a*–772*c* are represented by directional vector arrows indicated by crosses and dots shown respectively at 782*a*–782*c*. It is this electric field which acts upon the charged particles. It is readily seen that the directions of the currents in the windings turn out to be mutually opposite in any pair of neighboring stages or coils. Or, in other words, the transverse-undulative system of currents is formed in this case. The currents are changing in time according to some law of change. For instance, this can be the saw-tooth-like dependency of current magnitude on time. In this case within the limits of one pulse the current dependency can be considered a line-like one. In turn, the changing in time currents in the coils generate the changing in time magnetic field within block 770. The force lines of this magnetic field are shown at 780. As it is clear in FIG. 39, the transverse cross-section of core ("ferrite" or magnetic material block) 770 can be regarded as a chain of frame-like magneto-conductors. Magnetic contours 780 within these magneto-conductors are realized because they are closed. It is important that the horizontal directions of motion of the magnetic flux in each pair of the neighboring contours are reciprocally opposite. Whereas, the vertical directions of the magnetic flux in these any two neighboring contours always coincide. As a result the magnetic fluxes in all frame-like magneto-conductors or stages 778 are found to be closed. Therefore, each accelerative channel in this case is surrounded by the closed magnetic flux within its core walls. Inasmuch as this magnetic flux is changing in time that it generates the vortex electric field owing to the effect of electromagnetic induction. In the particular case of saw-tooth-like pulses of the current in the coils this electric field can be regarded quasi-stationary within the limits of one pulse. The directions of the vector of intensity of the electric field should be perpendicular to the plane of the magnetic contour. These directions are determined by the well-known "rule of an auger". In the discussed case it means that vectors of intensity of the vortex electric field 782 are directed along particular accelerative channels 772. The directions of vectors of intensity of electrical field 782 are reciprocally opposite within any two neighboring channels. This is determined by the opposite directions of circulation of the magnetic flux in the magnetic contours of both particular channels.

The operation principle of the planar one level design version of the EH-accelerator (see FIGS. 12–16) is discussed above. The cylindrical one-level design-version (see FIGS. 22, 23) has the similar operation principle. Analogously, the operation principle of the multi-level (planar or cylindrical) design-versions can be described also. This is illustrated below at the example of some planar two-level design-versions.

Generally, as analysis shows, all possible arrangements of the multi-level design-versions can be divided into three different groups:

a) the systems contained of two or a few different levels with horizontal turns, where each pair of the levels is connected by one turning system;

b) the systems where all particular acceleration channels are connected only by vertical turning systems;

c) the combined systems.

Figure 40:
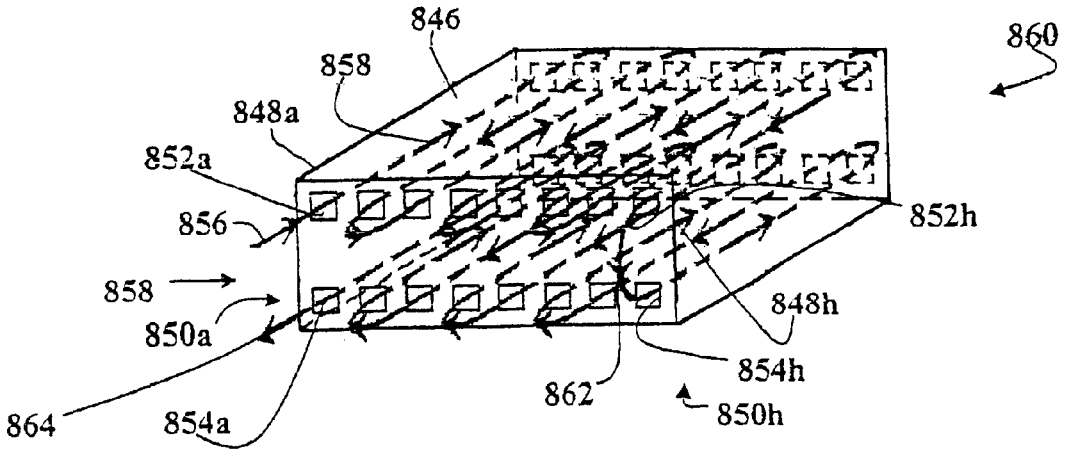
FIG. 40 is a perspective schematic view of a two-level accelerator approach wherein a particle trajectory is evolved undulating between adjacent accelerator stages of one level and then along the stages of the second-level of a sequence of stages.

The example of designs of type a) is illustrated in FIG. 40. In FIG. 40, an integral core formed of magnetic material is represented at 846. Core 846 provides the foundation for a two-level multi-channel or multi-stage system. The physical arrangement for the components of this intra-level-type of accelerator has been discussed in connection with FIG. 18 above. In the symbolic drawing of trajectory shown, a sequence 840 of upper accelerator stages is shown at 848*a*–848*h*. Aligned vertically with the sequence 848 is a corresponding sequence 850 of accelerator stages which are parallel and planer within a single level as shown at 850*a*–850*h*. The upper accelerator stages 848*a*–848*h* as before, are shown associated with core-formed channels or elongate openings 852*a*–852*h*, and corresponding channels are shown within stages 850 at 854*a*–854*h*. The accelerator input, i.e., input from the particle source or the particle beam trajectory commencement is represented at 856 and it may be seen that this trajectory, as represented at 858, within the upper sequence of stages 848 undulates back and forth within the single sequence 848 with turns within a "horizontal" turning region carrying steering assemblies as represented at 858 at the forward portion of this system and 860 at the rearward portion. Particle trajectory path 858 continues at this single sequence level until stage 848*h*, whereupon it curves under "vertical" steering downwardly as represented at 862 to enter the channel entrance of stage 850*h*. The particle trajectory or path route then undulates back and forth from stage to stage until exiting as beam 864 from stage 850*a*, which now represents or directs the particles to the accelerator output. The specific feature of this design is that the input beam 856 is introduced at same end of the accelerator as the output beam 864.

Figure 41:
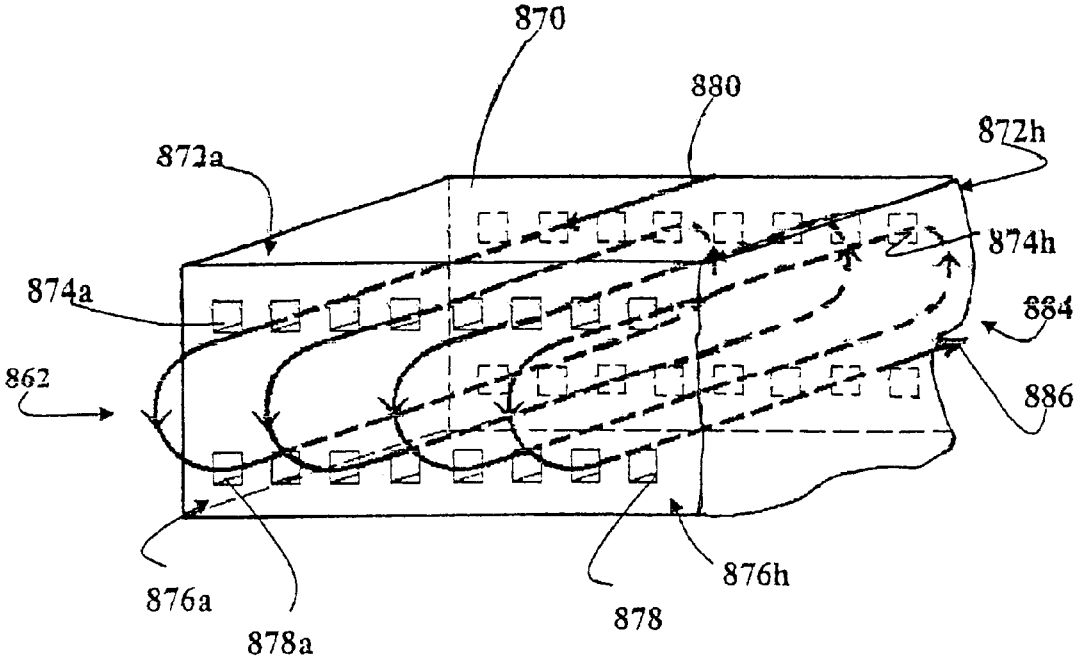
FIG. 41 is a schematic representation of accelerator structure employing accelerator stages with spaced-apart stage channels that are connected by turning systems.

The multi-level designs of the type b) are most promising in the case of large energy accelerated particles or in the case of acceleration of ion beams. The example of such system is illustrated in FIG. 41. In the figure, an inter-level multi-stage configuration is presented with steering wherein the path route or trajectory of the particle is one alternately passing from one sequence level to the next. In the figure, a core or block of magnetic material is shown at 870. As before, core 870 incorporates an upper sequence 872 of substantially linear and parallel accelerator stages represented at 872*a*–872*h*. Each of the stages 872*a*–872*h* is configured with an open or hollow elongate channel as at 874*a*–874*h*. Such channels are configured with a designated entrance and a designated exit.

Below the sequence of stages 872 is another aligned sequence 876 of substantially linear and parallel accelerator stages 876*a*–876*h*. As before, the stages of sequence 876 are configured with open and elongate channels formed in 878*a*–878*h* formed within the core 870. Windings and steering assemblies at the front and back of the arrangement complete the accelerator which is configured with a particle trajectory path or route with comment at an accelerator input at 880. The energized particle path commencing at 880 is one, as discussed above, which is employed for two spaced-apart sequence levels in which the steering directional transition regions may be considered "vertical", the path progressing through a stage of one sequence and then by vertical steering into the entrance of a stage of the next sequence and so on until the last stage is reached. This sequence is represented in the figure with the introduction of the particle path route or trajectory at 880, whereupon it exits from stage 874*b* to be turned at 882 to enter stage 878*a* of sequence 878. Note that the path then progresses through lower sequence stage 876*a* to its exit and again is turned or steered vertically to enter the entrance of upper sequence stage 874*d*. This undulation with vertical steering continues until the output extending to the accelerator output is developed as represented at arrow 886. The rearward steering region is represented at 884 and it may be observed that a relatively larger radius of turning may be developed with the steering assembly regions 882 and 884. The particle trajectory path involved for any of the given sequences or levels is one which utilizes alternative stages.

The larger radii contribute to the utilization of the trajectory path shown with higher energy systems or heavy ions. In contrast to the previous case in FIG. 40 here the accelerated charged particle beam performs only vertical turns. This means that turning radiuses (or, that is the same, magnitudes of the induction of magnetic field in the turning systems) in the design in FIG. 41 may be essentially lower that in the design in FIG. 40. However, only half of the total number (i.e., ever other one or alternate one) of the particular accelerator channels or stages 872, 876, in the system with vertical turns in FIG. 41, is used. This is explained by the directions of the vector of intensity of electric field in any two neighboring channels (for "vertical" steering) to be reciprocally opposite. Hence, in the discussed case the directions of the intensity vectors of electric field within all "empty" channels would be in directions of deceleration.

Advantageous utilization may be made of the requirement for alternating the stages of each sequence in a dual level sequence as shown in FIG. 41. In this regard, sequence 872 may be configured to hold, in effect, two sequences with two undulating particle beams which cooperate with dual sequences at what initially is described as sequence 876.

Thus, the channels which are unused as shown at 872, to wit 874*a,* 874*c,* 874*e,* and 874*g* may be combined with lower level stages 876*b,* 876*d,* 876*f* and 876*h*. Accordingly, two particle beams are accelerated with the dual sequence or dual level system at hand with attendant advantages as noted earlier. Of particular note in that regard, any thrust or impulse occasioned by the energized particle path trajectories is countermanded or neutralized by the adjacent trajectory of the second particle path. This feature of no resultant momentum is of value in systems striving for a frictionless condition without spurious or undesired movement such as space propulsion or highly delicate suspended industrial processes.

Figure 42:
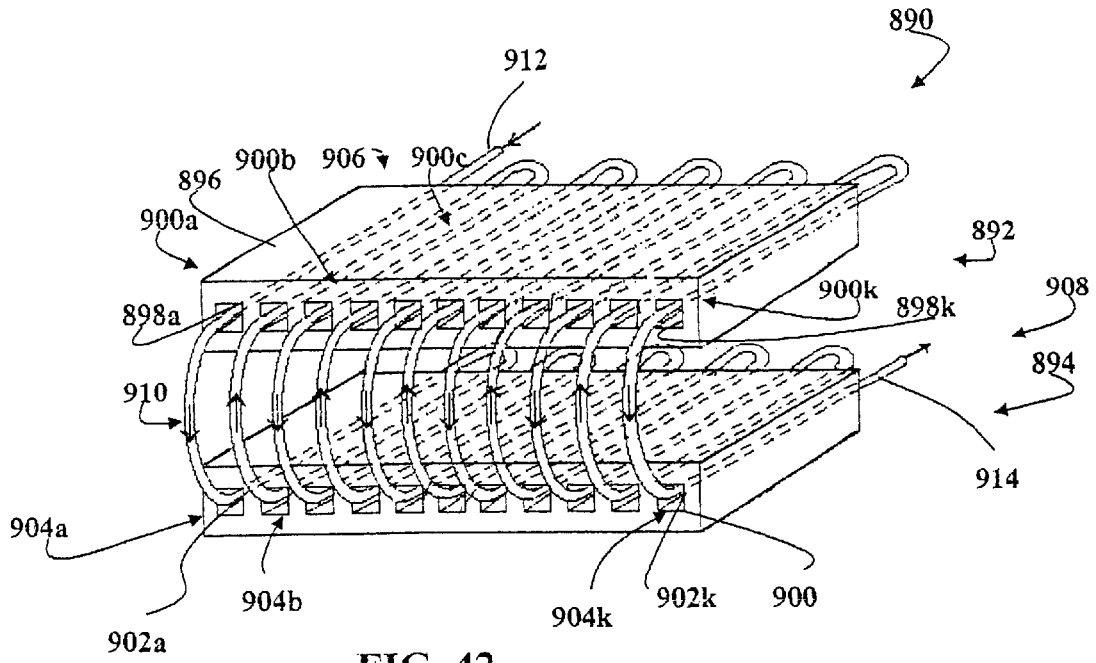
FIG. 42 illustrates a hybrid accelerator arrangement involving two, spaced apart levels of accelerator stages of accelerator stage sequences.

An example of the combined design-version (the system of the type c) is illustrated in FIG. 42. The somewhat hybridized EH-accelerator system is represented generally at 890 and is seen to include two discrete accelerator stage sequences represented generally at 892 and 894. Note that these sequences are physically, in this case, vertically mutually spaced apart and in their final configuration, each stage will incorporate two windings in the conventional physical structural technique described earlier herein. The upper accelerator stage sequence 892, as before, is seen to be configured with a magnetic material core 896 of integral or single piece block configuration which is formed of magnetic material having a sequence of parallel mutually spaced apart channels 898*a*–898*k*. Each of these channels 898*a*–898*k* is configured with dual component windings as described hereandabove and thus each constitutes a discrete accelerator stage represented generally at 900*a*–900*k*.

Looking to lower disposed accelerator stage sequence 894, as before, this sequence 894 is formed within an integral core of magnetic material shown at 900. Core 900 is configured with a sequence of mutually spaced apart and parallel channels 902*a*–902*k* which are combined with appropriate windings such that each constitutes a linear accelerator stage 904*a*–904*k*. A turning assembly dedicated to the level or plane represented by the rearward side, in the sense of FIG. 42, of stage sequence 900 is positioned at the region represented at arrow 906 and, similarly, such a stage sequence 894 dedicated rearwardly disposed turning assembly region is located as represented in general at arrow 908. The turning assemblies in these regions 906 and 908, with the exceptions of the accelerator input and accelerator output function to cause the particle path or trajectory to assume a route moving from one stage to the next adjacent stage across the given sequence. In this regard, the channel exit of each alternate stage from second through last of the stages of sequence 892 is in particle transfer relationship with the entrance of each channel of each next adjacent stage of that sequence 892. However, the turning assemblies at the forward region shown generally at 910 are configured for inter-sequence maneuvering of the particle path. Accordingly, the accelerator input represented at particle path beginning 912 extends through stage 900*a,* whereupon the steering assemblies at region 910 cause it to be turned through a relatively larger radius into the entrance of stage 904*a*. In this regard, the channel exit of the first stage 900*a* of sequence 892 is in particle transfer relationship with the channel entrance of the first stage 904*a* of the lower sequence 894. The path then extends through stage 904*a* to be turned at the steering assembly region 908 into the entrance of next adjacent lower stage 904*b*. The turning assembly at forward region 910 then turns this path to cause a route into the entrance of the next adjacent accelerator stage of sequence 892 as at 900*b* to occur. Upon leaving the channel exit of stage 900*b,* the steering assembly within region 906 turns the trajectory to form a route into the entrance of next upper stage 900*c* of the sequence 892. This route for the particle beam or trajectory reiterates until the accelerator output is derived at 914. Note from above that the channel exit of each alternate stage from second through next to last of the lower sequence 894, i.e., stages 904*b*–904*j,* are in particle transfer relationship with the channel entrance of each channel of each next adjacent stage of this lower sequence 894. Correspondingly, the channel entrance of each alternate stage from second through next to last of the upper sequence 892, i.e., stages 900*b* alternating to stage 900*j* are in particle transfer relationship with the channel exit of each alternate stage from second to last of the lower sequence 894. Note that the input 912 and output 914 advantageously are on the same side of the system 890.

Figure 20:
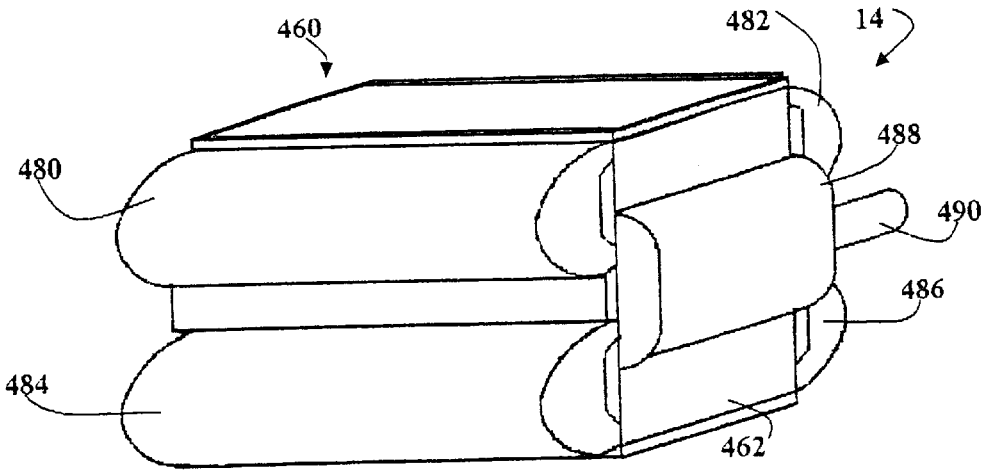
FIG. 20 is a perspective schematic representation of a two accelerator system with a feature for combining two output particle beams.
Figure 43:
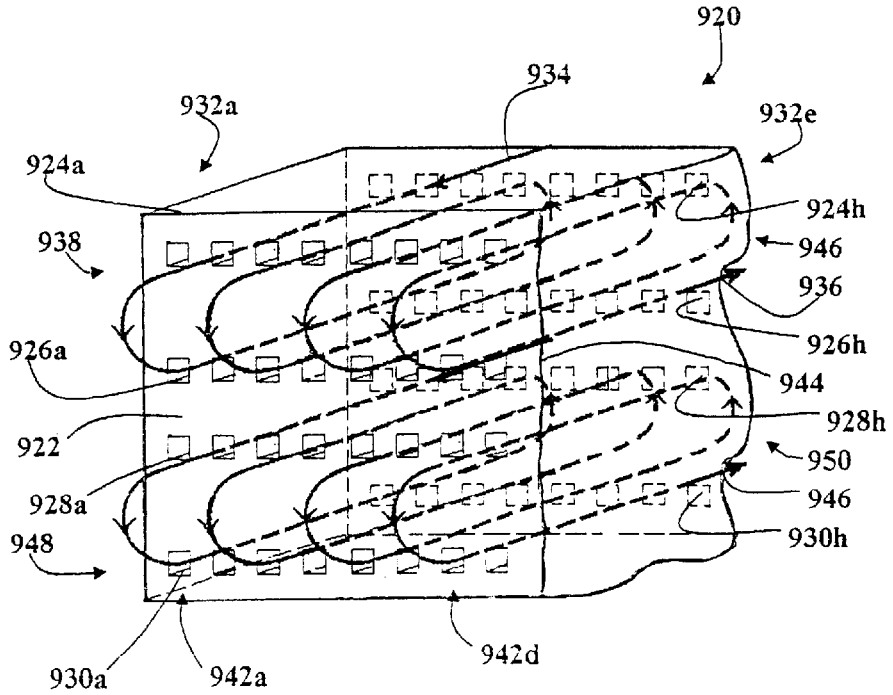
FIG. 43 is a perspective schematic representation of an arrangement for generating two particle beam outputs.

The operational principles of system with more numbers of levels are analogous. This can be illustrated at the example of the planar four-level systems, which is shown in FIGS. 20,21. The scheme of passing of the charged particle beam in such design (without a system for joining of both beams) is illustrated in FIG. 43. This two-beam system is shown in general at 920 and is seen to include a singular core formed integrally of magnetic material and shown at 922. Core 922 is formed having a first stage sequence 924 having parallel, mutually spaced-apart channels 924*a*–924*h*. Spaced at a more extended distance below the sequence channels 924*a*–924*h* is a corresponding stage sequence 926 with channels which are paired therewith and are shown at 926*a*–926*h*.

In similar fashion, a lower portion of the core 922 is configured with a stage sequence 928 with parallel, mutually spaced apart channels 928*a*–928*h* which are paired with the corresponding channels of a stage sequence 930 spaced therefrom and shown at 930*a*–930*h*. Field windings are provided in conjunction with channel sequences 924 and 926 to establish respective sequences of accelerator stages 932*a*–932*e*. Note that these stages are positioned at every other one of the channels (alternate channels) and that the accelerator input for the particle beam trajectory or path route is seen to be located at 934 and the accelerator output is shown at 936. Turning assemblies are provided at the forward region represented in general at 938 and at a rearward region shown in general at 940.

Field windings are provided with the channels of sequences 928 and 930, to establish respective corresponding sequences, of accelerator stages 942*a*–942*h* and 943*a*–943*h*. The accelerator input for the particle beam trajectory or path route is at 944 while the corresponding output of this separate particle accelerator is at 946. A sequence of steering assemblies is provided in the region shown generally at 948 and a corresponding rearwardly disposed combination of steering assemblies is provided at the region shown generally at 950.

The discourse now turns to Group 9 of the figure groupings which is concerned with methods for particle turning or steering and encompasses FIGS. 44 through 48. EH-accelerators may be employed as a system for cooling charged particle beams. The cooling features of some design versions of EH-accelerators are based on the specific mechanism of selective acceleration of charged particles. The essence of this mechanism consists in that the particles with higher energy accelerate less than particles with lower energy in EH-coolers. As a result an equalization of particle energies of the beam occurs.

It should be mentioned that the character of the cooling effect essentially depends on individual features of different designs of the EH-accelerators. Two variants of this effect can be realized in the EH-accelerators. The first of them is characteristic of systems with crossed undulative EH-fields, when both components of the EH-field are generated in the same work volume (see FIGS. 32,33). In this case the dependence of the averaged energy of a charged particle on the longitudinal coordinate can be described by the following expression:

$$\overline{H} = H_o ch\left\{\frac{eE}{ckp_o}\right\}, \tag{3}$$

where $\overline{H}$ is the averaged energy, $H_o$ is the initial energy, e is charge of the accelerated particle, E is the intensity of the electric field, $P_o$ is the initial mechanical momentum of the particle, $k=2\pi/\Lambda$ is the wave number of the undulative EH-field, $\Lambda$ is the period of this field. It is readily seen that indeed the particles with higher initial energy (initial momentum $P_o$) accelerate less than particles with lower initial energy (momentum $P_o$). Here we assumed that the intensity E is constant within time interval of the particle passing through the accelerator.

The second variant of the cooling mechanism can be realized in systems with non-undulating crossed fields (but with undulative form of particle trajectories). Some turning systems in linearly polarized EH-accelerators and induction systems in circularly polarized EH-accelerators might be used as evident illustration examples of such kind. Discussion of such examples we begin with some specific general features of the cooling effect.

It should be mentioned that from the traditional point of view, the cooling effect seems rather unusual. Firstly, it is well known that according to the second law of thermodynamics heat cannot be transferred from a cold object to a hotter one. It would seem, therefore, according to this law, the effect of cooling of a charged particle beam is impossible. But, in reality, this is not quite right, because this law might be applied to thermodynamically closed systems only. It is well known that any charged particle beam, which moves in external electromagnetic fields, is essentially an open system. Hence, we have no discrepancy with the fundamental principles in our case. Secondly, it would seem also that the fact of cooling obviously contradicts with Liouville's theorem. However, analogously with the first case, it is not right. It is well known that this theorem concerns the conservation of the phase volume (emmitance) only, whereas in the case of the cooling effect an equalization of particle energies (reduction of the beam temperature) takes place. In this connection, the cooling effect can be interpreted as a relevant turn of the phase volume in six-dimensional space, as a whole. The momentum projections are reduced and the coordinate (in space) projections are increased, simultaneously. In, the opposite situation the effect of dynamic heating of charged particle beam takes place.

As it is said above, a charged particle moving in the EH-undulated field undergoes acceleration. The particle trajectory between the electromagnet poles (see, for instance, FIG. 33) is determined mainly by the action of the magnetic field. It is well known that a charged particle moves within a homogenous magnetic field on a circular-type trajectory with radius equal to $$R_c = \frac{mc^2}{qB}\sqrt{\gamma^2 - 1}, \tag{4}$$

where $\gamma=E/mc^2$ is the relativistic factor; E is the energy, m is the rest mass of the particle; B is the induction of the magnetic field (the other values have been described earlier). Just as well in the case of storage rings the idea of the cooling effect is based on the phenomenon of particle dispersion, which is widely known is beam technologies. The essence of this phenomenon is explained in FIG. 44. Here: 956 is the charged particle beam which contains particles of different energy (in a uniform magnetic field). Accordingly, the particles will undergo bending of their paths; 958 are directions of the vector of induction of the homogeneous magnetic field $\vec{B}$; 960 are the trajectories of four different charged particles (with numbers 1, 2, 3, and 4). Accordingly with the formula (4), the particles 1, 2, 3, 4 should move along the circular trajectories with relevant different radiuses $R_1$, $R_2$, $R_3$, $R_4$. The particles with high energy $mc^2\gamma$ move on trajectories of larger radiuses than particles with lower energy (fee formula (4)).

Let's turn to the traditional version of the cooling effect, which is well known in accelerator technologies. In this case the mechanism of selective losses (which is represented in the form of cyclotron radiation) has some specific features. These features are determined by the physical nature of synchrotron radiation. Namely, particles with larger radiuses (higher energy—see formula (4)) radiate (lose) more electromagnetic energy than the smaller radiuses particles. Owing to this mechanism the equalization of particle energies in storage rings occurs. However, in reality this effect appears rather feebly in view of the weakness of the effect of synchrotron radiation in analogous physical situations. This leads to the consequence that today storage rings are only one of the real systems where this physical mechanism can be realized and used practically. But, as it is well known, the storage rings are rather cumbersome systems. This circumstance essentially reduces the practical significance of the discussed "synchrotron" version of the cooling effect.

Further we analyze our version of the cooling effect. In contrast to the traditional version this version uses the peculiar mechanism of selective acceleration. The mechanism of selective acceleration is characterized by essentially higher intensity than the mechanism of selective losses. Consequently it can be realized at an essentially lesser length of a system. In turn, this provides a very promising possibility for constructing an especially compact cooling system.

There are at least two possible variants of the cooling mechanisms on the basis of the effect of selective acceleration. As it was noted already, the mechanisms of the basis of the effect are selective acceleration. As it was noted already, the mechanism of the first type can be realized in the case when acceleration of cooled beam occurs within a superposition of crossed undulative electric and magnetic fields. For illustration of the latter we discuss the simplest model of the linearly polarized cooling system pictured in FIG. 33. The transverse magnetic field between the poles is a periodic function of longitudinal coordinates z: B=B(z). As a result of this, the particle trajectory can be roughly regarded as the periodical consequence of the circular arcs. In this case the particles with the higher energies (which are characterized by larger turning radiuses—see formula (4)) less deviate in the transverse plane than the particles with lower energies. Hence, the particles with lower energies move on longer trajectories than the particles with higher energies. It means that the vortex electric field performs more work in the acceleration of the lower-energy particles than in the acceleration of the more energetic particles (see formula (2)). As a consequence, the magnitudes of the energy of different particles tend to be equalized. The physical mechanism of this type, we treat as the mechanism of selective acceleration of charged particles in EH-fields.

In principle, the same physical situation realizes in the case of the circularly and the elliptically polarized systems with a radial direction of the magnetic field. The only difference is that here the cooling mechanism develops in a three-dimensional space, not in two-dimensional space, as it takes place in the case of linearly polarized EH-accelerators.

However, essentially another situation occurs in the systems with axially directed magnetic field (see FIGS. 24, 37) and in some design versions of turning systems (see, for instance, FIG. 15). It should be reminded that in the above-discussed case curvilinearity of the trajectory is caused by virtue of the undulative nature of the magnetic field $\vec{B}$ (see FIGS. 32, 33). In this case, as it is shown above, the amplitude of the particle oscillations (or, it is the same, as the magnitude of spiral radius in the case of circular polarization) is higher as the particle energy is lower. In contrast, in the systems with axially directed magnetic field the opposite situation is realized. Here, as the rotation radius of a particle becomes larger the higher its energy is. This conclusion follows from the formula (4) (see also FIG. 44). Indeed, it is obvious that the particle rotation radium $R_c$ is proportional to its energy $E-mc^2\gamma$. Hence with the growth the energy, the radius grows also.

Then the motion dynamics of accelerated particles in the systems of this type is discussed. For this, the circularly polarized system shown in FIGS. 24 and 37 is chosen. The projections of particle trajectories on a transverse plane of this system are shown in FIG. 45. Here: 970 are the particle trajectory; 977 are the force lines of the electric field; 974 is the inductor; 976 is the direction of vector of induction of the changing in time magnetic field within the inductor 976; 978 are directions of the vector of induction of the magnetic field, which generates the turning system. The four positively charged particles with numbers 1, 2, 3, and 4 (see also FIG. 44) posses different energies and they move (under action of the magnetic field 978) on spiral-like trajectories along the longitudinal axis of the system. In a transverse plane, these trajectories have the form of closed circles 970. According with the above statement, the circle with the radius $R_1$ corresponds to the particle of lower energy and the particle with higher energy moves on trajectory of radium $R_4$. The position 972 shows the force lines of vortex electric field $E_1'$ and $E_2'$, respectively. This field is generated by magnetic material inductor 974, where magnetic field 976 is slowly changing in time and it is perpendicular to the drawing plane. In view of the azimuthal symmetry of the discussed system the intensity of the vortex electric field that acts at that particle with number j=1, 2, 3, 4 turns out to be depended only on the trajectory radium $R_j$:

$$E \cong E_j(1/R_1) \tag{5}$$

(Note: it should be not mistaken the values $E_{1,2}$ (for j=1 or j=2) and $E_{1,2}'$, respectively; $E_{1,2}$ are intensity of the electric field in points at radiuses $R_{1,2}$ ). The work performed by the vortex electric field under acceleration of some j-th particle can be calculated by following manner:

$$A_j = 2\pi R_j q E_j(1/R) \tag{6}$$

where q is the charge of the particle. Correspondingly, the difference in the work, which is performed on particles with numbers j=1 and j=4 is:

$$\Delta A = A_4 - A_1 = 2\pi q[R_4 E_4(1/R_4) - R_1 E_1(1/R_1)] \tag{7}$$

On the other hand the expression for difference of energies $\Delta E = E_4 - E_1$ of these particles can be found by using the formula (3) and the definition of the relativistic factor $\gamma = E/mc^2$:

$$\Delta E = \frac{\Delta R}{R_1}\frac{E_1^2 - m^2c^4}{E_1}, \tag{8}$$

where $\Delta R = R_4 = R_1$, explanation of other values are given above. The cooling effect can be determined as compensation (particular or total) of the energy difference (8) by the difference of works of the vortex electric field (7):

$$\Delta A < 0,\ |\Delta A| \sim \Delta E. \tag{9}$$

In the specifically discussed design example the cooling condition (9) can be rewritten by using the expressions (7) and (8):

$$2\pi q[R_4 E_4(1/R_4) - R_1 E_1(1/R_1)] + \frac{\Delta R}{R_1}\frac{E_1^2 - m^2c^4}{E_1} \sim 0. \tag{10}$$

It is understood that for the simplest case as represented in FIGS. 24, 37, and 45, the condition (10) cannot be reached satisfactory, i.e., this design cannot be used as a cooling system. Indeed, here the dependency $E_j(R_j)$ by virtue of the mentioned asizuthal symmetry of this system can be represented in the form:

$$E \cong a/R_j, \tag{11}$$

where a is some known constant, which depends on the system parameters. Substituting the formula (11) in the cooling condition (10) shows that the latter is not satisfied. However, the system in FIG. 24 can be transformed into an accelerator-cooler by some design modification. For instance, it can be done by violation of its asimuthal symmetry. An illustration of this design idea is presented in FIG. 46. Here: 984 are the directions of the vector of induction of magnetic field, generated within a turning system; 986 is the spiral-like ferrite inductor; 988 is the direction of the vector of induction of magnetic field, generated within ferrite inductor 986, 990 are the particle trajectories. The ferrite inductor 988 is accomplished in the spiral form. Moreover, the center of any cross-section does not coincide with the center of symmetry of the acceleration channel. Apart from that, the radiuses of the force lines of the vortex electric field do not equal to the radiuses of particle trajectories 990. As a result, the relevant cooling condition of the type (10) is satisfied in some combinations of design parameters of the system. Such a combination is calculated on the basis of the condition similar to (10), which can be obtained for a given case by using the definition (9).

The analogous situation takes place for some designs of the turning systems (see FIG. 15). The method of transforming these designs into a cooler-accelerator is the same—it is a violation of having an azimuthal symmetry of the system. This assertion can be illustrated with the design example shown in FIGS. 47 and 48. In particular, in FIG. 47 is shown illustration example for a turning system of a "split-pole" type. Here: 996 is the input charged particle beam; 998 are the force lines of the electric field; 1000 is the ferrite (magnetic material) inductor; 1002 are the trajectories of four different particles; 1004 is the output charged particle beam; 1006 is one of two magnetic poles (the crosses are the directions of the magnetic field between these poles).

Figure 47:
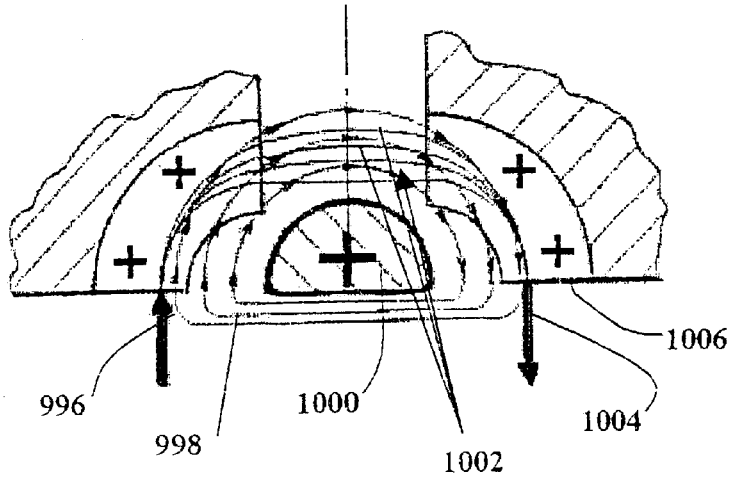
FIG. 47 is a schematic partial sectional view of a steering magnetic system combined with an accelerating arrangement incorporating a "split-poles" feature.
Figure 48:
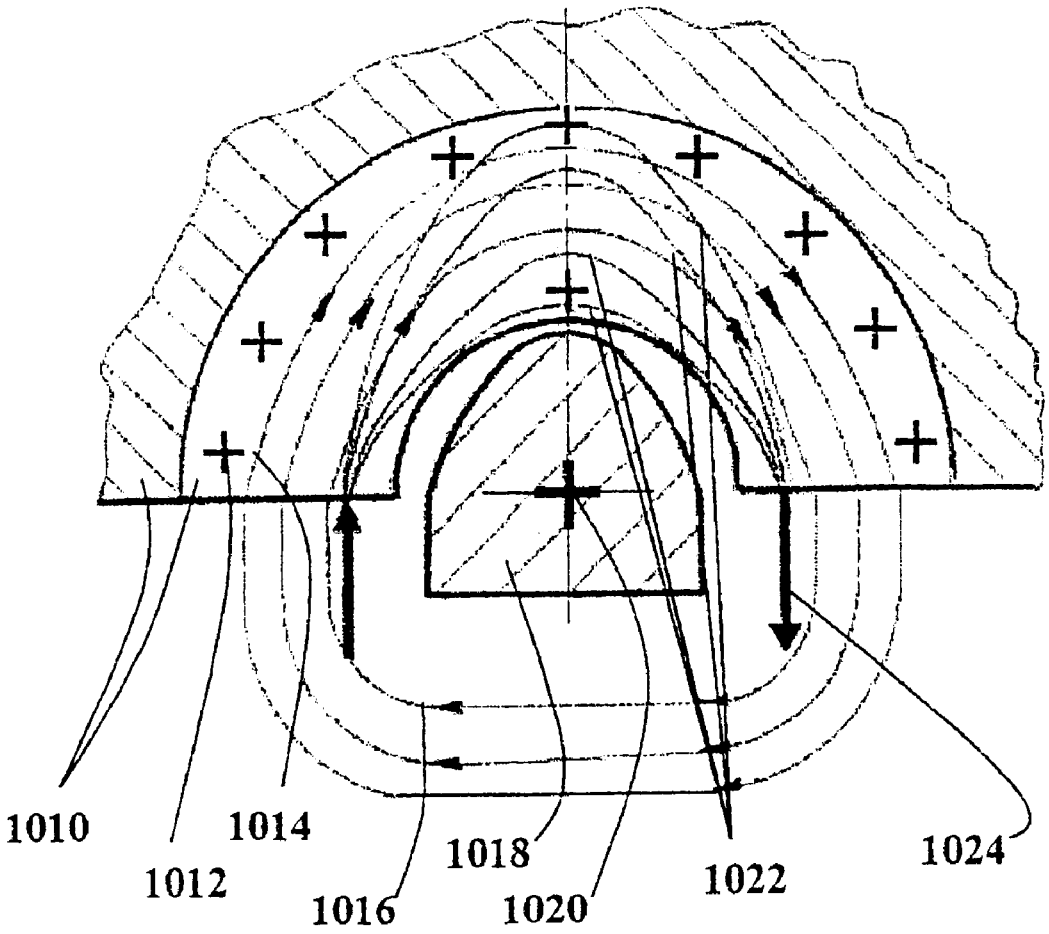
FIG. 48 shows a steering assembly similar to FIG. 48 but without the "split-poles" feature.

The system in FIG. 48 is different from the system in FIG. 47 only in the shape of the magnetic poles. In this case the poles are not "split". Here: 1010 is the magnet poles; 1012 are the directions of the magnetic field between the poles 1010; 1014 are the force lines of the electric field; 1016 is the input charged particle beam; 1018 is the ferrite (magnetic material) inductor; 1020 is the direction of the magnetic field within ferrite inductor 1018; 1022 are the trajectories of four different charged particle of beam 1016; 1024 is the output charged particle beam. The forms of the force line 998, 1014, as well as the form of particle trajectories 186, 195, are like circular arcs. However, it can be seen that in these cases, the spatial symmetry between the force 998, 1014 (which characterize the vortex electric field generated by the ferrite (magnetic material) inductors 1000, 1018), on the one hand, and the particle trajectories 1007, 1022, on the other hand, is violated. As a result, the input particle beams 996, 1016 after turning and accelerating in the output 1004, 1026 become cooled.

As discussed in connection with FIG. 15, the steering arrangements of FIGS. 47 and 48 achieve an improved, potentially closer, radius of turning in combination with a desirable acceleration of the particles in the turning particle beams. The cooling effect evoked in this design achieves what may be termed a "focusing" of the beams as they enter the steering system for turning purposes and exit as a focused beam. Recall the earlier observation that the beams will tend to diffuse or "fringe" as they enter the turning or steering assemblies. Thus, with the initial embodiment of the latter two figures, an accelerating surface region is located in adjacency with the core assembly pole faces and is excited by an associated field winding to derive a crossed electric field for imparting energy to the affected particles within the noted directional transitional regions. The so-called "split-pole" construction of FIG. 47 achieves a compactness in the steering assemblies by providing a gap or slot between magnetic poles which tends to straighten or linearize the trajectories of the particle during the turning maneuver. The noted slot is shown at the top of the figure. In effect, a hybrid arrangement for turning is provided by including a particle accelerating electric field and a turning magnetic field generated separately as a component of the turning or steering assembly.

Figure 49A:
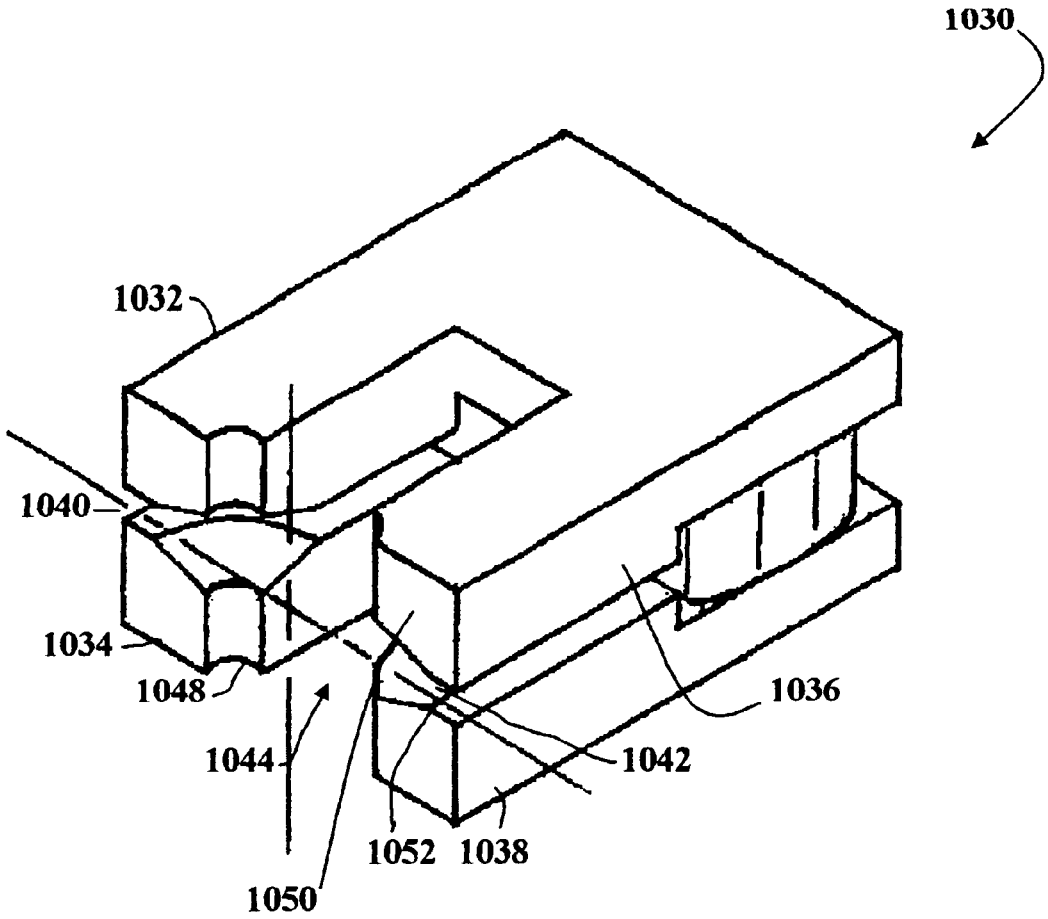
FIG. 49A is a perspective drawing of a turning assembly employed with the invention.
Figure 49B:
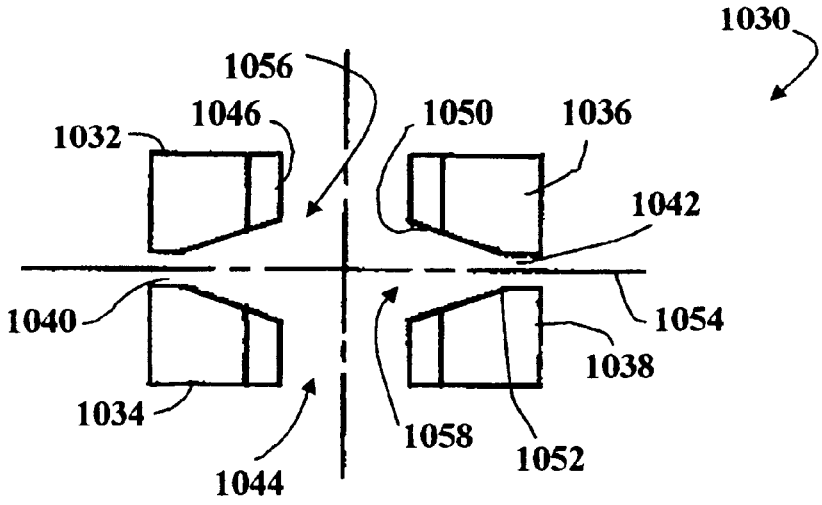
FIG. 49B is an end view of the turning assembly or steering assembly shown in FIG. 49A.

Referring to FIGS. 49A and 49B, a perspective view as well an end view of a steering assembly are shown respectively. In FIG. 49A, a steering assembly, for example, as earlier described in 302 in connection with the FIGS. 15A and 15B is represented in general at 1030. The assembly 1030 is seen to be formed in a split-pole fashion, having polar north and south components or paired legs 1032 and 1034 which are spaced apart from corresponding parallel paired legs 1036 and 1038. Note that a gap will be present between the paired legs, as represented at gap 1040 between legs 1032 and 1034 and at gap 1042 spacing leg 1036 from leg 1038. Such paired components as shown are, in turn, spaced apart to define a vertically oriented slot represented generally at 1044. The width of the slot or gap can be adjusted by the user for the purpose of linearizing the electric field and, as a consequence, linearizing the particle path projection as discussed earlier, for example, in connection with FIG. 47. Such variation in the effective turning radius can be utilized, for example, in connection with turning or steering called for in embodiments such as described earlier in connection with FIG. 41.

Note in FIG. 49A that the legs 1032 and 1034 are chamfered or the radius defined by the gap face is enlarged as represented respectively at 1046 and 1048. In similar fashion, a chamfered or radial enlargement is provided with respect to the faces of legs 1036 and 1038 respectively at 1050 and 1052. For clarity, a line defining a plane of particle path turning is represented in FIG. 49B at 1054. It may be observed in that figure in connection with magnetic field flux path lines as shown generally at 1056 and 1058 that the magnetic field intensity will decrease as it widens toward the center of the center gap or slot 1044. This entire arrangement along with the chamfered or radially enhanced regions affords the user a particle beam focusing capability to accommodate the geometry of the accelerator involved.

Figure 44:
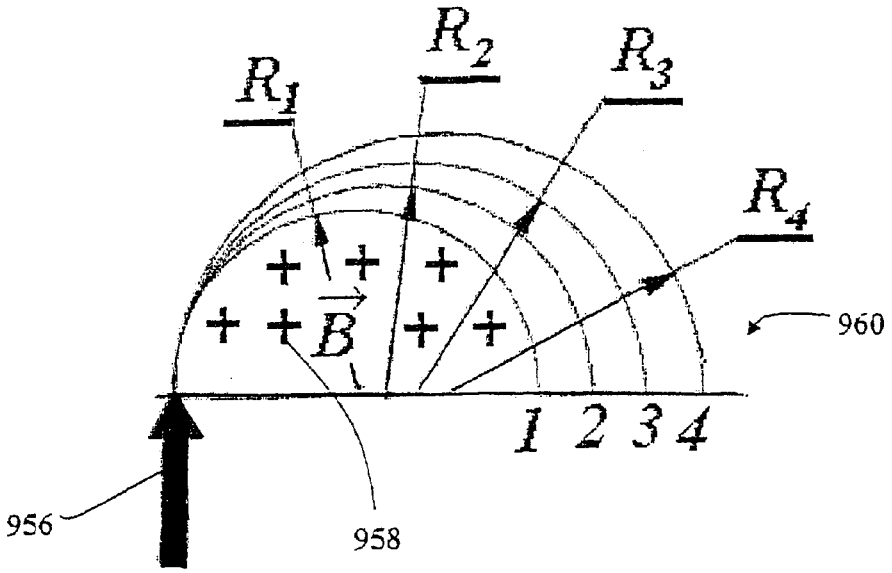
FIG. 44 is a schematic representation showing the effect of dispersion of particles in a uniform magnetic field.
Figure 45:
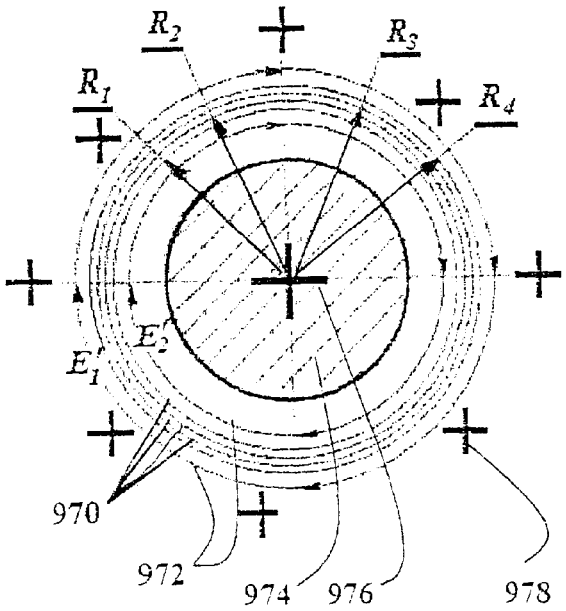
FIG. 45 illustrates projections of trajectories of particles on a transverse plane.
Figure 46:
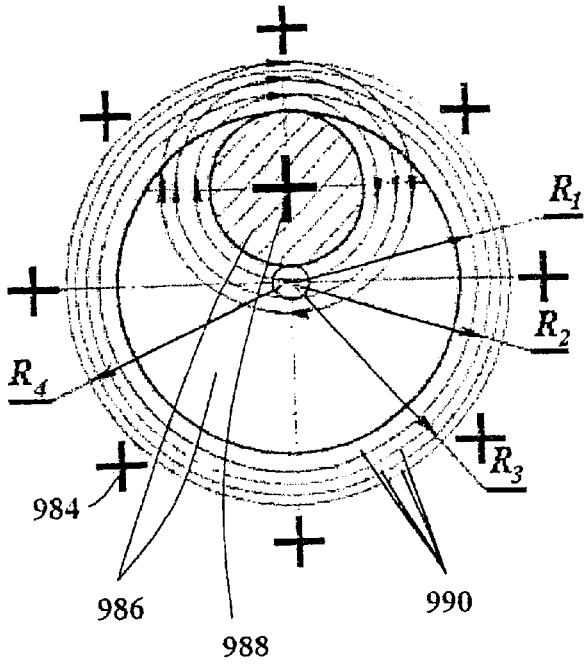
FIG. 46 is an illustration showing the projection of particle trajectories on a transverse plane and is associated with the embodiments of FIGS. 27 and 37.

The reader is re-directed to the discourse associated with FIG. 44 concerning the phenomena of turning a particle beam in connection with an imposed magnetic force. It may be recalled and further observed that a turning activity provided the part of the magnetic field is one which does not affect the velocity of the particles of the beam, but only affects the direction of their movement. By contrast, the electric field influence is one which well may influence speed. Gradient magnetic fields as described at 1056 and 1058 are highly advantageous for the turning functions involved. Those versed in the discipline of physics readily will be impressed with the unique utilization of speed.

What is claimed is:

1. A method for accelerating particles to a given particle energy utilizing an EH-undulated accelerator structure with an energized particle output direction, comprising the steps of:

(a) providing a source of particles to be energized by acceleration;

(b) providing an acceleration channel with said structure of spatially constrained configuration derived in correspondence with directional transition regions and substantially surmounted by a magnetic core and winding assembly excitable from an associated distributed time varying current source to generate a magnetic field about said acceleration channel and a corresponding crossed electric field having particle accelerating vectors with generally undulating acceleration directions along said acceleration channel, said channel extending from an accelerator input to an accelerator output said core comprising a magnetic material effective to generate said magnetic field;

(c) providing a magnetic steering assembly positioned with respect to said directional transition regions and effective to derive undulative transitions of said acceleration directions;

(d) introducing said particles from said source to said accelerator input;

(e) actuating said distributed current source to derive said magnetic field and said crossed electric field to effect acceleration of said particles to form a path of energized particles within a select path route along said acceleration channel;

(f) steering said path of particles within said acceleration channel with said steering assembly to derive, with said magnetic and crossed electric fields, a said path of energized particles having a system directional vector corresponding with said output direction; and (g) directing said path of energized particles from said accelerator output.

2. The method of claim 1 in which said step (d) for actuating said distributed current source is carried out with frequencies in the range of about 0.1 Megahertz to 10 Gigahertz.

3. The method of claim 1 in which:

said step (a) for providing a source of particles provides said source as a source of neutral molecules which are converted to an ionized plasma which, in turn is introduced to said accelerator input.

4. The method of claim 3 in which said step (a) for providing a source of particles includes the steps of:

(a1) providing a microwave generator coupled to receive said ionized plasma and actuable to modulate said ionized plasma to provide a modulated plasma output; and (a2) actuating said microwave generator and introducing said modulated plasma output into said accelerator input.

5. The method of claim 4 in which said step (a1) for providing a microwave generator includes the actuation of said microwave generator to extract positive and negative particles; and including the steps of:

(a3) providing a charged particle separator having a separator input for receiving said positive and negative particles, said separator input communicating with first and second separator paths extending to said accelerator input; and (a4) controlling said charged particle separator to direct said positive ion particles along said first path and said negative ion particles along said second path.

6. The method of claim 5 including the step of:

(a5) effecting a merging of said first and second paths at said accelerator input.

7. The method of claim 1 in which:

said step (a) for providing a source of particles includes the steps of:

(a1) providing a first source of negative particles as a negative particle electron beam;

(a2) providing a second source of particles as a positive ion beam;

(a3) merging said first and second sources of particles to provide a merged beam pair of negative and positive particles;

(a4) introducing said merged beam pair into said accelerator input; and said step (b) provides said acceleration effective to accelerate said negative particles from said first source in said acceleration channel along a first path route and directed to said acceleration output, and effective to accelerate said particles from said second source in said acceleration channel along a second path route to derive an energized particle quasi-neutral particle beam at said accelerator output.

8. The method of claim 1 in which:

said step (a) for providing a source of particles includes the steps of:

(a1) providing a first source of particles as a positive ion beam;

(a2) providing a second source of particles as an electron beam exhibiting a first energy;

(a3) providing a third source of particles as an electron beam exhibiting a second energy different than said first energy;

(a4) merging said first, second and third sources of particles to provide a merged beam of positive and negative particles;

(a5) introducing said merged beam of particles into said accelerator input; and said step (b) provides said acceleration channel of configuration effective to accelerate said particles from said second and third source in said acceleration channel along a first path route having said system directional vector directed to said accelerator output, and effective to accelerate said particles from said first source in said acceleration channel along a second path route having said system directional vector to derive an energized particle quasi-neutral particle beam at said accelerator output.

9. The method of claim 8 in which said step (a) for providing a source of particles includes the steps of:

(a6) providing a microwave generator coupled to receive said merged beam of positive and negative particles, said merged beam exhibiting an unstable frequency characteristic, said generator being actuable to pass components of said merged beam exhibiting a select said frequency characteristic; and (a7) actuating said microwave generator.

10. The method of claim 1 in which said step (b) provides said acceleration channel as a sequence of adjacent linear substantially parallel accelerator stages from first to nth, each stage having a linear stage acceleration channel with a channel entrance and a channel exit, the channel exit of said first stage, and each next said stage until said nth stage, being associated in particle transfer relationship with the channel entrance of each next said stage of said sequence at a said directional transition region, and the channel exit of said nth stage being at said accelerator output.

11. The method of claim 10 in which said linear stage acceleration channels of said first through nth stages are disposed in substantially coplanar fashion.

12. The method of claim 10 in which:

each said accelerator stage is provided having two, mutually oppositely disposed core and winding components, each having two pole faces of opposite polarity, said two pole faces of each two components being mutually oppositely disposed from each other to define a said linear stage acceleration channel, and said pole faces sequentially alternating in polarity from said first to said nth stage.

13. The method of claim 10 in which each said accelerator stage is provided having magnetic material core and winding components, each defining a said linear stage acceleration channel.

14. The method of claim 13 in which said magnetic material cores of said core and winding components defining a said linear stage acceleration channel are provided as being integrally formed together to provide said first to nth stages.

15. The method of claim 1 in which said step (b) provides said acceleration channel as:

a first sequence of substantially linear and parallel accelerator stages from first to last, each stage having a linear stage acceleration channel with a channel entrance and a channel exit;

a second sequence of substantially linear and parallel accelerator stages from first to last, each stage having a linear stage acceleration channel with a channel entrance and a channel exit;

said second sequence of accelerator stages being spaced from said first sequence of accelerator stages;

the channel entrance of said first stage of said first sequence being in particle receiving relationship with said accelerator input; and the channel exit of said first stage of said first sequence being associated in particle transfer relationship with the channel entrance of said first stage of said second sequence to define a said directional transition region, a said directional transition region being defined between select linear accelerator stages of respective said first and second sequences of said accelerator stages.

16. The method of claim 1 in which said step (b) provides said acceleration channel as:

a first sequence of adjacent substantially linear and parallel accelerator stages from first to last, each stage having a linear stage acceleration channel with a channel entrance and a channel exit, the channel exit of said first stage being associated in particle transfer relationship with the channel entrance of the next adjacent said stage of said first sequence to define a said directional transition region, a said directional transition region being defined between successive adjacent said accelerator stages of said first sequence;

a second sequence of adjacent substantially linear and parallel accelerator stages from first to last, each stage having a linear stage acceleration channel with a channel entrance and a channel exit, the channel entrance of said first stage being associated in particle transfer relationship with the channel exit of said last accelerator stage of said first sequence to define a said directional transition region and the channel exit of said first stage of said second sequence being associated in particle transfer relationship with the channel entrance of the next said stage of said second sequence to define a said directional transition region, a said directional transition region being defined between successive said accelerator stages of said second sequence, said last accelerator stage linear stage acceleration channel exit being at said accelerator output.

17. The method of claim 15 in which said step (b) provides said acceleration channel as:

a first sequence of spaced apart substantially linear and parallel accelerator stages from first to last, each stage having a linear stage acceleration channel with a channel entrance and a channel exit;

a second sequence of spaced apart substantially linear and parallel accelerator stages from first to last, each stage having a linear stage accelerator channel with a channel entrance and a channel exit and each stage being located intermediate and in adjacency with two successive stages of said first sequence of accelerator stages;

a third sequence of spaced apart substantially linear and parallel accelerator stages from first to last, each stage having a linear stage acceleration channel with a channel entrance and a channel exit, said third sequence being spaced from said first and second sequences;

a fourth sequence of spaced apart substantially linear and parallel accelerator stages from first to last, each stage having a linear stage accelerator channel with a channel entrance and a channel exit and each stage being located intermediate and in adjacency with two successive stages of said third sequence of accelerator stages;

the channel entrance of said first stage of said first sequence providing a first said accelerator input;

the channel entrance of said first stage of said second required providing a second said accelerator input;

the channel exit of said first stage of said first sequence being associated in particle transfer relationship with the channel entrance of said first stage of said third sequence to define a said directional transition region, a said directional transition region being defined between successive linear accelerator stages of respective said first and third sequences of said accelerator stages; and the channel exit of said first stage of said second sequence being associated in particle transfer relationship with the channel entrance of said first stage of said fourth sequence to define a said directional transition region, a said directional transition region being defined between successive linear accelerator stages of respective said second and fourth sequences of said accelerator stages.

18. The method of claim 17 in which said step (b) provides said acceleration channel accelerator output as a first accelerator output carrying accelerated particles from said last stage of said third sequence, and a second accelerator output carrying accelerated particles from said last stage of said fourth sequence.

19. The method of claim 17 in which said step (b) provides said accelerator channel wherein said linear and parallel stages of said first, second, third and fourth stages are arranged in mutually parallel relationship.

20. The method of claim 15 or 16 in which said spacing between said first and second sequence of accelerator stages is selected in correspondence with the energy exhibited by said energized particles.

21. The method of claim 15 or 16 in which:

each said accelerator stage of said first and second sequences is provided having two, mutually oppositely disposed magnetic material core and winding components mutually oppositely disposed from each other to define a said linear stage acceleration channel.

22. The method of claim 21 in which said magnetic material cores of said magnetic material core and winding components of said first sequence are provided as being integrally formed together.

23. The method of claim 22 in which said magnetic material cores of said magnetic material core and winding components of said second sequence are provided as being integrally formed together.

24. The method of claim 21 in which said magnetic material cores of said magnetic material core and winding components of both said first and second sequences are provided as being integrally formed together.

25. The method of claim 1 in which:

said step (a) providing a source of particles, provides a first source of particles exhibiting a first particle characteristic, and a second source of particles exhibiting a second particle characteristic different from said first particle characteristic;

said step (b) provides said acceleration channel as;

a first sequence of substantially linear and parallel accelerator stages from first to last, each stage having a linear stage acceleration channel with a channel entrance and a channel exit, the channel entrance of said first stage being a said accelerator input for receiving particles from said first source of particles, the channel exit of said first stage and each next said stage until said last stage being associated in particle transfer relationship with the channel entrance of a next said stage of said first sequence to define a said directional transition region, and the channel exit of said last stage being a first said accelerator output;

a second sequence of substantially linear and parallel accelerator stages from first to last, spaced from said first sequence, each stage of said second sequence having a linear stage acceleration channel with a channel entrance and a channel exit, the channel entrance of said first stage being a said accelerator input for receiving particles from said second source of particles, the channel exit of said first stage and each next stage until said last stage being associated in particle transfer relationship with the channel entrance of a next said stage of said second sequence to define a said directional transition region, and the channel exit of said last stage being a second said accelerator output; and including the step of:

(b1) merging said first and second accelerator outputs to provide a composite particle beam output.

26. The method of claim 1 in which said step (b) for providing an acceleration channel provides said channel as first through n sequences of adjacent substantially linear and parallel accelerator stages from first to last, said stages of each sequence being substantially radially aligned with and parallel to a longitudinal axis and being mutually radially spaced apart, each of said accelerator stages of each said radially aligned first through n sequences having a linear stage acceleration channel with a channel entrance and a channel exit, the channel entrance of said first accelerator stage being said accelerator input, the channel exit of said first accelerator stage and each next said accelerator stage, until said last stage, being associated in particle transfer relationship with the channel entrance of a next said accelerator stage to define a said directional transition region, the channel exit of the said last accelerator stage being said accelerator exit.

27. The method of claim 26 in which said first accelerator stage of said first sequence and the last said accelerator stage of said nth sequence are disposed radially outermost from said axis.

28. The method of claim 26 in which said step (b) for providing an acceleration channel provides a common acceleration channel disposed about said axis and serving as a common acceleration channel for one accelerator stage of each said first through n sequences.

29. The method of claim 26 in which:

said step (b) provides said acceleration channel with a said surmounted time varying current source deriving a said magnetic field which field lies within planes perpendicular to said longitudinal axis.

30. The method of claim 29 in which:

said step (b) provides said crossed electric field along a vector substantially coincident with said output direction.

31. The method of claim 1 in which:

said step (b) for providing an acceleration channel provides said channel as a sequence of first through last of linear accelerator stages extending in parallel from a central axis of said core and winding assembly, each said accelerator stage having a linear acceleration channel with a channel entrance and a channel exit, the channel exit of each said stage from said first stage through the next to said last stage being associated in particle transfer relationship with the entrance of a said stage to define said directional transition regions;

said step (d) introduces particles to said accelerator input at said channel entrance of said first stage; and said step (g) directs said path of energized particles from the channel exit of said last accelerator stage.

32. The method of claim 31 in which:

said step (c) provides a said magnetic steering assembly for deriving said undulative transitional between said channel exit of the next to last stage and said last stage as an electromagnetic steering assembly actuable to carry out said step (f) for steering said path of particles and further actuable to effect carrying out of said step (g) directing said path of energized particles by directing said particles from said last stage as said accelerator output.

33. The method of claim 32 in which:

said step (f) effects said steering of said path of particles fashion from said first through last stages with a select number of reiterations, whereupon said step (g) is carried out.

34. The method of claim 31 in which:

said step (b) provides said accelerative channel first through last linear accelerator stages as being radially aligned about a central axis of said core and winding assembly.

35. The method of claim 1 in which:

said step (c) provides said magnetic steering assembly as a core assembly formed of magnetically responsive material having spaced apart polar-designated pole faces positioned at said directional transition region, a source of magnetization magnetically coupled with said core assembly to derive a magnetic field intermediate said pole faces, and said pole faces being located to effect an interception of said path of energized particles to cause it's directional alteration in conformance within said spacially constrained configuration of said acceleration channel.

36. The method of claim 35 in which said step (c) provides said source of magnetism as comprising a permanent magnet assembly deriving said magnetic field at a predetermined field strength corresponding with the energization of said particles and the geometry of said directional alteration.

37. The method of claim 35 in which said step (c) provides said source of magnetism as comprising a permanent magnet assembly for deriving a said magnetic field at a given field strength, and an electromagnet assembly coupled with said core assembly and selectively energizable to alter said given field strength.

38. The method of claim 36 in which said step (c) provides said core assembly as having first and second mutually isolated extensions, each being magnetically coupled with said permanent magnet assembly in a unique polar sense, and said electromagnet assembly comprises a first electromagnetic winding coupled in flux transfer relationship with said first extension and a second electromagnetic winding coupled in flux transfer relationship with said second extension.

39. The method of claim 35 in which:

said step (c) provides said magnetic steering assembly as further comprising a steering accelerator assembly having an accelerator core assembly with an electromagnetic winding excitable with a time varying current, and a steering component formed of magnetic material in flux transfer communication with said particle-accelerating accelerator core assembly and having an accelerating surface region in spaced adjacency with said core assembly pole faces and excitable from said winding to derive an electric field for imparting energy to said particles at a said directional transition regions.

40. The method of claim 39 in which:

said step (c) provides said magnetic steering assembly as comprising a said core assembly wherein said pole faces are configured with mutually cooperating curvatures for promoting said path of energized particles directional alteration in correspondence with said curvature.

41. The method of claim 1 in which:

said step (b) provides said acceleration channel as a generally spiral-shaped channel extending about a generally cylindrically shaped said core and winding assembly disposed about a longitudinal axis and extending from said accelerator input to said accelerator output, and to which said distributed time varying current source is applied;

said step (c) provides said magnetic steering assembly as a spirally shaped bifurcate magnetic steering core having spaced apart pole faces located in spaced adjacency with said core and winding assembly to define therewith said generally spiral shaped channel and effect guidance of said energized particles along a spiral said path route having a said system directional vector with a component generally parallel with said axis.

42. The method of claim 1 in which:

said step (a) provides said source of particles as negative ions;

said step (e) accelerates said negative ions to form said path of accelerated particles as a path of negative ion particles; and said step (g) includes the step of providing a stripping target for intercepting said path of negative ion particles to derive a path of energized neutral particles at said accelerator output.

43. The method of claim 1 in which:

said step (a) provides said source of particles as protons;

said step (c) accelerates said protons from said source to form said accelerated particles as a path of positive ion particles; and said step (g) includes the step of forming a path of energized neutrons as said accelerator output.

44. The method of claim 1 in which said step (b) provides said acceleration channel as:

a first sequence of adjacent substantially linear and parallel accelerator stages from first to last, each having a linear stage acceleration channel with a channel entrance and a channel exit said channel entrances and channel exits being alternately oppositely disposed from respective first through last accelerator stages;

a second sequence of adjacent, substantially linear and parallel accelerator stages from first to last, each stage having a linear stage acceleration channel with a channel entrance and a channel exit, said channel entrances and channel exits being alternately oppositely disposed from respective said first through last stages of said second sequence;

said second sequence of accelerator stages being spaced from said first sequence of acceleration stages;

the channel entrance of said first stage of said first sequence being in particle receiving relationship with said accelerator input;

the channel exit of said first stage of said first sequence being in particle transfer relationship with the channel entrance of said first stage of said second sequence;

the channel exit of each alternate said stage, from second through last half said stages of said first sequence being in particle transfer relationship with the entrance of each channel of each next adjacent stage of said first sequence;

the channel exit of each alternate said stage from second through the next to said last stage of said second sequence being in particle transfer relationship with the channel entrance of each channel of each next adjacent stage of said second sequence; and the channel entrance of each alternate said stage from second through next to last of said first sequence being in particle transfer relationship with the channel exit of each alternate said state from second to next to last of said second sequence.

45. The method of claim 1 in which:

said step (b) provides said acceleration channel as:

a first sequence of accelerator stages from first to last, each stage having an acceleration channel with a channel entrance and a channel exit, said channel entrance and channel exits of said first sequence being alternately oppositely disposed to define first sequence first and second transition regions;

a second sequence of accelerator stages from first to last, spaced from said first sequence, each stage having an acceleration channel with a channel entrance and a channel exit, said channel entrances and said channel exits of said second sequence being alternately oppositely disposed to define second sequence first and second transition regions;

said step (c) provides said steering assembly as:

a first steering assembly located in particle transfer association between said first transition regions of said first and second sequences;

a second steering assembly located in particle transfer association with said first through last stages of said first sequence; and a third steering assembly located in particle transfer association with said first through last stages of said second sequence.

46. Apparatus for accelerating particles to given particle energy, utilizing an EH-undulated accelerator comprising:

(a) a source of particles;

(b) an acceleration channel configured having a magnetic material core assembly defining a particle path direction within a spacially constrained configuration, said channel being surmounted by a winding assembly excitable with a time varying current generating a corresponding time varying magnetic field within said core assembly and a corresponding time varying crossed electric field exhibiting particle accelerating vectors along said acceleration channel for energizing said particles along said path, said acceleration channel extending from an acceleration input for receiving said particles from said source to an accelerator output for expelling an energized particle beam;

(c) a current source for applying said time varying current to excite said winding assembly, said time varying current exhibiting a frequency greater than about 0.1 MHz; and (d) said magnetic material being effective to support the inductive generation of said time varying magnetic field.

47. The apparatus of claim 46 in which said current source is a current at a frequency within the range of about 0.1 MHz to 10 GHz.

48. The apparatus of claim 46 in which said magnetic material exhibits a relative permeability within a range of about 100 to 200.

49. The apparatus of claim 46 in which said magnetic material exhibits a B field saturation of about 0.2 to 0.5 Tesla.

50. The apparatus of claim 46 in which said source of particles comprises:

a source of neutral particles;

a discharge chamber receiving said neutral particles, having a magnetic containment assembly and excitable to form an ionized plasma deriving charge-carrying particles from said neutral particles and providing said charge-carrying particles as said source of particles; and a current source for exciting said discharge chamber.

51. The apparatus of claim 50 in which said source of particles further comprises a microwave generator responsive to said charge carrying particle, to derive modulated charge carrying particles as a said source of particles.

52. The apparatus of claim 51 in which said source of particle further comprises:

a charged particle separator having a separator input for receiving said modulated charge carrying particles and deriving a said source of particles as positively charged particles located within a first separator path and negatively charged particles located within a second separator path.

53. The apparatus of claim 46 in which said source of particle comprises:

a first source of particles present as a positive ion beam;

a second source of particles present as a negative particle beam exhibiting a first energy level;

a magnetic merging stage responsive to said first and second sources of particles to derive a merged beam comprised of positive and negative particles as particles from said source of particles.

54. The apparatus of claim 53 in which said source of particles further comprises:

a third source of particles present as a negative particle beam exhibiting a second energy different from said first energy; and said magnetic merging stage is responsive to said first, second and third sources of particles to derive a said merged beam.

55. The apparatus of claim 54 in which said source of particles further comprises:

a microwave generator responsive to said first, second and third sources of particles deriving said merged beam exhibiting an unstable frequency characteristic to pass components thereof exhibiting a select said frequency characteristic.

56. The apparatus of claim 46 in which:

said acceleration channel core assembly comprises a said core assembly defining a sequence of adjacent said channels each surmounted by a said winding assembly to form a sequence of accelerator stages from first to nth, each with a channel entrance and a channel exit, the channel exit of said first stage and each next said stage until said nth stage being associated in particle transfer relationship with the channel entrance of each next said stage of said sequence at an acceleration channel directional transition region; and including a magnetic steering assembly positioned with respect to each said directional transition region effective to transfer particles from a said channel exit to a channel entrance.

57. The apparatus of claim 56 in which each said accelerator stage comprises:

a said core assembly having first and second core components;

said winding assembly including first and second winding components operatively associated with each stage mounted in flux transfer relationship with respective said first and second core components to define two pole faces of opposite polarity;

said first and second core component pole faces being mutually oppositely disposed to define a said channel.

58. The apparatus of claim 56 in which said core assembly is formed of said magnetic material as an integral component having said sequence of channels extending therethrough.

59. The apparatus of claim 46 in which:

said acceleration channel comprises:

a first sequence of adjacent substantially linear accelerator stages from first to last each stage having a linear stage acceleration channel with a channel entrance and a channel exit;

a second sequence of adjacent substantially linear accelerator stages from first to last, each stage having a linear acceleration channel with a channel entrance and a channel exit;

the channel entrance of said first stage of said first sequence providing said accelerator input;

the channel exit of said first stage of said first sequence being associated in particle transfer relationship with the channel entrance of said first stage of said second sequence to define a directional transition region, a said directional transition region being defined between successive accelerator stages of respective said first and second sequence of said accelerator stages; and said apparatus includes a magnetic steering assembly positioned with respect to said directional transition regions and effective to transfer said energized particles from the said acceleration path defined by one said accelerator stage to the acceleration path of another said accelerator stage.

60. The apparatus of claim 46 in which:

said acceleration channel comprises:

a first sequence of adjacent substantially linear accelerator stages from first to last, each stage having an acceleration channel with a channel entrance and a channel exit, the channel exit of said first stage being associated in particle transfer relationship with a channel entrance of a next said stage of said first sequence to define a directional transition region, a said directional transition region being defined between successive said accelerator stages of said first sequence;

a second sequence of adjacent substantially linear accelerator stages from first to last, each stage having an accelerator channel with a channel entrance and a channel exit, the channel entrance of said first stage of said second sequence being associated in particle transfer relationship with the channel exit of said last accelerator stage of said first sequence to define a said directional transition region and the channel exit of said first stage of said second sequence being associated in particle transfer relationship with the channel entrance of the next adjacent said stage of said second sequence to define a said directional transition region, a said directional transition region being defined between successive said accelerator stages of said second sequence, the last said accelerator stage acceleration channel exit being at said accelerator output; and said apparatus includes:

a magnetic steering assembly positioned with respect to said directional transition regions and effective to transfer said energized particles from the acceleration path defined by one acceleration stage to the acceleration path of another acceleration stage.

61. The apparatus of claim 46 in which:

said source of particles comprises:

a first source of particle exhibiting a first particle characteristic, and a second source of particles exhibiting a second particle characteristic different from said first particle characteristic;

said acceleration channel comprises:

a first sequence of linear accelerator stages from first to last, each stage having an acceleration channel with a channel entrance and a channel exit, the channel entrance of said first stage being a said accelerator input for receiving particles from said first source of particles, the channel exit of said first stage and each next stage until said last stage being associated in particle transfer relationship with the channel entrance of a next said stage of said first sequence to define a directional transition region, and the channel exit of said last stage being a first said accelerator output;

a second sequence of linear accelerator stages from first to last, spaced from said first sequence, each stage of said second sequence having an acceleration channel with a channel entrance and a channel exit, the channel entrance of said first stage being a said accelerator input for receiving particles from said second source of particles, the channel exit of said first stage and each next stage until said last stage being associated in particle transfer relationship with the channel entrance of a next adjacent stage of said second sequence to define a said directional transition region, and the channel exit of said last stage being a second said accelerator output;

said apparatus includes:

a magnetic steering assembly positioned with respect to said directional transition regions and effective to transfer said energized particles from the acceleration path defined by one acceleration stage to the acceleration path of another acceleration stage; and a merging stage responsive to said first and second accelerator outputs for merging them into a composite particle beam output.

62. The apparatus of claim 46 in which:

said acceleration channel comprises:

first through n sequences of substantially linear and parallel accelerator stages from first to last, said accelerator stages of each sequence being substantially radially aligned with and parallel to a longitudinal axis and being mutually radially spaced apart, each of said accelerator stages of each said radially aligned first through n sequences having a linear acceleration channel with a channel entrance and a channel exit, the channel entrance of said first accelerator stage being said accelerator input, the channel exit of said first accelerator stage and each next accelerator stage, until said last stage, being associated in particle transfer relationship with the channel entrance of a next said accelerator stage, to define directional transition regions, the channel exit of the last accelerator stage being said accelerator exit; and said apparatus includes:

a magnetic steering assembly positioned with respect to said directional transition regions and effective to transfer said energized particles from the acceleration path defined by one acceleration stage to the acceleration path of another acceleration stage.

63. The apparatus of claim 62 in which said first accelerator stage of said first sequence and the last accelerator stage of said nth sequence are disposed radially outermost from said axis.

64. The apparatus of claim 62 in which said acceleration channel includes a common acceleration channel disposed substantially symmetrically about said longitudinal axis and configured to serve as a common acceleration channel for one accelerator stage of each said first through n sequence.

65. The apparatus of claim 46 in which:

said acceleration direction altering channel is incorporated within said spacially constrained configuration in correspondence with directional transition regions; and said apparatus includes a steering assembly positioned at said directional transition regions to maintain a said path of energized particles within said direction altering channel.

66. The apparatus of claim 65 in which said steering assembly comprises:

a core assembly formed of magnetically responsive material having spaced apart polar-designated pole faces positioned at a directional transaction region;

a source of magnetization magnetically coupled with said core assembly to derive a magnetic field intermediate said pole faces; and said pole faces being located to intercept energized particles at said directional transition region and cause their directional alteration in conformance with said spacially constrained configuration.

67. The apparatus of claim 66 in which said source of magnetization comprises a permanent magnet deriving said magnetic field at a predetermined field strength corresponding with the level of said energized particles.

68. The apparatus of claim 66 in which said source of magnetism comprises:

a permanent magnet deriving a said magnetic field at a given field strength; and an electromagnet assembly coupled with said core assembly and selectively energizable to alter said given field strength.

69. The apparatus of claim 67 in which:

said core assembly includes first and second mutually spaced apart extensions, each being magnetically coupled with said permanent magnet assembly in a unique polar sense; and said electromagnetic assembly comprises a first electromagnetic winding coupled in flux transfer relationship with said first extension and a second electromagnetic winding coupled in flux transfer relationship with said second extension.

70. The apparatus of claim 66 in which said magnetic steering assembly further comprises:

a steering accelerator assembly having an accelerator core assembly with a field-winding excitable with a time varying current; and a steering-particle-accelerating component formed of magnetic material coupled in flux transfer communication with said accelerator core assembly and having an accelerating surface region in spaced adjacency with said core assembly pole faces and excitable from said winding to carry a magnetic field and derive a crossed electric field for imparting to said particles at a said directional transition region.

71. The apparatus of claim 46 in which:

said acceleration channel has a generally spiral-shaped said channel extending about a generally cylindrically-shaped said core assembly and winding assembly having components located at a central region disposed about a longitudinal axis and extending from said accelerator input to said accelerator output; and a steering assembly including a spirally-shaped bifurcate magnetic steering core having spaced apart pole faces located in spaced adjacency with said central region to define said generally spiral-shaped channel and effect guidance of said energized particles.

72. The apparatus of claim 46 in which said accelerator channel core assembly defining particle path direction altering channel has a generally circular outer boundary of boundary widthwise dimension disposed about a longitudinal axis and extending from said accelerator input to said accelerator output, said winding assembly surmounting said core assembly adjacent to and spaced from said outer boundary, said core assembly comprising first to n sequences of dual stages from first to last, each stage having oppositely disposed stage core assemblies with stage field windings excitable from said current source and have pole faces spaced apart at said boundary.

73. The apparatus of claim 46 in which said acceleration channel comprises:

a first sequence of spaced apart substantially linear and parallel accelerator stages from first to last, each stage having a linear stage acceleration channel with a channel entrance and a channel exit;

a second sequence of spaced apart substantially linear and parallel accelerator stages from first to last, each stage having a linear stage accelerator channel with a channel entrance and a channel exit and each stage being located intermediate and in adjacency with two successive stages of said first sequence of accelerator stages;

a third sequence of spaced apart substantially linear and parallel accelerator stages from first to last, each stage having a linear stage acceleration channel with a channel entrance and a channel exit, said third sequence being spaced from said first and second sequences;

a fourth sequence of spaced apart substantially linear and parallel accelerator stages from first to last, each stage having a linear stage accelerator channel with a channel entrance and a channel exit and each stage being located intermediate and in adjacency with two successive stages of said third sequence of accelerator stages;

the channel entrance of said first stage of said first sequence providing a first said accelerator input;

the channel entrance of said first stage of said second sequence providing a second said accelerator input;

the channel exit of said first stage of said first sequence being associated in particle transfer relationship with the channel entrance of said first stage of said third sequence to define a directional transition region, a said directional transition region being defined between successive linear accelerator stages of respective said first and third sequences of said accelerator stages; and the channel exit of said first stage of said second sequence being associated in particle transfer relationship with the channel entrance of said first stage of said fourth sequence to define a said directional transition region, a said directional transition region being defined between successive linear accelerator stages of respective said second and fourth sequences of said accelerator stages; and said apparatus includes a magnetic steering assembly positioned with respect to each said directional transition region effective to transfer particles from a said channel exit to a channel entrance.

74. The apparatus of claim 73 in which said acceleration channel accelerator output comprises a first accelerator output carrying accelerated particles from said last stage of said third sequence, and a second accelerator output carrying accelerated particles from said last stage of said fourth sequence.

75. The apparatus of claim 74 in which said linear and parallel stages of said first, second, third and fourth stages are arranged in mutually parallel relationship.

76. A method for accelerating particles to a given particle utilizing an EH-undulated accelerator structure with an energized particle output direction, comprising the steps of:

(a) providing a source of particles;

(b) providing an acceleration channel having a generally curvilinear outer boundary disposed about a longitudinal axis generally parallel with said particle output direction and extending from an entrance region communicating with an accelerator input for receiving particles from said source to an exit region communicating with an accelerator output, a core and winding assembly surmounting said acceleration channel outer boundary and provided as first to n sequences of dual stages from first to last, each stage having oppositely disposed stage core assemblies with stage field windings excitable with a time varying current and having pole faces spaced apart at said boundary, said excitation being effective for each said stage to derive a magnetic field within said core assembly exhibiting a particle turning effect and a corresponding crossed electric field having a particle accelerating vector along said axis for effecting the acceleration of said particles from said entrance region toward said exit region along a curvilinear particle path;

(c) applying time varying currents to said core assembly field windings to effect said curvilinear-propagation; and (d) directing said particles from said path through said accelerator output as accelerated particles having said particle output direction.

77. The method of claim 76 in which:

said step (b) providing said acceleration channel provides each said core and winding assembly sequence from first to n as mutually oppositely disposed sequence and stage defining core legs formed of magnetic material extending to pole faces located in mutually oppositely facing relationship adjacent said border for deriving components of said electric field, at least one stage component of said field windings being associated in flux transfer relationship with a said core leg of each said stage.

78. The method of claim 77 in which said step (b) provides each said core and winding assembly sequence as first and second mutually oppositely disposed support cores formed of magnetic material, arranged generally in parallel relationship with said axis and each supporting a plurality of said stage defining core legs.

79. The method of claim 48 in which said field windings are wound about said first and second support cores.

80. The method of claim 76 in which:

said step (a) providing a source of particles, provides a first source, of particles exhibiting a first particle characteristic, and a second source of particles exhibiting a second particle characteristic different from said first particle characteristic; and said step (d) directs said particles from said path through said accelerator output as a composite beam of said accelerated particles.

81. The method of claim 80 in which said step (a) provide said first source of particles as positive charge particles and said second source of particles as negative charge particles.

82. The method of claim 76 in which:

said step (b) provides said acceleration channel core and winding assembly as having at least about four said sequences, each said stage of each said sequence being aligned with said axis along a generally common.

* * * * *